US006929906B2

(12) United States Patent
Ishii et al.

(10) Patent No.: US 6,929,906 B2
(45) Date of Patent: Aug. 16, 2005

(54) SILVER HALIDE COLOR PHOTOSENSITIVE MATERIAL

(75) Inventors: Yoshio Ishii, Minami-Ashigara (JP); Koji Takaku, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/695,815

(22) Filed: Oct. 30, 2003

(65) Prior Publication Data

US 2004/0101791 A1 May 27, 2004

(30) Foreign Application Priority Data

Nov. 1, 2002 (JP) ..... 2002-320237

(51) Int. Cl.[7] ..... G03C 1/46; G03C 1/08; G03C 7/26; G03C 7/32

(52) U.S. Cl. ..... 430/505; 430/544; 430/955; 430/957; 430/502; 430/614; 430/615

(58) Field of Search ..... 430/505, 955, 430/957, 544, 502, 614, 615

(56) References Cited

U.S. PATENT DOCUMENTS 4,686,175 A * 8/1987 Ogawa et al. ..... 430/505
5,766,820 A * 6/1998 Fukawa et al. ..... 430/264
5,851,753 A * 12/1998 Yamada et al. ..... 430/603
6,043,013 A 3/2000 Burns et al.
6,319,660 B1 11/2001 Allway et al.
6,350,564 B1 * 2/2002 Bringley et al. ..... 430/505
6,426,180 B1 * 7/2002 Bringley et al. ..... 430/955
6,455,242 B1 * 9/2002 Allway et al. ..... 430/505

FOREIGN PATENT DOCUMENTS

JP 62-27740 A 2/1987

* cited by examiner

*Primary Examiner*—Geraldine Letscher
(74) *Attorney, Agent, or Firm*—Sughrue Mion, PLLC

(57) ABSTRACT

A silver halide color photosensitive material comprises at least one light-sensitive silver halide emulsion layer and at least one nonlight-sensitive layer. At least one of the nonlight-sensitive layers contains colloidal silver. The colloidal silver-containing nonlight-sensitive layer or a nonlight-sensitive layer adjacent to the colloidal silver-containing nonlight-sensitive layer contains a compound capable of releasing a development inhibitor or a precursor thereof by a coupling reaction with an oxidized developing agent. At least one layer selected from the group consisting of the light-sensitive silver halide emulsion layer and the nonlight-sensitive layer contains a compound (B), which is a compound having at least three hetero atoms and capable of enhancing the photographic speed of the photosensitive material in comparison to the same photosensitive materials without the compound.

6 Claims, No Drawings

SILVER HALIDE COLOR PHOTOSENSITIVE MATERIAL

CROSS-REFERENCE TO RELATED APPLICATIONS

This application is based upon and claims the benefit of priority from the prior Japanese Patent Application No. 2002-320237, filed Nov. 1, 2002, the entire contents of which are incorporated herein by reference.

BACKGROUND OF THE INVENTION

1. Field of the Invention

The present invention relates to a silver halide color photosensitive material which is of high photographic speed and is superior in image quality and which exhibits a small fluctuation in photographic properties due to a development process applied thereto.

2. Description of the Related Art

In the field of silver halide color photosensitive materials, to increase the photographic speed of photosensitive materials is an important object.

It is known that the photographic speed of silver halide photosensitive materials is generally determined depending upon the size of silver halide emulsion grains contained therein.

In other words, it is possible to increase the photographic speed by use of large silver halide emulsion grains. However, it is also well known that the graininess is deteriorated with increase in size of silver halide grains. There is a trade-off between the photographic speed and the graininess.

Therefore, to increase the photographic speed without deteriorating the graininess is the most basic and important problem for the performance of photosensitive materials.

A method is known in which increase in photographic speed without causing no deterioration of graininess is accomplished by incorporating a compound having at least three hetero atoms which do not react with an oxidized developing agent to a silver halide photosensitive material (see Japanese Patent Application KOKAI Publication No. (hereinafter also referred to as "JP-A-") 2000-194085).

This method exhibits some effect of increasing in photographic speed. It, however, also exhibits some increase in fog fluctuation due to development process fluctuation, and therefore, is desired to be improved.

On the other hand, problems associated with the use of elemental silver in an antihalation layer or the like include an undesired increase in fog at image-forming layers. It is also known that this fog is very susceptible to development. There is known a method of reducing the undesired fog by use of a heterocyclic thiol compound having a defined Clog P (see JP-A-11-271930).

This method exhibits an effect of reducing fog. It, however, results in an increase in photographic property fluctuation due to storage of a photosensitive material, and therefore, some improvement is desired.

BRIEF SUMMARY OF THE INVENTION

A problem to be solved by the present invention is to provide a silver halide color photosensitive material which exhibits a high photographic speed and a high image quality, which exhibits a small fluctuation in photographic properties due to a development process thereof, and which exhibits an improved fluctuation in photographic properties due to the storage thereof.

The problem has been solved by the silver halide color photosensitive materials shown below:

(1) A silver halide color photosensitive material comprising at least one light-sensitive silver halide emulsion layer and at least one nonlight-sensitive layer, wherein at least one of the nonlight-sensitive layers containing colloidal silver; the colloidal silver-containing nonlight-sensitive layer or a nonlight-sensitive layer adjacent to the colloidal silver-containing nonlight-sensitive layer containing a compound capable of releasing a development inhibitor or a precursor thereof by a coupling reaction with an oxidized developing agent; and at least one layer selected from the group consisting of the light-sensitive silver halide emulsion layer and the nonlight-sensitive layer containing a compound (B) defined below:

compound (B): a compound having at least three hetero atoms and capable of enhancing the photographic speed of the photosensitive material in comparison to the same photosensitive materials without the compound.

(2) The silver halide color photosensitive material described in (1), wherein the compound capable of releasing a development inhibitor or a precursor thereof by a coupling reaction with an oxidized developing agent is a compound which generates substantially no color after the release of the development inhibitor or the precursor thereof.

(3) The silver halide color photosensitive material described in (1) or (2), wherein the compound (B) is a 1,3,4,6-tetraazaindene-based compound.

(4) The silver halide color photosensitive material described in (1) or (2), wherein the compound (B) is represented by the following general formula (M) or (C):

(M)

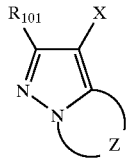

(C)

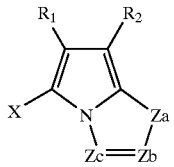

In the general formula (M), $R_{101}$ represents a hydrogen atom or substituent. Z represents a group of non-metallic atoms required to form a 5-membered azole ring containing 2 to 4 nitrogen atoms, wherein the azole ring may have a substituent or may have a condensed ring attached thereto. X represents a hydrogen atom or substituent.

In the general formula (C), Za represents —NH— or —CH($R_3$)—. Zb and Zc independently represent —C($R_4$)= or —N=. Each of $R_1$, $R_2$ and $R_3$ independently represents an electron-withdrawing group having a Hammett's substituent constant σp of not less than 0.2 and not more than 1.0. $R_4$ represents a hydrogen atom or substituent, provided that when there are two or more $R_4$s, they may be the same or different. X represents a hydrogen atom or substituent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be explained in more detail below.

First, the "compound capable of releasing a development inhibitor or a precursor thereof by a coupling reaction with an oxidized developing agent" is described.

The compound capable of releasing a development inhibitor or a precursor thereof by a coupling reaction with an oxidized developing agent (hereinafter also referred to as "compound of releasing a development inhibitor or a precursor thereof" or "development inhibitor-releasing compound") preferably includes a compound represented by A-B and compounds represented by general formula (I) or general formula (II) to be described later.

A represents a coupler residue. Preferable examples are those described below. Examples of the coupler residue are yellow coupler residues (e.g., open-chain ketomethylene coupler residues such as acylacetanilide, malondianilide and 1,2,4-benzothiadiadine-1,1-dioxide-3-ylacetanilide), magenta coupler residues (e.g., 5-pyrazolone type, pyrazolotriazole type, imidapyrazole type coupler residues), cyan coupler residues (e.g., a phenol type coupler residue, a naphthol type coupler residue, and imidazole type coupler residue described in European Patent Publication No. (hereinafter also referred to as "EP") 249,453, the disclosure of which is herein incorporated by reference and pyrazolopyrimidine type coupler residue described in EP 304,001, the disclosure of which is herein incorporated by reference), and non-dye-forming coupler residues (e.g., imidanone type and acetophenone type coupler residues). It is also possible to use heterocyclic coupler residues described in U.S. Pat. No. (hereinafter also refereed to as U.S.P.) 4,315,070, U.S. Pat. Nos. 4,183,752, 4,174,969, 3,961,959, and 4,171,223, and JP-A-52-82423, all the disclosures of which are herein incorporated by reference.

The development inhibitor residue or a precursor thereof represented by B is the same as B1 and B2 of formula (I) and (II) to be described later.

Examples of the development inhibitor-releasing coupler are described in JP-A's-62-34158 and 63-37346, U.S. Pat. No. 4,782,012, JP-A-60-191241, and EP 252376, the disclosures of which are incorporated by reference.

A-1

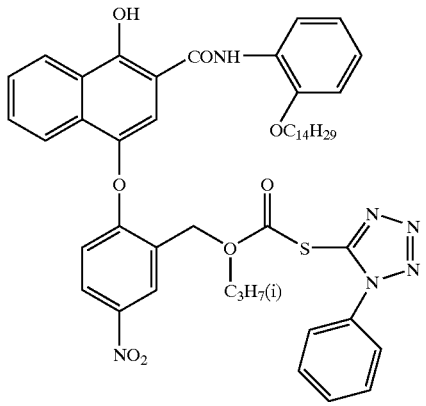

A-2

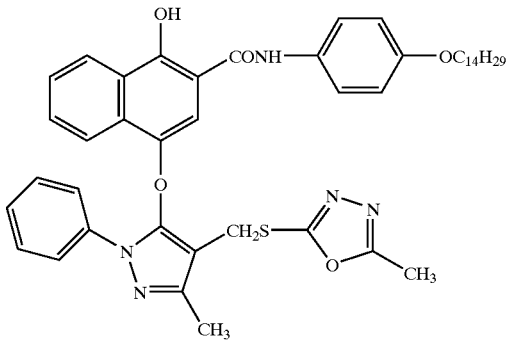

A-3

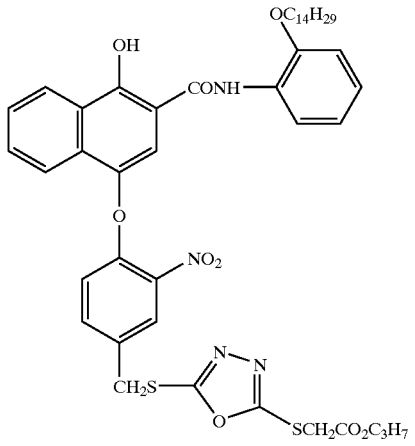

A-4

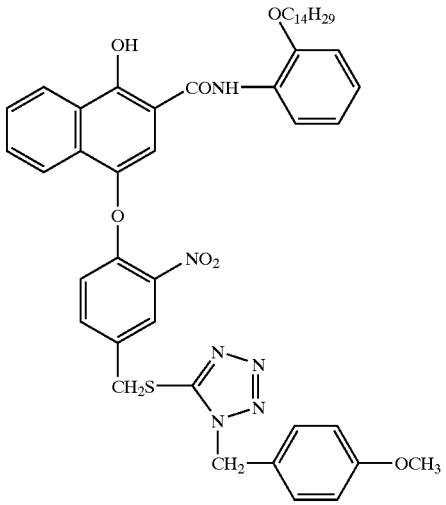

-continued
A-5
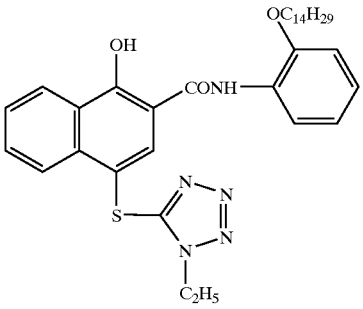
A-6
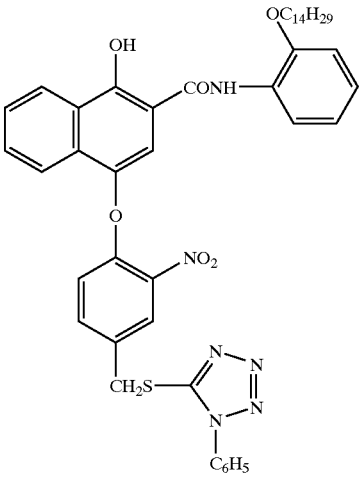
A-7
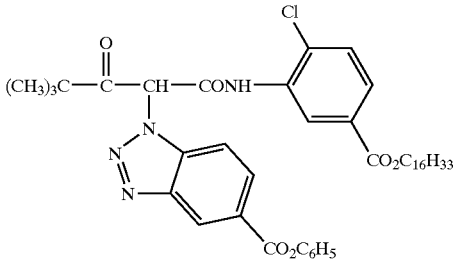
A-8
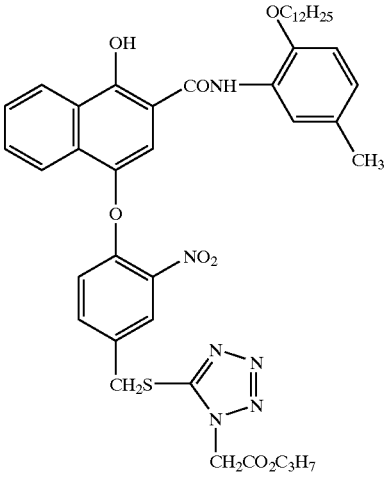
A-9
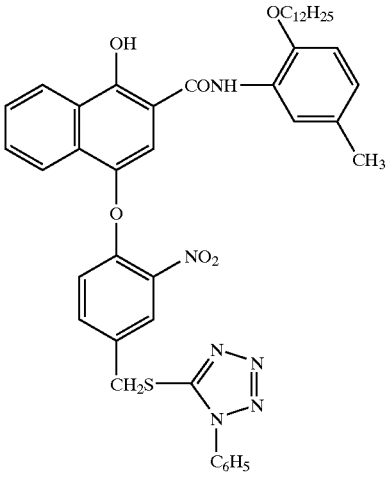
A-10
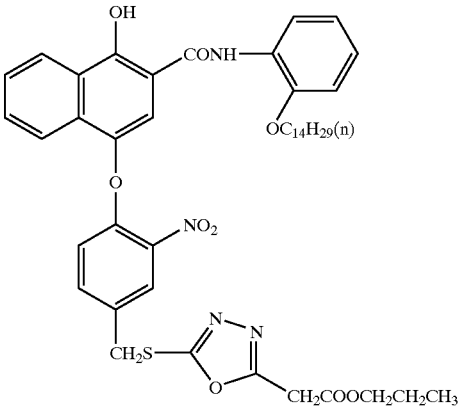

-continued
A-11
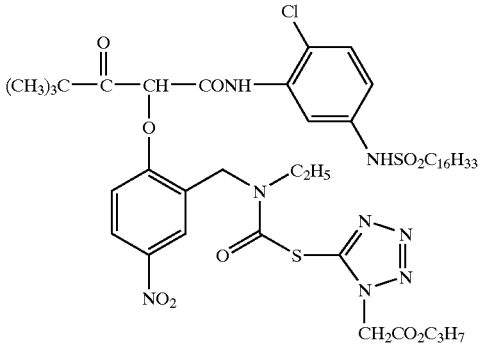
A-12
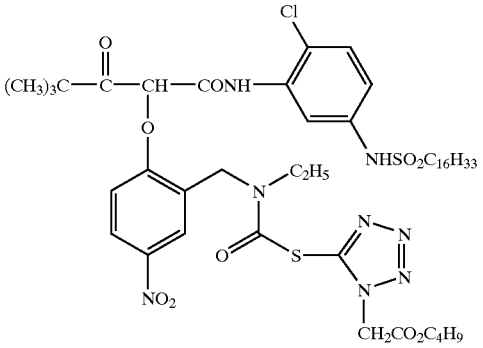
A-13
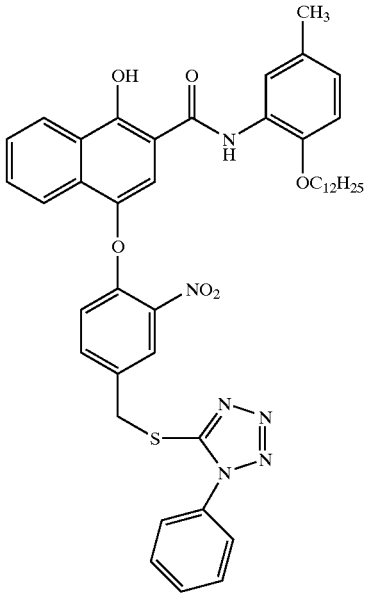
A-14
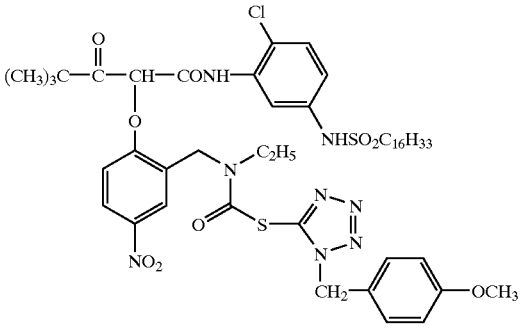
A-15
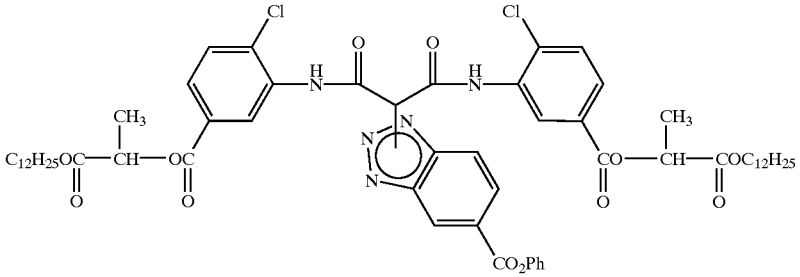

-continued
A-16
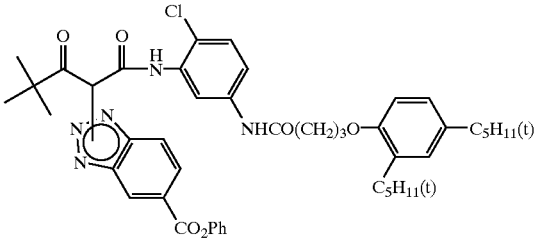
A-17
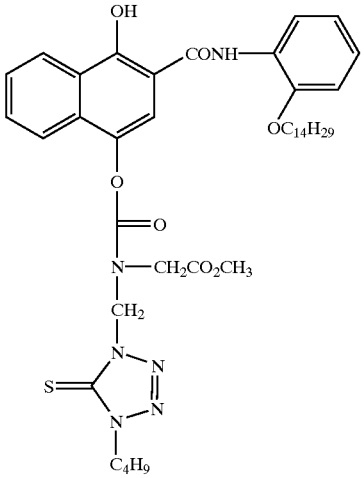
A-18
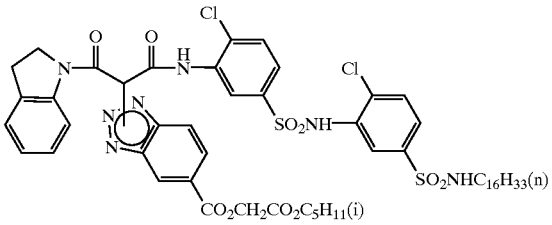
A-19
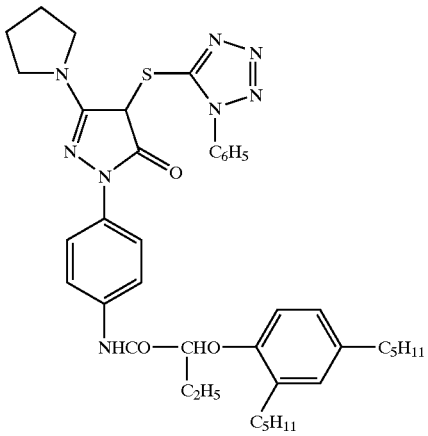
A-20
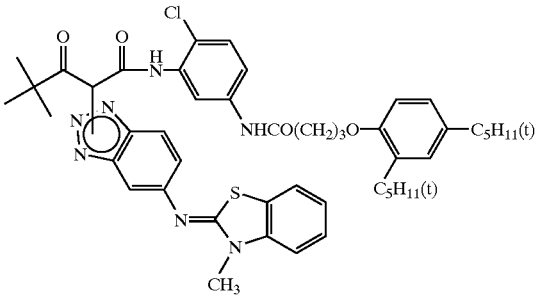
A-21
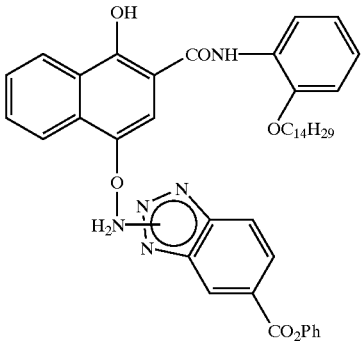

-continued

A-22

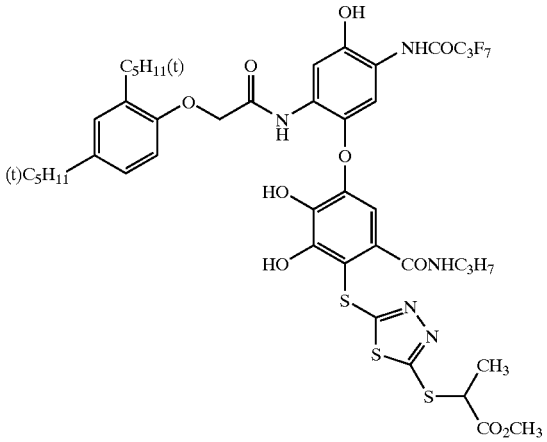

A-23

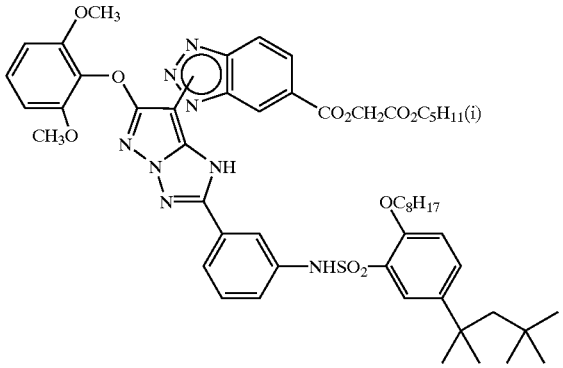

A-24

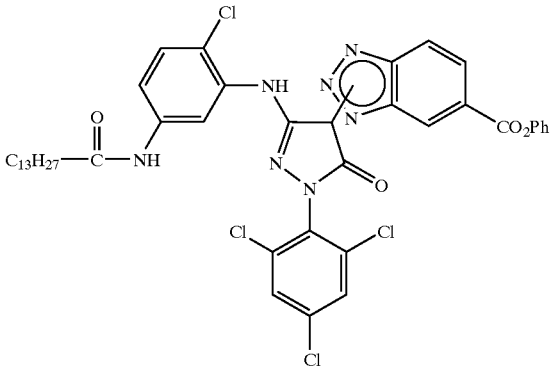

A-25

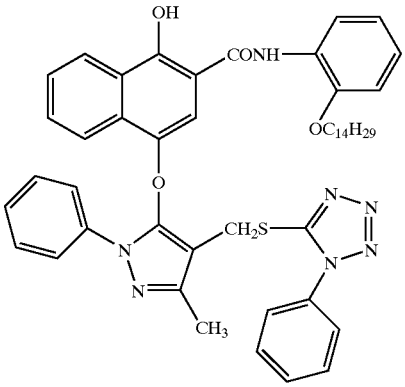

A-26

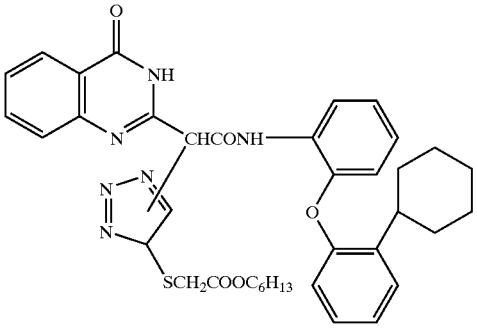

Nest, the development inhibitor-releasing compound represented by formula (I) will be described.

COUP1-B1 (I)

(wherein COUP1 represents a coupler residue capable of releasing B1 by a reaction with an oxidized developing agent, together with generating a water-soluble or alkali-soluble compound. B1 represents a development inhibitor residue or a precursor thereof that bonds to the coupling position of COUP1.

More specifically, a development inhibitor-releasing compound represented by formula (I) is represented by formula (Ia) or (Ib) below:

COUP1-$(TIME)_m$-PUG (Ia)

COUP1-$(TIME)_i$-RED-PUG (Ib)

wherein COUP1 represents a coupler residue capable of splitting off $(TIME)_m$-PUG or $(TIME)_i$-RED-PUG by a coupling reaction with the oxidized developing agent and forming a water-soluble or alkali-soluble compound, TIME represents a timing group capable of cleaving PUG or RED-PUG after splitting off from COUP1 by the coupling reaction, RED represents a group capable of reacting with an oxidized developing agent after splitting off from COUP1 or TIME and cleaving PUG, PUG represents a development inhibitor, m represents an integer of 0 to 2, and i represents 0 or 1. If m is 2, two TIMEs represent the same group or different groups.

If COUP1 represents a yellow coupler residue, examples of this coupler residue are a pivaloylacetanilide type coupler residue, benzoylacetanilide type coupler residue, and 1,2,4-benzothiadiadine-1,1-dioxido-3-ylacetanilide, malondiester type coupler residue, malondiamide type coupler residue, dibenzoylmethane type coupler residue, benzothiazolylacetamide type coupler residue, malonestermonoamide type coupler residue, benzooxazolylacetamide type coupler residue, benzoimidazolylacetamide type coupler residue, quinazoline-4-one-2-ylacetanilide type coupler residue, and cycloalkanoylacetamide type coupler residue.

If COUP1 represents a magenta coupler residue, examples of this coupler residue are a 5-pyrazolone type coupler residue, pyrazolo[1,5-a]benzimidazole type coupler residue, pyrazolo[1,5-b][1,2,4]triazole type coupler residue, pyrazolo[5,1-c][1,2,4]triazole type coupler residue, imidazo[1,2-b]pyrazole type coupler residue, pyrrolo[1,2-b][1,2,4]triazole type coupler residue, pyrazolo[1,5-b]pyrazole type coupler residue, and cyanoacetophenone type coupler residue.

If COUP1 represents a cyan coupler residue, examples of this coupler residue are a phenol type coupler residue, naphthol type coupler residue, pyrrolo[1,2-b][1,2,4]triazole type coupler residue, pyrrolo[2,1-c][1,2,4]triazole type coupler residue, and 2,4-diphenylimidazole type coupler residue.

COUP1 can also be a coupler residue which does not substantially generate any color image. Examples of a coupler residue of this type are indanone type and acetophenone type coupler residues.

Next, development inhibitor residue represented by PUG will be described.

The pKa of the conjugated acids of the development inhibitors (for example, development inhibitors described in U.S. Pat. Nos. 3,227,554, 3,384,657, 3,615,506, 3,617,291, 3,733,201, and 5,200,306, and British Patent 1450479, and U.S. Pat. No. 5,034,311, all the disclosures of which is incorporated herein by reference), is preferably 13 or less, more preferably 11 or less.

Preferable development inhibitor is mercaptotetrazole derivatives, mercaptotriazole derivatives, mercaptothiadiazole derivatives, mercaptooxadiazole derivatives, mercaptoimidazole derivatives, mercaptobenzimidazole derivatives, mercaptobenzothiazole derivatives, mercaptobenzoxazole derivatives, tetrazole derivatives, 1,2,3-triazole derivatives, 1,2,4-triazole derivatives or benzotriazole derivatives.

Preferable development inhibitors are represented by Formulas DI-1 to DI-6 below:

DI-1

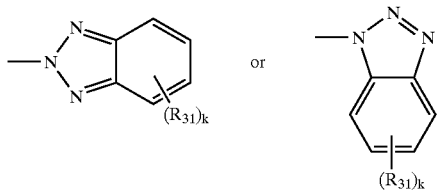

DI-2

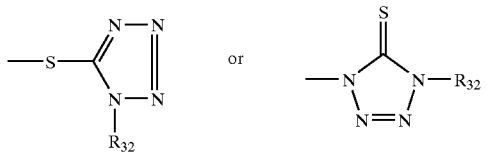

DI-3

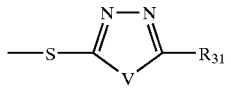

-continued

DI-4

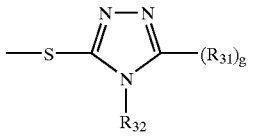

DI-5

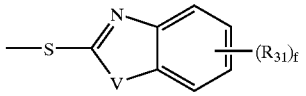

DI-6

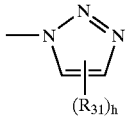

wherein $R_{31}$ represents a halogen atom, $R_{46}O$— group, $R_{46}S$— group, $R_{47}CON(R_{48})$— group, $R_{47}N(R_{48})CO$— group, $R_{46}OCON(R_{47})$— group, $R_{46}O_2(R_{47})$— group, $R_{47}N(R_{48})SO_2$ group, $R_{46}SO_2$— group, $R_{47}OCO$— group, $R_{47}N(R_{48})CON(R_{49})$— group, $R_{47}CON(R_{48})SO_2$— group, $R_{47}N(R_{48})CON(R_{49})SO_2$— group, group having the same meaning as $R_{46}$, $R_{47}N(R_{48})$— group, $R_{46}CO_2$— group, $R_{47}OSO_2$— group, cyano group, or nitro group.

$R_{46}$ represents an alkyl group (including cycloalkyl and bicycloalkyl), alkenyl group (including cycloalkenyl and bicycloalkyenyl), alkynyl group, aryl group, or heterocyclic group. Each of $R_{47}$, $R_{48}$, and $R_{49}$ represents an alkyl group, aryl group, heterocyclic group, or hydrogen atom.

The alkyl group represented by $R_{46}$, $R_{47}$, $R_{48}$ or $R_{49}$ is a linear, branched or cyclic, substituted or unsubstituted alkyl group having 1 to 32 carbon atoms, preferably 1 to 20 carbon atoms. Typical examples thereof include methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, 2-chloroethyl and 2-cyanoethyl. The alkenyl group represents a linear, branched or cyclic, substituted or unsubstituted alkenyl group having 1 to 32 carbon atoms, preferably 1 to 20 carbon atoms. Typical examples thereof include vinyl, allyl, prenyl, geranyl, oleyl and 2-cyclohexen-1-yl. The alkynyl group represents a substituted or unsubstituted alkynyl group having 1 to 32 carbon atoms, preferably 1 to 20 carbon atoms. Typical examples thereof include ethynyl and propargyl.

The terminology "carbon atoms" used herein means the total number of carbon atoms which, when the alkyl, alkenyl or alkynyl group has a substituent, includes the number of carbon atoms of the substituent. With respect to groups other than these groups as well, the total number of carbon atoms including that of any substituent thereof is meant.

The substituents suitable to the above- or below-mentioned groups and the below-mentioned substituents include, for example, a halogen atom (for example, fluorine, chlorine, bromine and iodine atoms), hydroxyl group, carboxyl group, sulfo group, cyano group, nitro group, alkyl group (for example, methyl, ethyl and hexyl), fluoroalkyl group (for example, trifluoromethyl), aryl group (for example, phenyl, tolyl and naphthyl), heterocyclic group (for example, a heterocyclic group mentioned with respect to $R_{46}$), alkoxy group (for example, methoxy, ethoxy and octyloxy), aryloxy group (for example, phenoxy and naphthyloxy), alkylthio group (for example, methylthio and butylthio), arylthio group (for example, phenylthio), amino group (for example, amino, N-methylamino, N,N-dimethylamino and N-phenylamino), acyl group (for example, acetyl, propionyl and benzoyl), alkyl- or arylsulfonyl group (for example, methylsulfonyl and phenylsulfonyl), acylamino group (for example, acetylamino and benzoylamino), alkyl- or aryl-sulfonylamino group (for example, methanesulfonylamino and benzenesulfonylamino), carbamoyl group (for example, carbamoyl, N-methylamincarbonyl, N,N-dimethylaminocarbonyl and N-phenylaminocarbonyl), sulfamoyl group (for example, sulfamoyl, N-methylaminosulfonyl, N,N-dimethylaminosulfonyl and N-phenylaminosulfonyl), alkoxycarbonyl group (for example, methoxycarbonyl, ethoxycarbonyl and octyloxycarbonyl), aryloxycarbonyl group (for example, phenoxycarbonyl and naphthyloxycarbonyl), acyloxy group (for example, acetyloxy and benzoyloxy), alkoxycarbonyloxy group (for example, methoxycarbonyloxy and ethoxycarbonyloxy), aryloxycarbonyloxy group (for example, phenoxycarbonyloxy), alkoxycarbonylamino group (for example, methoxycarbonylamino and butoxycarbonylamino), aryloxycarbonylamino group (for example, phenoxycarbonylamino), aminocarbonyloxy group (for example, N-methylaminocarbonyloxy and N-phenylaminocarbonyloxy) and aminocarbonylamino group (for example, N-methylaminocarbonylamino and N-phenylaminocarbonylamino).

The aryl group represented by $R_{46}$, $R_{47}$, $R_{48}$, or $R_{49}$ is a 6- to 32-carbon aryl group, preferably substituted or nonsubstituted phenyl or substituted or nonsubstituted naphthyl.

The heterocyclic group represented by $R_{46}$, $R_{47}$, $R_{48}$, or $R_{49}$ is a 1- to 32-carbon, preferably 1- to 20-carbon substituted or nonsubstituted heterocyclic group which contains a hetero atom selected from a nitrogen atom, oxygen atom, and sulfur atom and which is preferably a 3- to 8-membered ring. Representative examples of this heterocyclic group are 2-pyridyl, 2-benzoxazolyl, 2-imidazolyl, 2-benzimidazolyl, 1-indolyl, 1,3,4-thiadiazole-2-yl, 1,2,4-triazole-2-yl, or 1-indolinyl.

$R_{32}$ represents a group having the same meaning as $R_{46}$. k represents an integer from 1 to 4, g represents 0 or 1, and h represents 1 or 2. V represents an oxygen atom, sulfur atom, or —N($R_{46}$)—. $R_{31}$ and $R_{32}$ can further have a substituent.

A group represented by TIME will be described next.

A group represented by TIME can be any connecting group which can cleave PUG after being cleaved from COUP1 during development. Examples are a group described in U.S. Pat. Nos. 4,146,396, 4,652,516, and 4,698,297, which uses a cleavage reaction of hemiacetal; a timing group described in U.S. Pat. Nos. 4,248,962, 4,847,185, and 4,857,440, which causes a cleavage reaction by using an intramolecular nucleophilic substitution reaction; a timing group described in U.S. Pat. Nos. 4,409,323 and 4,421,845, which causes a cleavage reaction by using an electron transfer reaction; a group described in U.S. Pat. No. 4,546,073, which causes a cleavage reaction by using a hydrolytic reaction of iminoketal; and a group described in West German Patent 2626317, which causes a cleavage reaction by using a hydrolytic reaction of ester, all the disclosures of which are herein incorporated by reference. At a heteroatom, preferably an oxygen atom, sulfur atom, or nitrogen atom contained in it, TIME bonds to COUP1 in formula (Ia) or (Ib). Preferable examples of TIME are formulas (T-1), (T-2), and (T-3) below.

$$*—W—(X{=}Y)_j—C(R_{21})R_{22}—** \quad \text{(T-1)}$$

$$*—W—CO—** \quad \text{(T-2)}$$

$$*—W\text{-LINK-}E1\text{-}** \quad \text{(T-3)}$$

wherein * represents a position where TIME bonds to COUP1 in formula (Ia) or (Ib), ** represents a position where TIME bonds to PUG or another TIME (if m is the plural number), W represents an oxygen atom, a sulfur atom, or >N—$R_{23}$, each of X and Y represents methine or a nitrogen atom, j represents 0, 1, or 2, and each of $R_{21}$, $R_{22}$, and $R_{23}$ represents a hydrogen atom or a substituent. If X and Y represent substituted methine, this substituent and any two substituents of each of $R_{21}$, $R_{22}$, and $R_{23}$ may or may not connect to form a cyclic structure (e.g., a benzene ring or a pyrazole ring). In formula (T-3), E1 represents an electrophilic group. LINK represents a connecting group which three-dimensionally relates W to E1 so as to allow an intramolecular nucleophilic substitution reaction.

Practical examples of TIME represented by formula (T-1) are as follows.

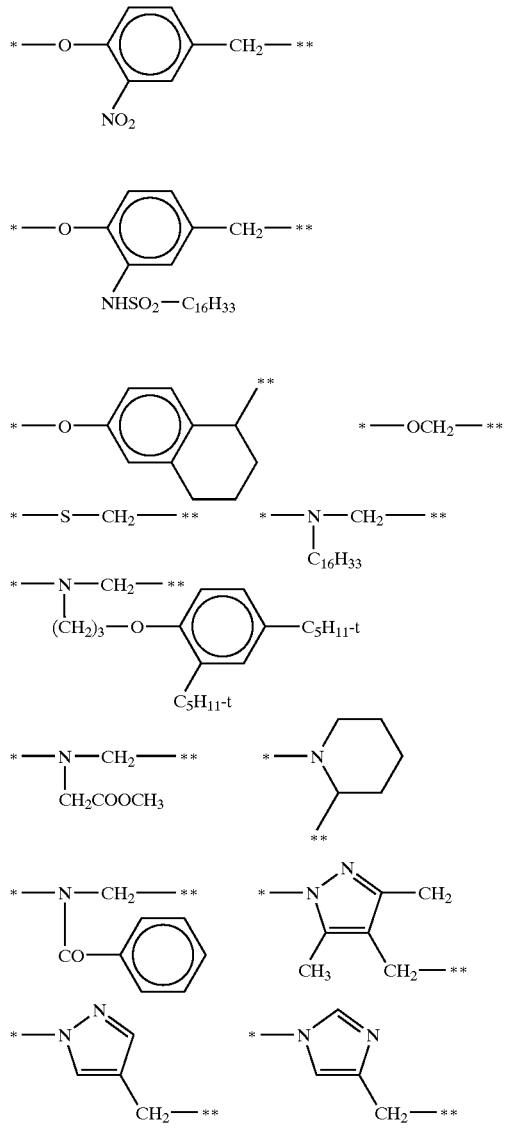

-continued
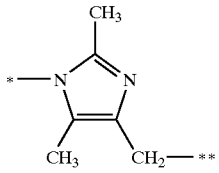
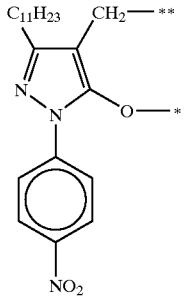
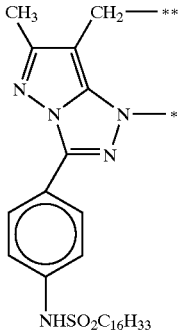
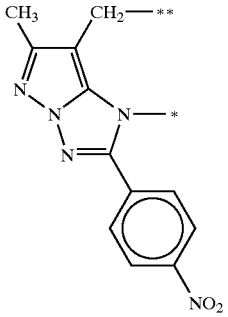
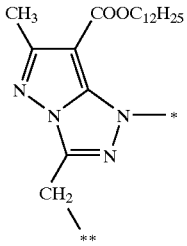
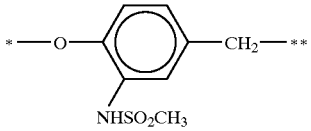
Practical examples of TIME represented by formula (T-2) are as follows.
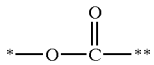
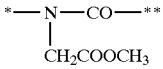
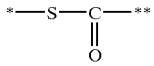
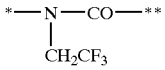
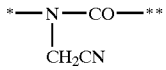
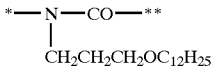
Practical examples of TIME represented by formula (T-3) are as follows.
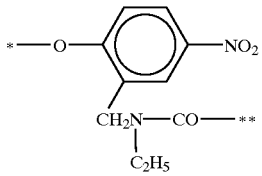
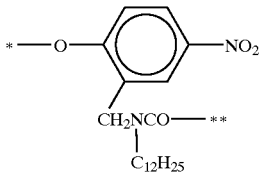
-continued
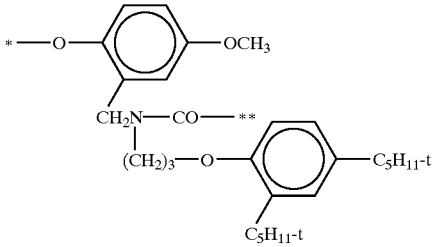
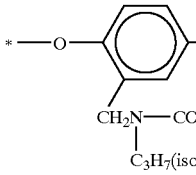
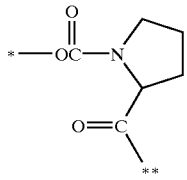
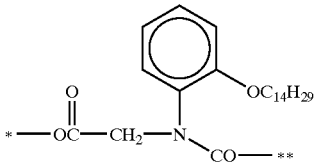
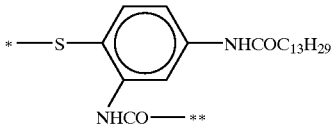
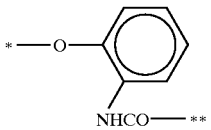
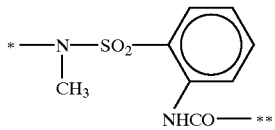
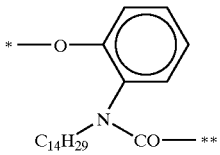
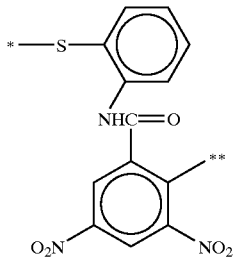
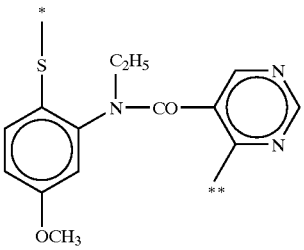
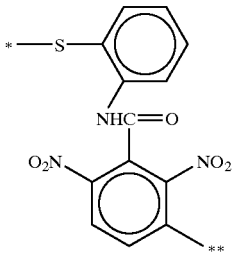
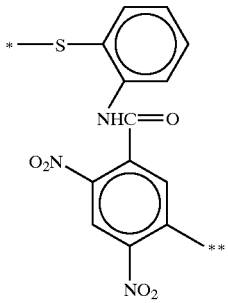

If m is 2 in formula (Ia), practical examples of $(TIME)_m$ are as follows.

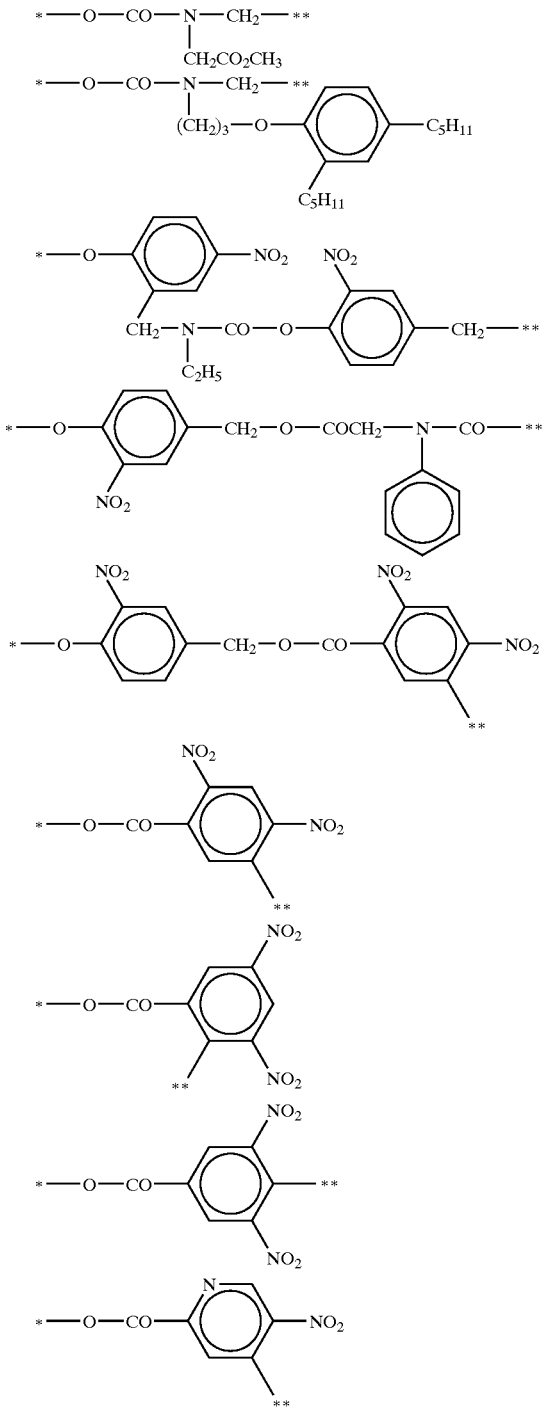

A group represented by RED in formula (Ib) will be described below. RED is a group which cleaves from COUP1 or TIME to form RED-PUG and can be cross-oxidized by an acidic substance, such as an oxidized developing agent, present during development. RED-PUG can be any compound as long as it cleaves PUG when oxidized. Examples of RED are hydroquinones, catechols, pyrogallols, 1,4-naphthohydroquinones, 1,2-naphthohydroquinones, sulfonamidophenols, hydrazides, and sulfonamidonaphthols.

Practical examples of these groups are described in JP-A's-61-230135, 62-251746 and 61-278852, U.S. Pat. Nos. 3,364,022, 3,379,529, 4,618,571, 3,639,417, and 4,684,604, and J. Org. Chem., Vol. 29, page 588 (1964), all the disclosures of which are herein incorporated by reference.

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group combines with COUP1 or TIME at an oxygen atom of the phenol group.

In order for a compound represented by formula (Ia) or (Ib) to be fixed to a photosensitive layer or a non-light-sensitive layer to which the compound is added before a silver halide photosensitive material containing the compound represented by formula (Ia) or (Ib) is developed, a compound represented by formula (Ia) or (Ib) preferably has a nondiffusing group. Most preferably, this nondiffusing group is contained in TIME or RED. Preferable examples of the nondiffusing group are an 8- to 40-carbon, preferably 12- to 32-carbon alkyl group, and an 8- to 40-carbon, preferably 12- to 32-carbon aryl group having at least one alkyl group (having 3 to 20 carbon atoms), alkoxy group (having 3 to 20 carbon atoms), or aryl group (having 6 to 20 carbon atoms).

Methods of synthesizing compounds represented by formulas (Ia) and (Ib) are described in, e.g., the known patents and references cited to explain TIME, RED, and PUG, JP-A's-61-156127, 58-160954, 58-162949, 61-249052, and 63-37350, U.S. Pat. No. 5,026,628, and European Patent Publication Nos. 443530A2 and 444501A2.

A development inhibitor-releasing compound represented by formula (II) will be described below.

COUP2-A-E-B2 (II)

wherein COUP2 represents a coupler residue capable of coupling with the oxidized developing agent, E represents an electrophilic portion, A represents a connecting group capable of releasing B2 with ring formation by an intramolecular nucleophilic substitution reaction of a nitrogen atom, which arises from the developing agent in the product of coupling between COUP2 and the oxidized developing agent and which directly bonds to the coupling position, with the nucleophilic portion E, and B2 represents a development inhibitor residue or its precursor.

As a coupler residue represented by COUP2, coupler residues generally known as photographic couplers can be used. Examples are yellow coupler residues (e.g., open-chain ketomethine type coupler residues such as acylactanilide and malondianilide), magenta coupler residues (e.g., 5-pyrazolon type and pyrazolotriazole type coupler residues), and cyan coupler residues (e.g., phenol type, naphthol type, and pyrrolotriazole type coupler residues). It is also possible to use yellow, magenta, and cyan dye forming couplers having novel skeletons described in, e.g., U.S. Pat. No. 5,681,689, JP-A's-7-128824, 7-128823, 6-222526, 9-258400, 9-258401, 9-269573, and 6-27612, the disclosures of which are herein incorporated by reference. Other coupler residues can also be used (e.g., coupler residues described in U.S. Pat. Nos. 3,632,345 and 3,928,041, which form a colorless substance by reacting with the oxidized aromatic amine-based developing agent and coupler residues described in U.S. Pat. Nos. 1,939,231 and 2,181,944, the disclosures of which are herein incorporated by reference, which form a black or intermediate-color substance by reacting with the oxidized aromatic amine-based developing agent).

The bonding position of COUP2 and the connecting group A can be any position provided that after a coupler and the oxidized developing agent couple with each other, B2 can be released with ring formation by an intramolecular nucleophilic substitution reaction of a nitrogen atom, which arises from the developing agent in the coupling product and directly bonds to the coupling position, with the electrophilic portion E. The position is preferably the coupling position of COUP2 or its nearby position (an atom adjacent to the coupling position or an atom adjacent to this atom adjacent to the coupling position), and more preferably, the nearby position (an atom adjacent to the coupling position or an atom adjacent to this atom adjacent to the coupling position) of the coupling position of COUP2.

When the connecting group A bonds to 1) the coupling position of a coupler residue represented by COUP2, 2) an atom adjacent to the coupling position, and 3) an atom adjacent to the atom adjacent to the coupling position, a reaction between a coupler of the present invention and the oxidized form (Ar'═NH) of an aromatic amine-based developing agent represented by $ArNH_2$ can be represented by the following formulas.

1) In the case where A bonds to the coupling position of COUP2

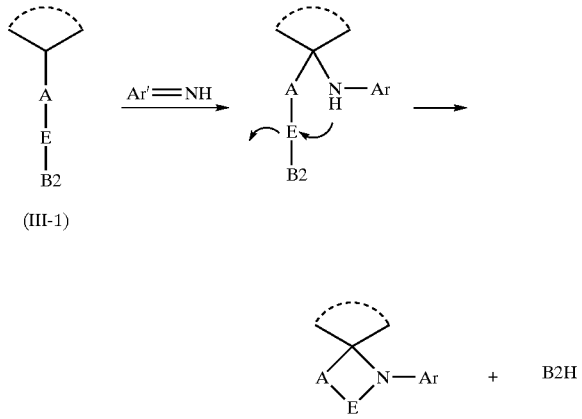

(III-1)

2) In the case where A bonds to the next atom to the coupling position of COUP2

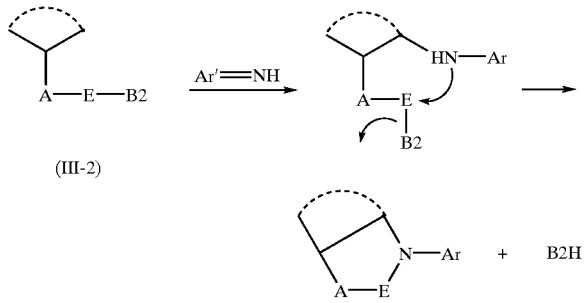

(III-2)

3) In the case where A bonds to the further next atom to the next atom to the coupling position of COUP2

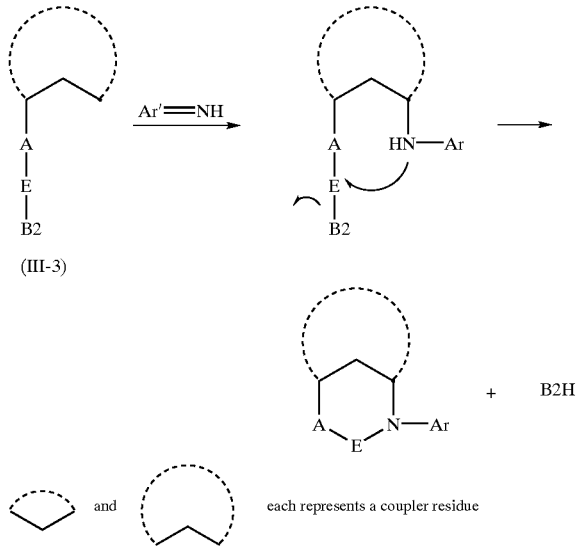

(III-3)

capable of coupling with an oxidized developing agent, which however doe s not necessarily represent a cyclic structure.

'represents the coupling position. The linear portion represents a boding between a nonmetallic atom and another nonmetallic atom.

A represents a connecting group capable of releasing B2, with the formation of a ring (preferably a 3- to 7-membered ring, and more preferably, a 5- or 6-membered ring), by an intramolecular nucleophilic substitution reaction of a nitrogen atom, which arises from a developing agent in the product of coupling between COUP2 and the oxidized developing agent and which directly bonds to the coupling position, with the electrophilic portion E. A preferable form of A can be represented by formula (IV) below.

(IV)

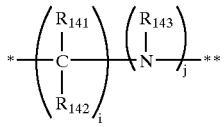

wherein * represents a portion connecting with COUP2, and ** represents a portion connecting with E. Each of $R_{141}$, $R_{142}$, $R_{143}$ independently represents a hydrogen atom, alkyl group (including cycloalkyl and bicycloalkyl), alkenyl group (including cycloalkenyl and bicycloalkenyl), alkynyl group, aryl group or heterocyclic group. The alkyl group, alkenyl group, alkynyl group, aryl group and heterocyclic group represented by $R_{141}$, $R_{142}$, $R_{143}$ have the same meaning as $R_{46}$. i represents an integer from 0 to 3, and j represents an integer from 0 to 2. $R_{141}$ or $R_{142}$ can combine with COUP2 or $R_{143}$ to form a ring, or $R_{141}$ and $R_{142}$ can combine with each other to form a spiro ring. If i is 2 or 3, a plurality of $R_{141}$'s or $R_{142}$'s can be the same or different, and adjacent $R_{141}$'s or $R_{142}$'s can combine with each other to form a ring. Each of $R_{141}$ and $R_{142}$ is preferably a hydrogen atom or a (1- to 20-carbon, preferably 1- to 10-carbon) straight chain, branched or cyclic substituted or unsubstituted alkyl group, alkenyl group, or alkynyl group, and more preferably, a hydrogen atom. $R_{143}$ is preferably a 1- to 32-carbon aliphatic group, and more preferably, a 1- to 22-carbon aliphatic group, and can combine with COUP2 to form a ring. If j is 2, two $R_{143}$'s can be the same or different, and adjacent $R_{143}$'s can form a ring. j is preferably 1. B2 represents a development inhibitor or its precursor. A preferable form of B2 is represented by formula (V) below.

$$\#\text{-}(TIME)_k\text{-}PUG \quad (V)$$

wherein # represents a portion connecting with E, TIME represents a timing group capable of releasing PUG after being released from E, k represents an integer from 0 to 2, preferably 0 or 1, and PUG represents a development inhibitor residue.

The timing group represented by TIME has the same meaning as TIME of the formulas (Ia) and (IB) mentioned above. The development inhibitor residue represented by PUG has the same meaning as mentioned above.

A preferable form of couplers used in the present invention is formula (III-2) (wherein A bonds at an atom adjacent to the coupling position of COUP) or formula (III-3) (wherein A bonds at an atom adjacent to the atom adjacent to the coupling position of COUP), and the most preferable form is formula (III-3). Formula (III-3) is preferably represented by formula (III-3a), more preferably, formula (III-3b), and most preferably, formula (III-3c). The structure of a cyclized form obtained by a reaction of formula (III-3c) with the oxidized form (Ar'=NH) of an aromatic amine-based developing agent represented by $ArNH_2$ can be represented by formula (VI) below.

(III-3a)

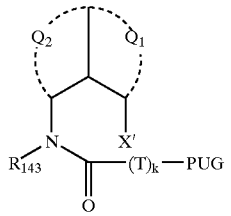

(III-3b)

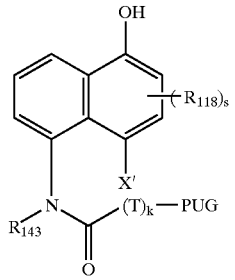

(III-3c)

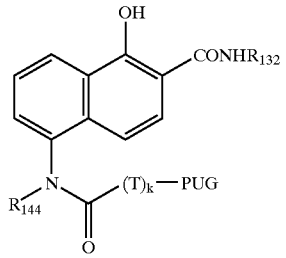

-continued (VI)

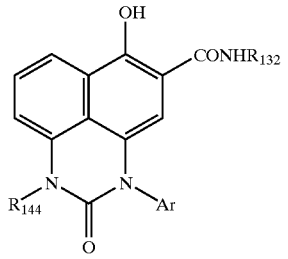

Each of $Q_1$ and $Q_2$ independently represents a nonmetallic atomic group required to form a 5- or 6-membered ring and cause a coupling reaction with an oxidized developing agent with an atom at the root of X'. The X' represents a hydrogen atom, a halogen atom (for example, a fluorine atom, a chlorine atom, a bromine atom and an iodine atom), $R_{131}$—, $R_{131}O$—, $R_{131}S$—, $R_{131}OCOO$—, $R_{132}COO$—, $R_{132}(R_{133})NCOO$— and $R_{132}CON(R_{133})$—. $R_{131}$ represents an alkyl group (including cycloalkyl and bicycloalkyl), an alkenyl group (including cycloalkenyl and bicycloalkenyl), an alkynyl group, an aryl group or a heterocyclic group. Each of $R_{132}$ and $R_{133}$ independently represents a hydrogen atom, an alkyl group (including cycloalkyl and bicycloalkyl), an alkenyl group (including cycloalkenyl and bicycloalkenyl), an alkynyl group, an aryl group or a heterocyclic group. The alkyl, alkenyl, alkynyl, aryl or heterocyclic group represented by $R_{131}$, $R_{132}$ and $R_{133}$ are defined the same as $R_{46}$.

T has the same meaning as TIME. k, PUG, s, $R_{132}$ and $R_{143}$ are defined the same as those described above. $R_{118}$ represents a substituent. r indicates an integer of 0 to 6. s indicates an integer of 0 to 5. Suitable substituents represented by $R_{118}$ include $R_{132}CON(R_{133})$—, $R_{131}OCN(R_{132})$—, $R_{131}SO_2N(R_{132})$—, $R_{132}(R_{133})NCON(R_{134})$—, $R_{131}S$—, $R_{131}O$—, $R_{132}(R_{133})NCO$—, $R_{132}(R_{133})NSO_2$—, $R_{131}OCO$—, a cyano group or halogen atom. $R_{131}$, $R_{132}$ and $R_{133}$ are defined the same as those described above. $R_{134}$ is a group defined the same as $R_{132}$. When r and s are 2 or more, $R_{118}$s may be the same or different. $R_{118}$s adjacent to each other may join to form a ring.

$R_{144}$ represents a substituted or unsubstituted alkyl (including cycloalkyl and bicycloalkyl), alkenyl (including cycloalkenyl and bicycloalkenyl) or alkynyl group, having 1 to 32 carbon atoms.

The following are specific examples of a coupler to be employed in the photosensitive material of the present invention, but the coupler is not limited to these examples.

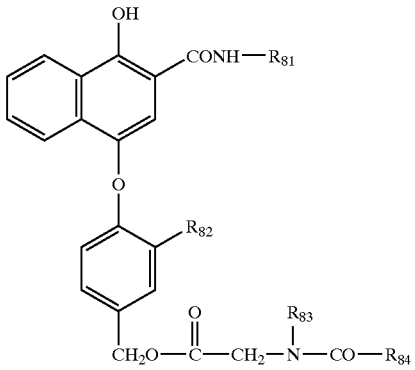
| No. | $R_{81}$ | $R_{82}$ | $R_{83}$ | $R_{84}$ |
|---|---|---|---|---|
| (1) | $—CH_3$ | $—NHSO_2C_{16}H_{33}(n)$ | $—C_6H_5$ | 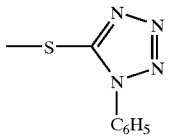 |
| (2) | $—CH_3$ | $—NHSO_2C_{16}H_{33}(n)$ | $—C_6H_5$ | 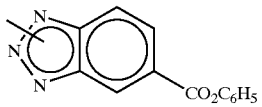 |
| (3) | $—CH_2CH_2OCH_3$ | $—NHSO_2C_{16}H_{33}(n)$ | $—C_6H_5$ | 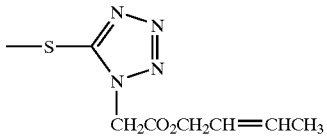 |
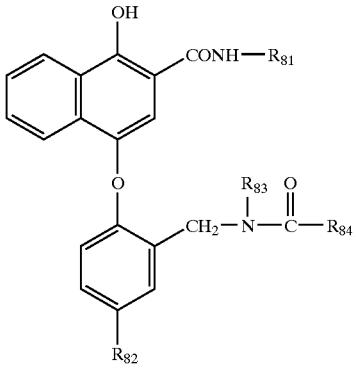
| | | | | |
|---|---|---|---|---|
| (4) | $—(CH_2)_2CO_2C_2H_5$ | $—NO_2$ | $—C_{12}H_{25}(n)$ | 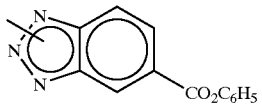 |
| (5) | $CH_3$ | $—NO_2$ | $—C_6H_5$ | 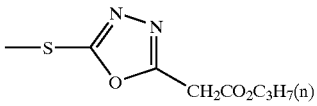 |

-continued
(6)
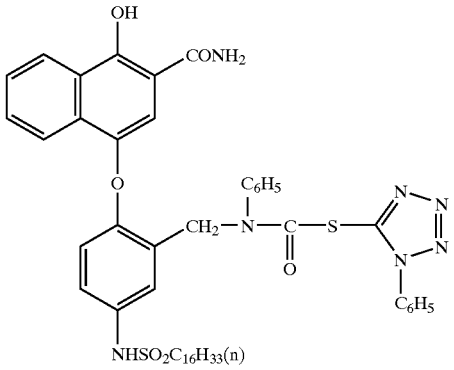
(7)
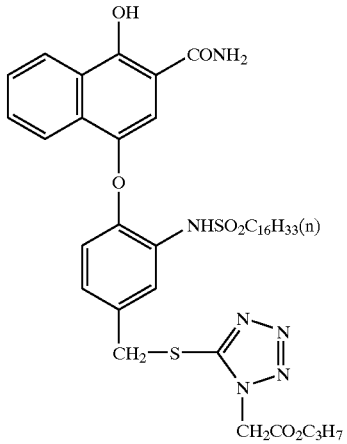
(8)
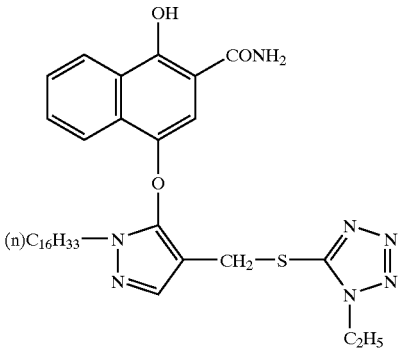
(9)
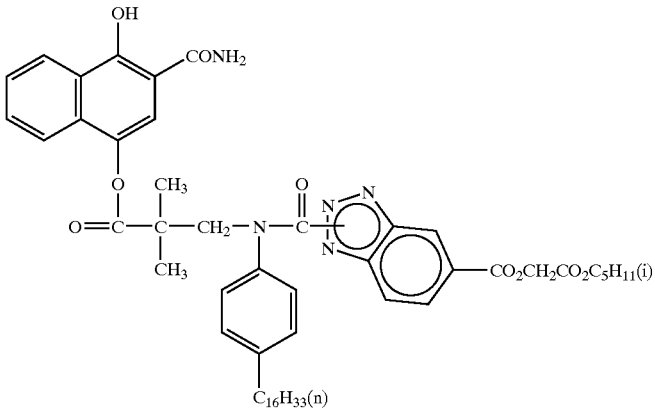

-continued
(10)
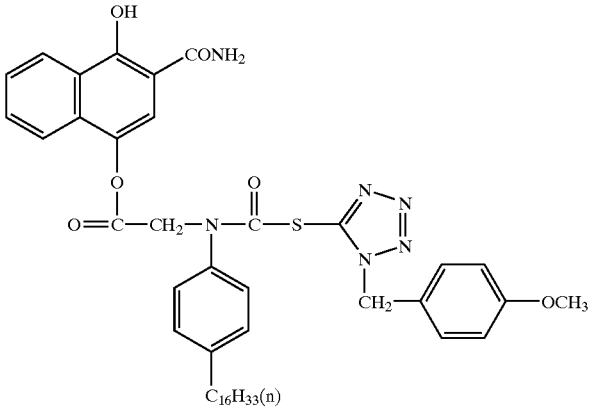
(11)
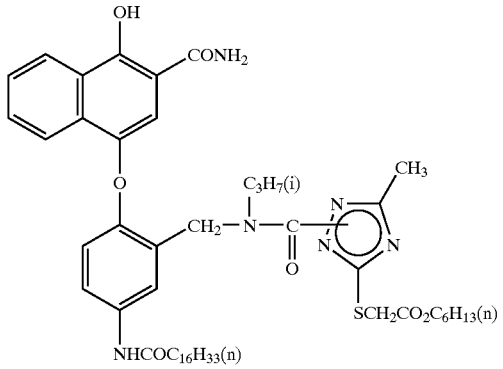
(12)
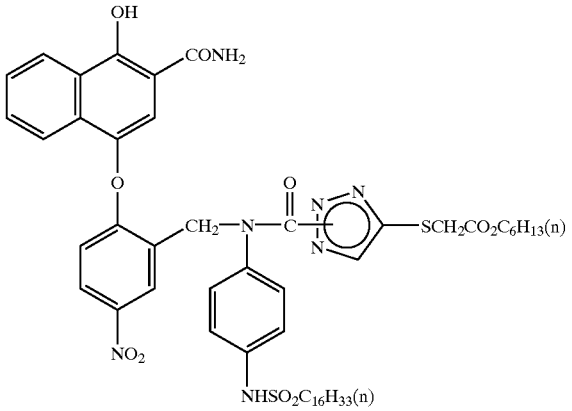
(13)
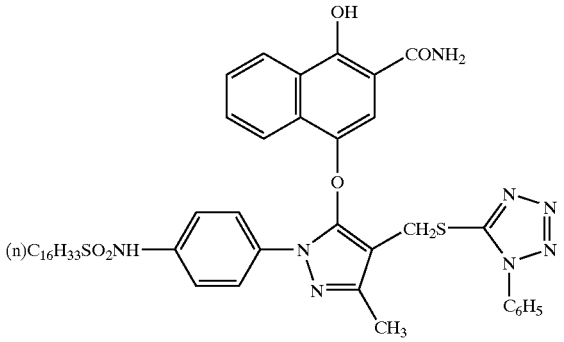

-continued
(14)
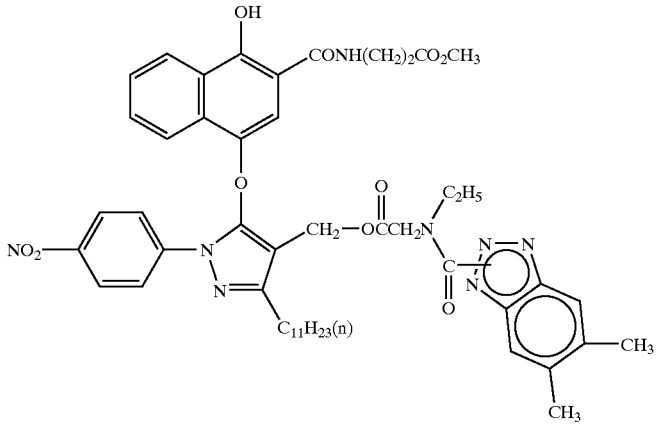
(15)
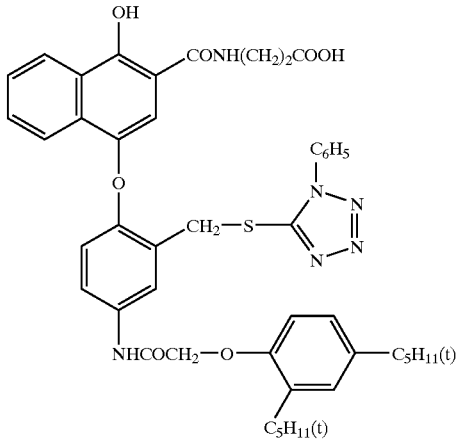
(16)
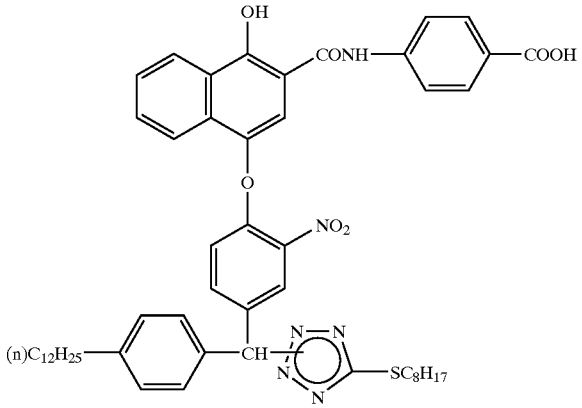

-continued
(17)
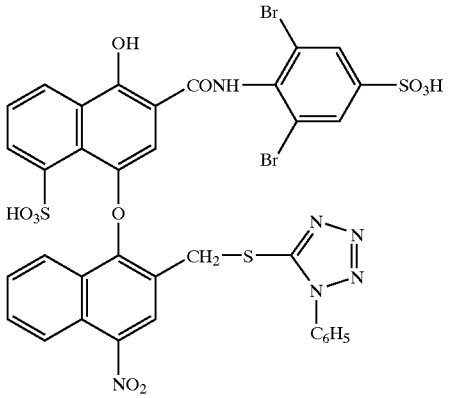
(18)
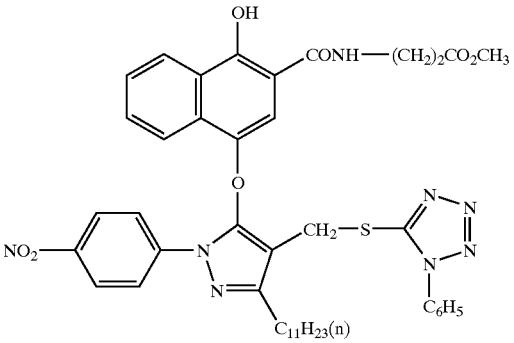
(19)
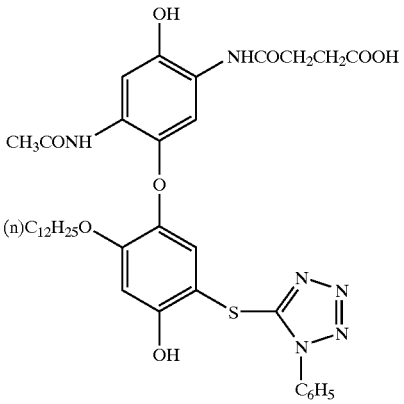
(20)
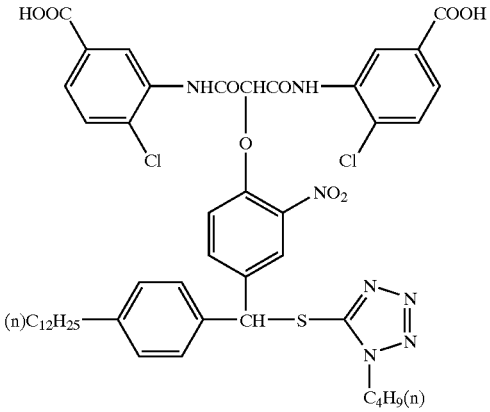

-continued
(21)
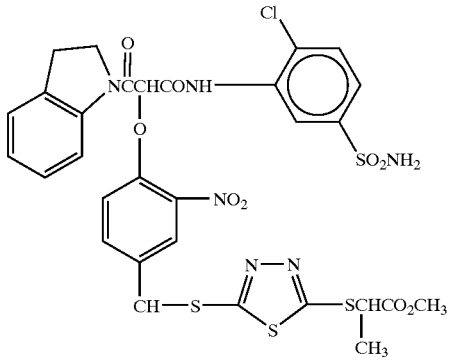
(22)
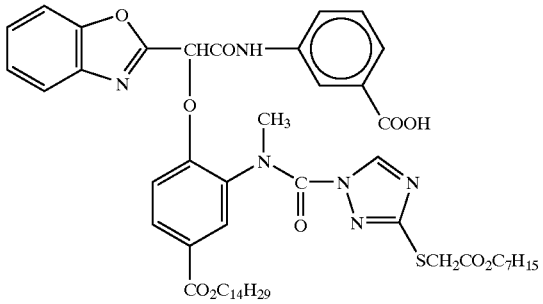
(23)
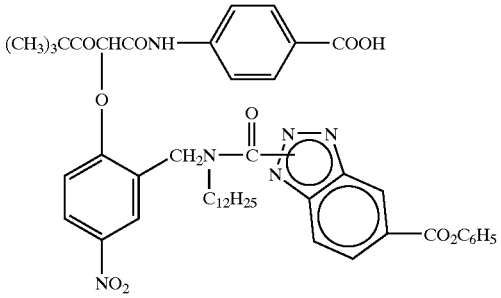
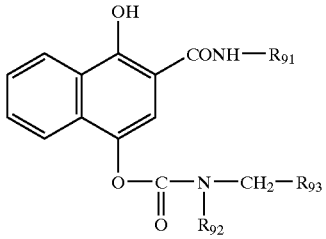
| No. | $R_{91}$ | $R_{92}$ | $R_{93}$ |
|---|---|---|---|
| (24) | H | $—CH_2CO_2C_{10}H_{21}(n)$ | 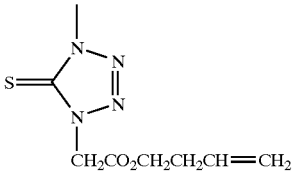 |
| (25) | H | 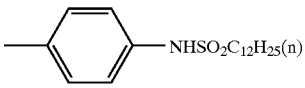 | 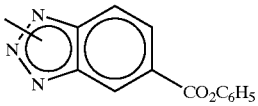 |

-continued
(26) —$CH_3$ —$CH_2CO_2C_{12}H_{25}$(n)
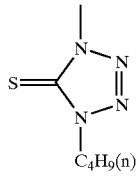
(27) —$(CH_2)_2COOH$
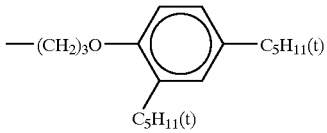
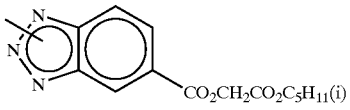
(28) —$SO_2CH_3$ —$CH_2CO_2C_{10}H_{21}$(n)
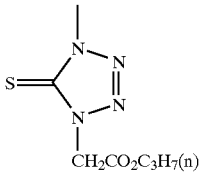
(29) H
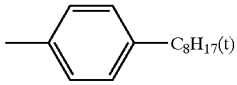
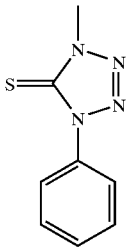
(30)
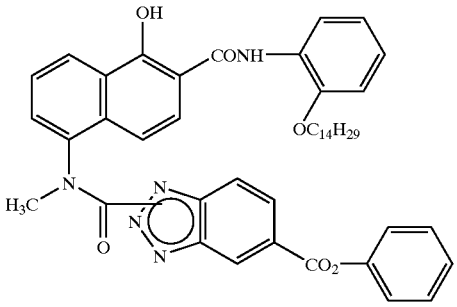
(31)
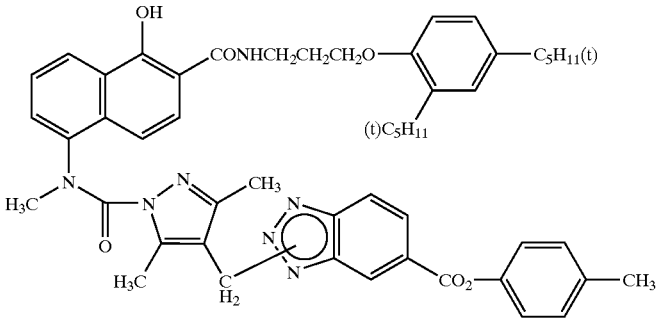

-continued
(32)
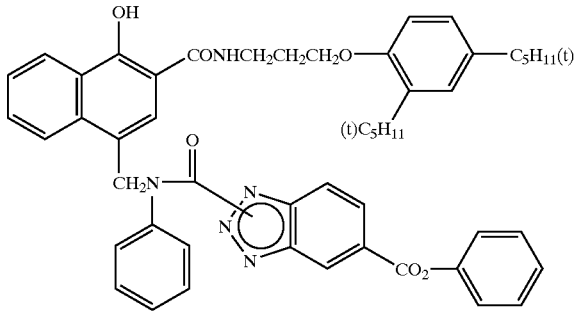
(33)
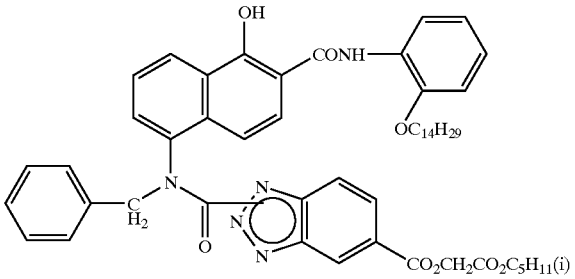
(34)
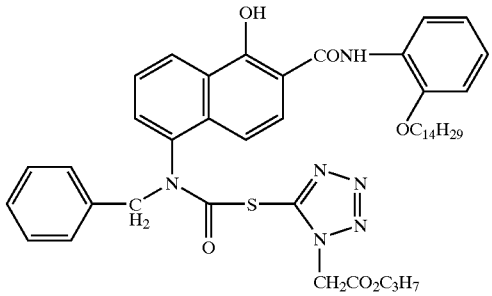
(35)
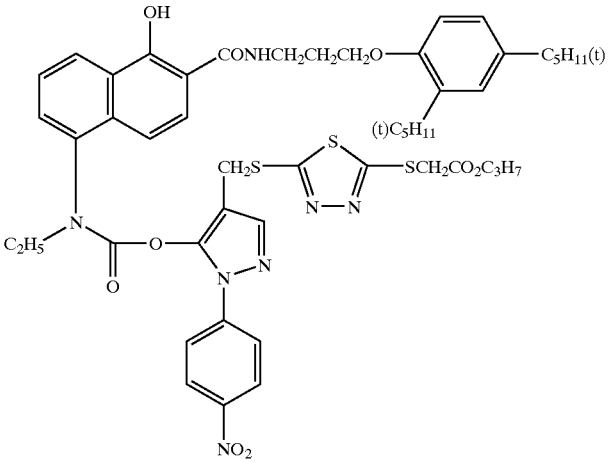

-continued
(36)
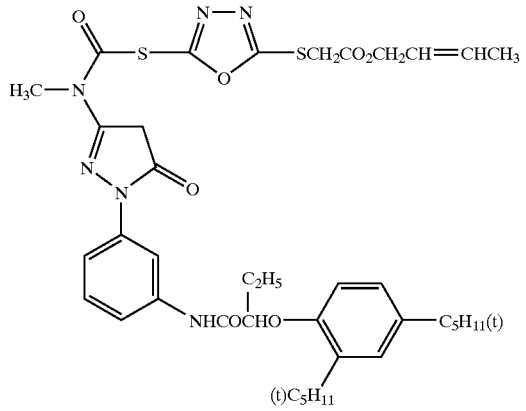
(37)
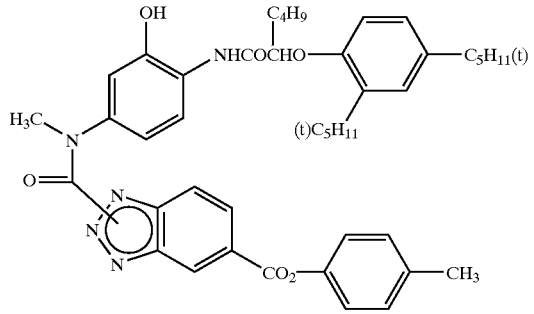
(38)
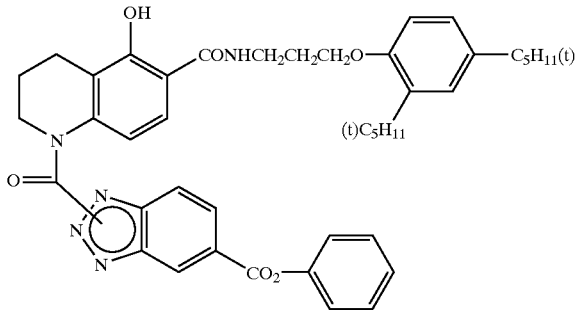
(39)
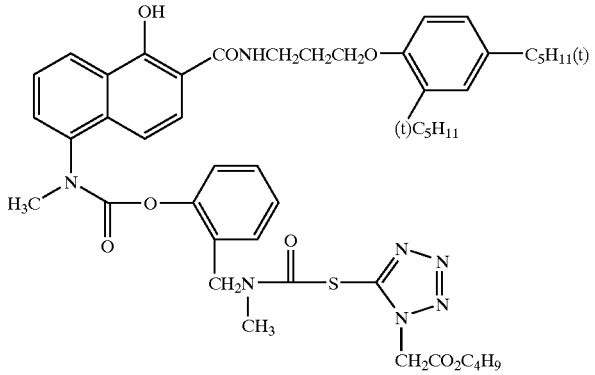

-continued
(40)
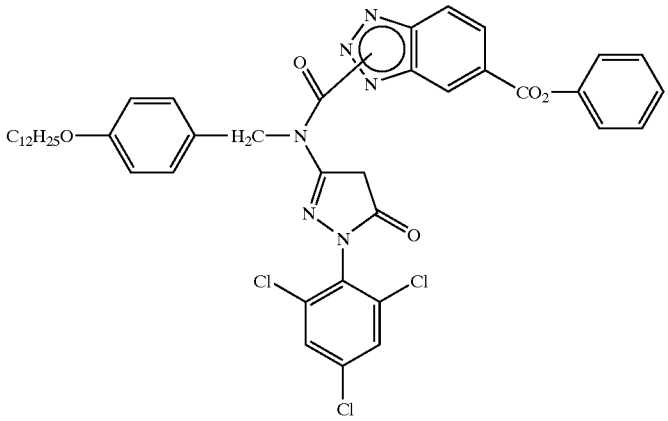
(41)
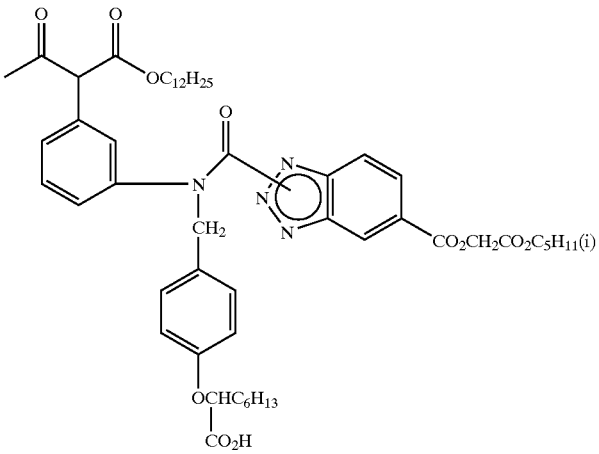
(42)
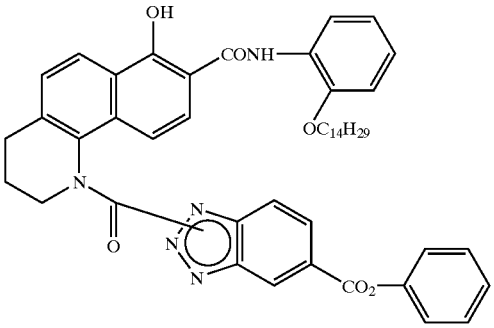
(43)
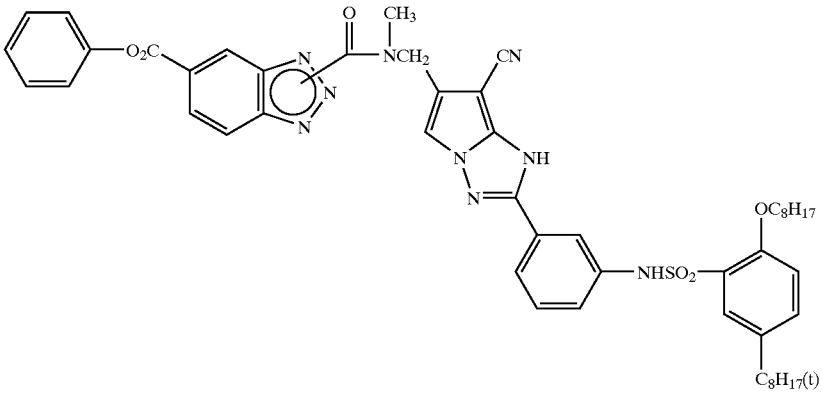

-continued
(44)
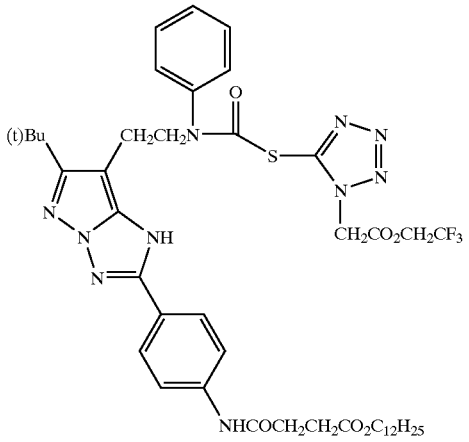
(45)
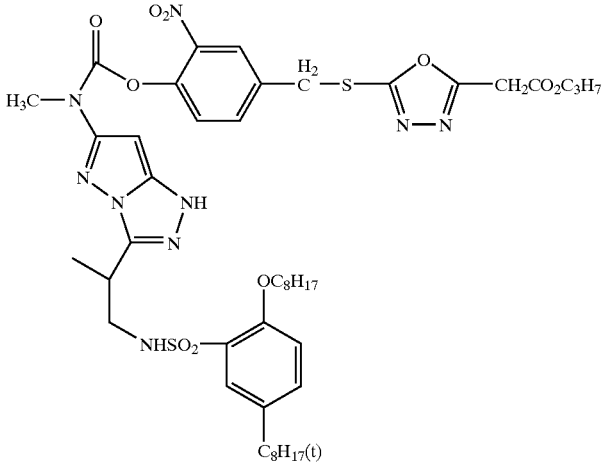
(46)
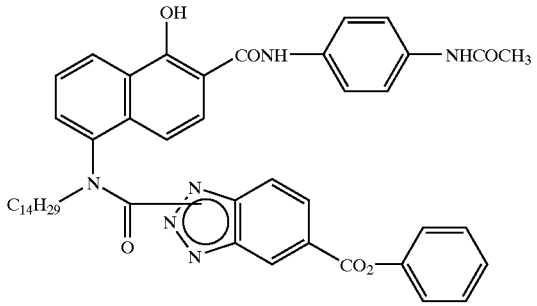
(47)
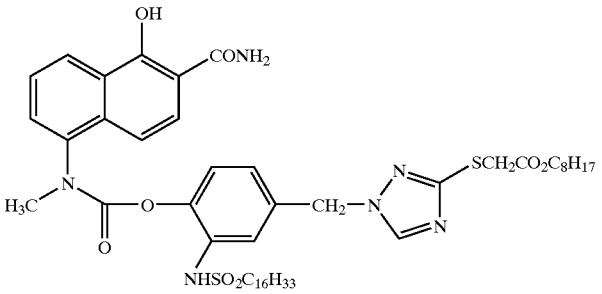

-continued
(48)
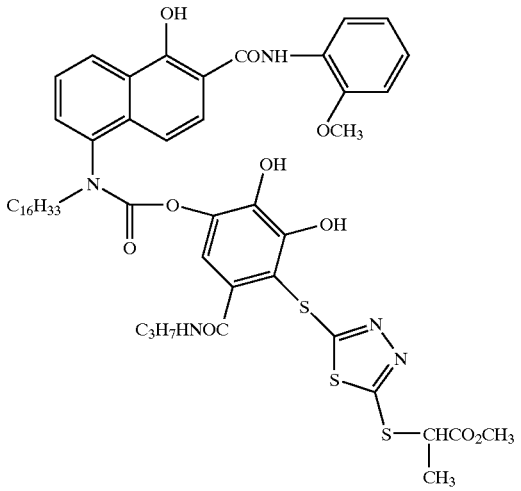
(49)
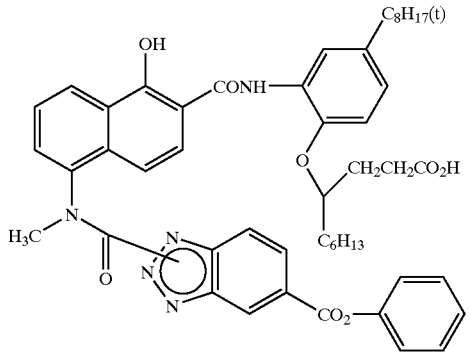
(50)
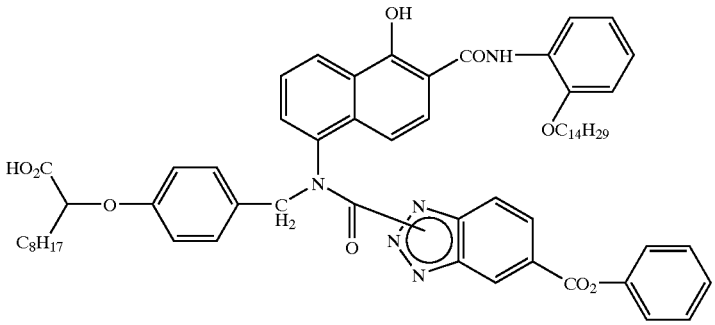
(51)
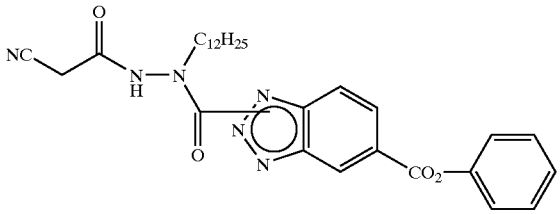

-continued
(52)
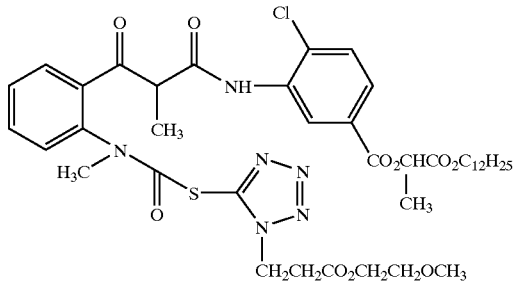
(53)
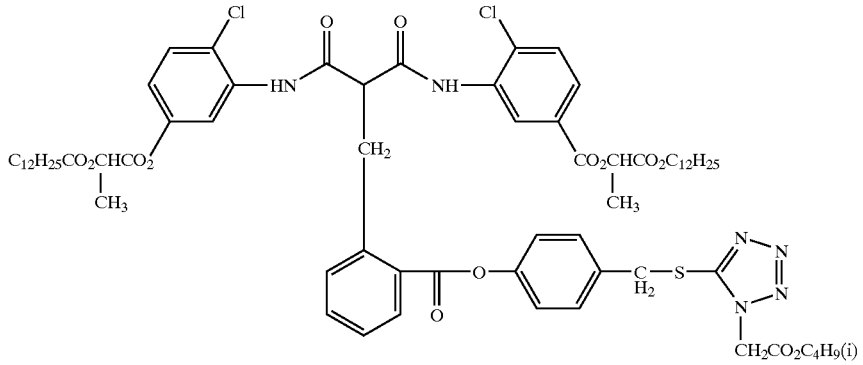
(54)
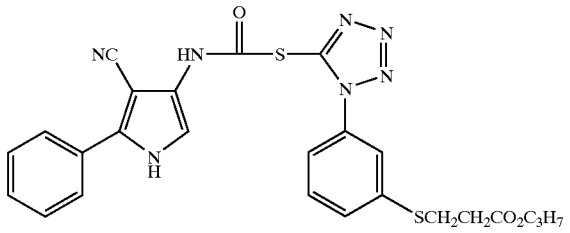
(55)
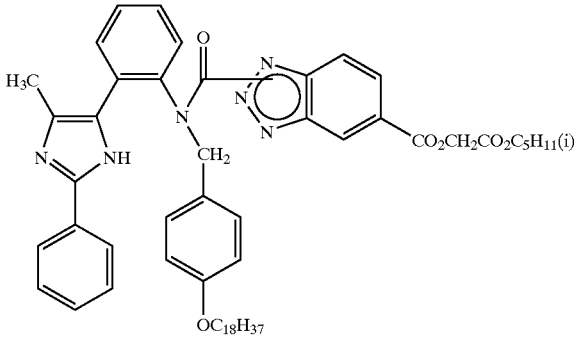

-continued
(56)
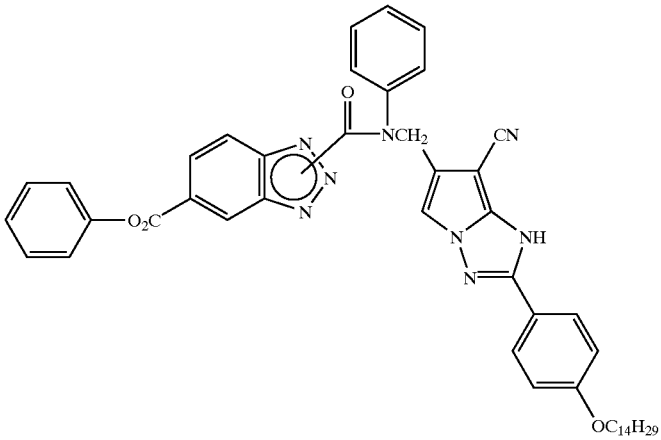
(57)
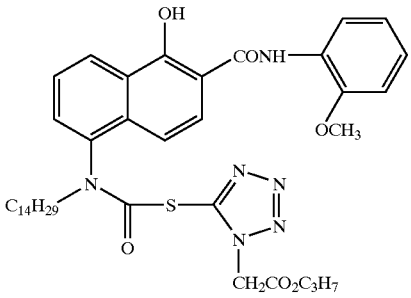
(58)
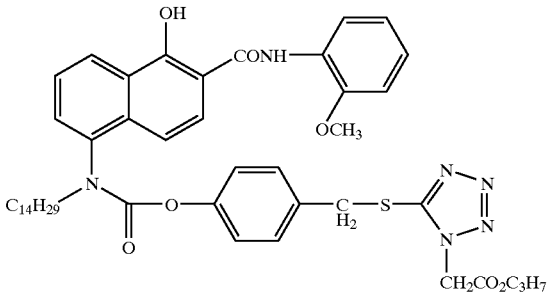
(59)
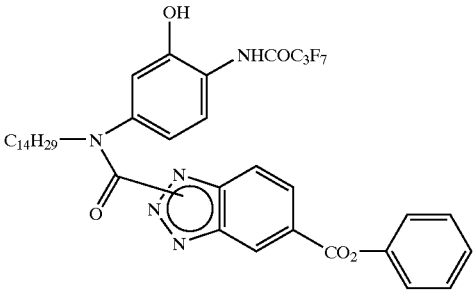

-continued
(60)
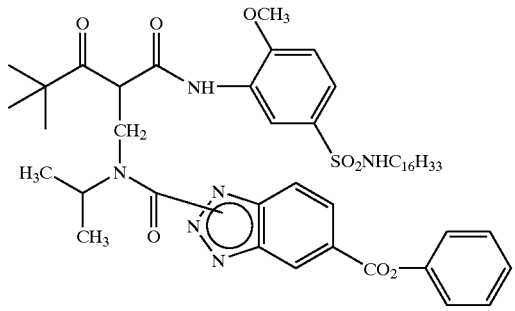
(61)
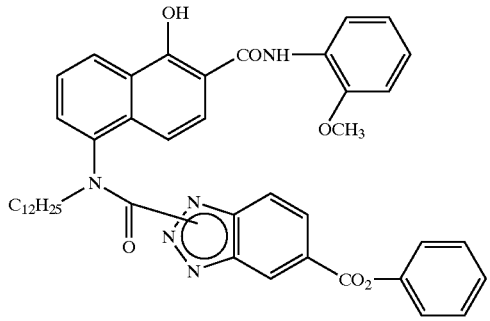
(62)
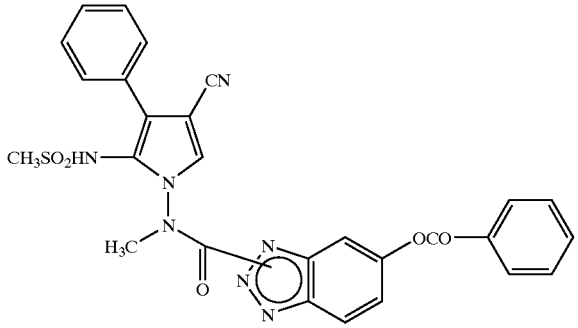
(63)
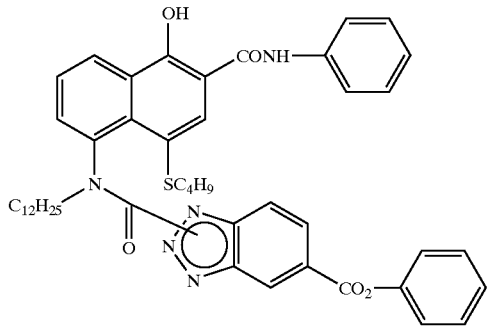
(64)
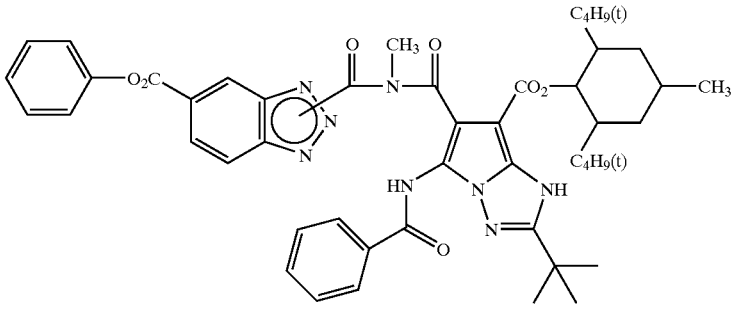

-continued
(65)
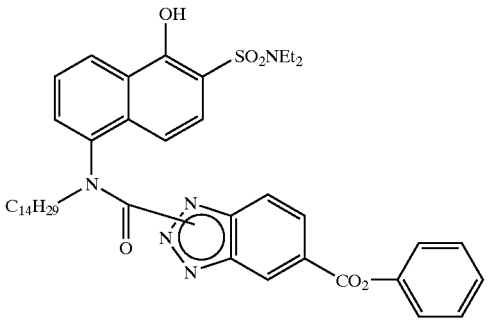
(66)
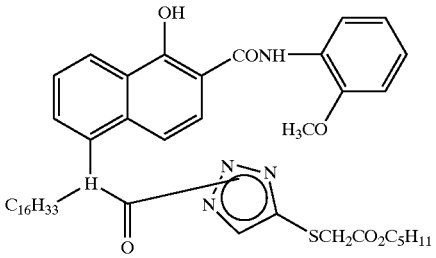
(67)
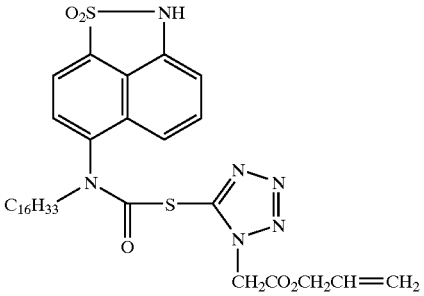
(68)
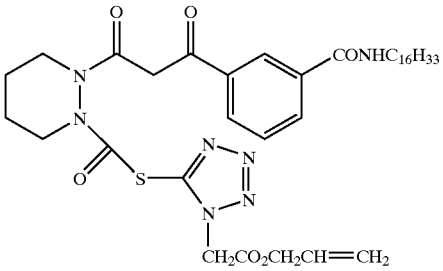
(69)
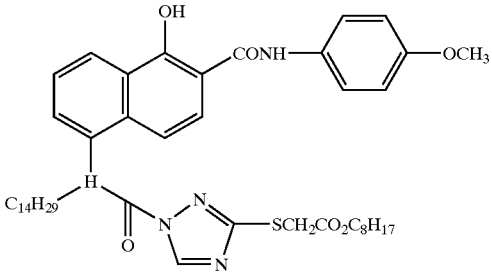

-continued
(70)
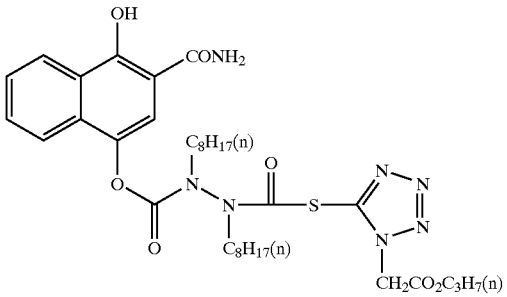
(71)
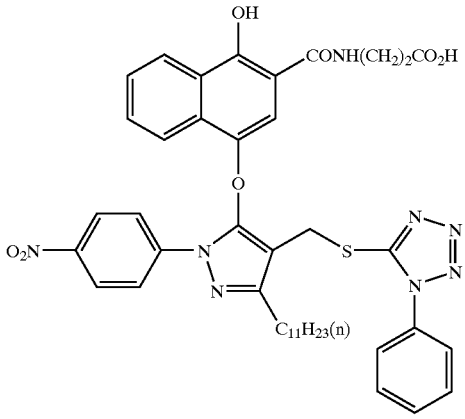
(72)
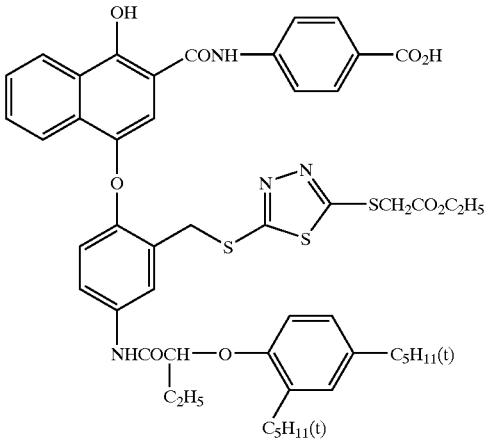
(73)
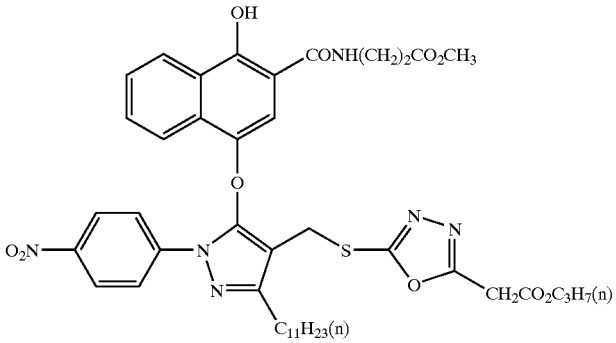

-continued
(74)
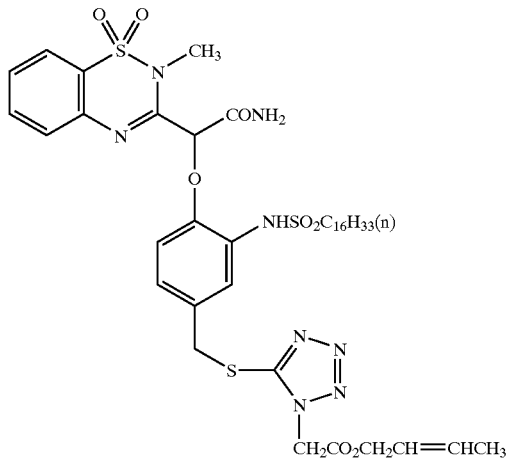
(75)
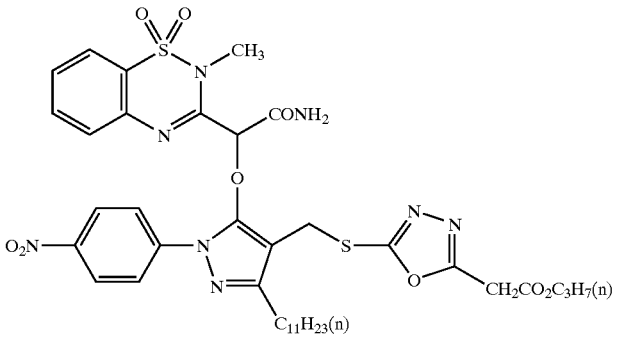
(76)
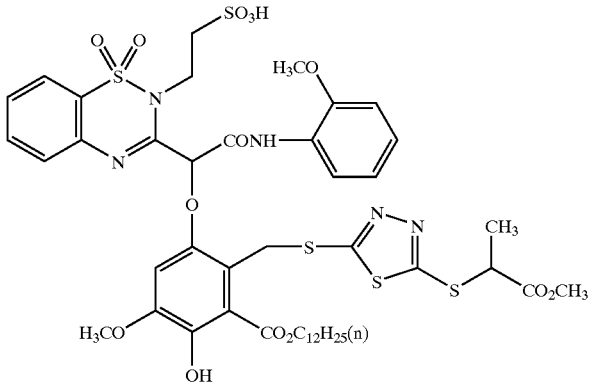
(77)
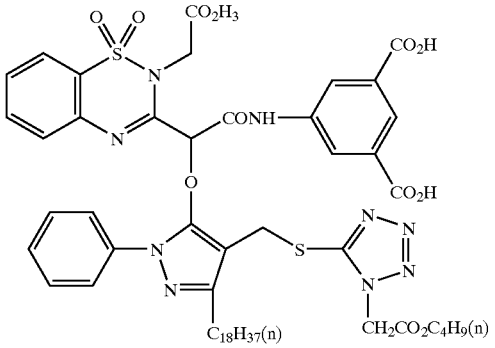

-continued
(78)
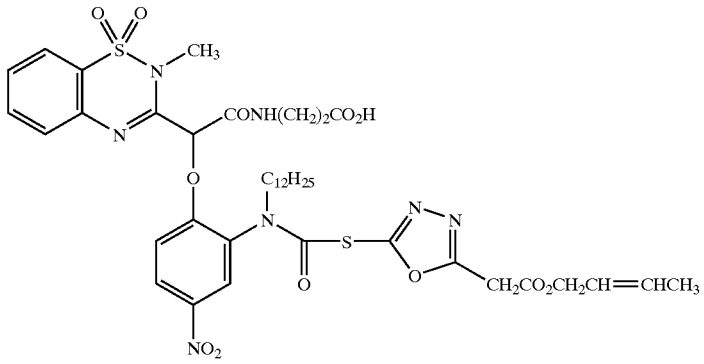
(79)
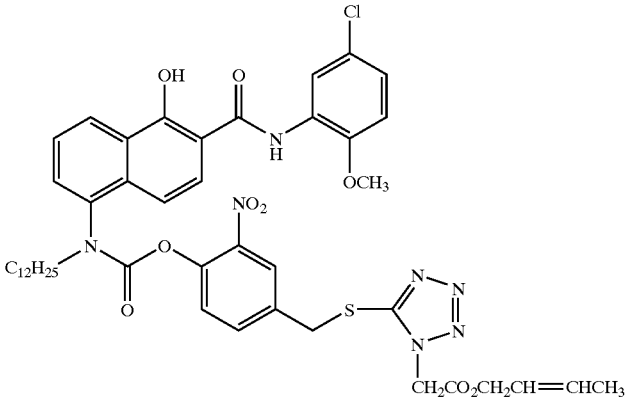
(80)
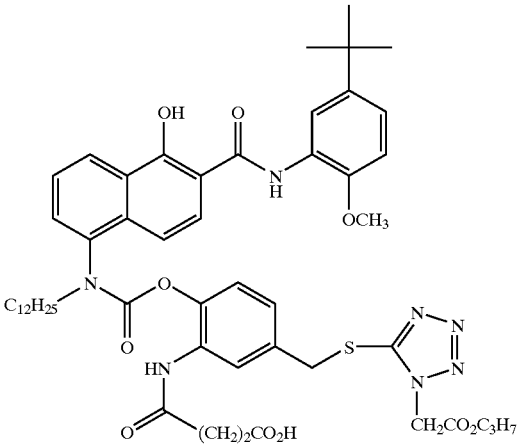
(81)
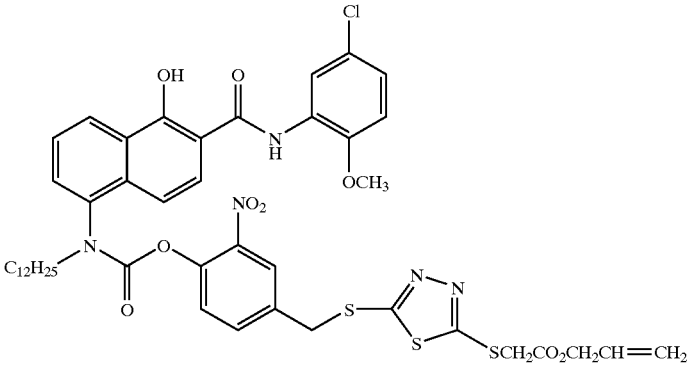

-continued
(82)
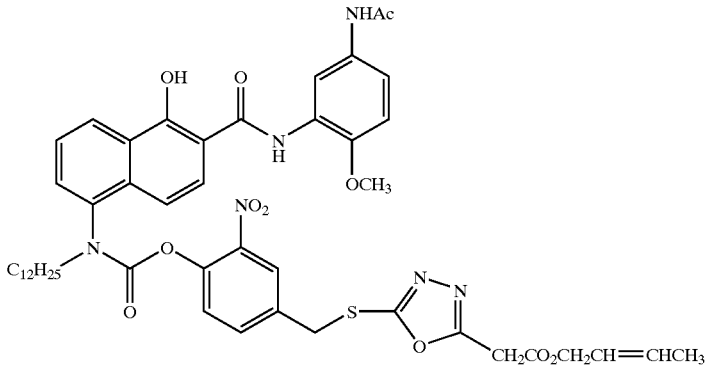
(83)
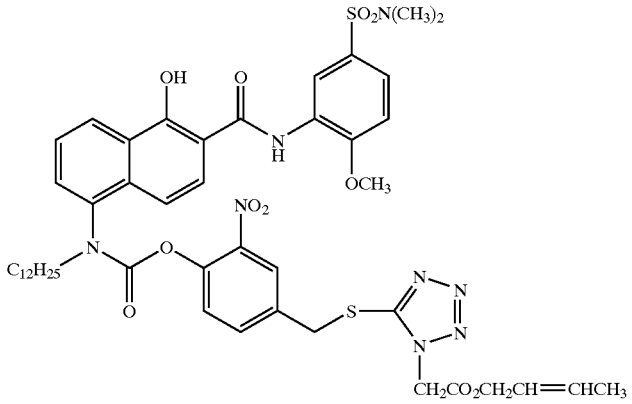
(84)
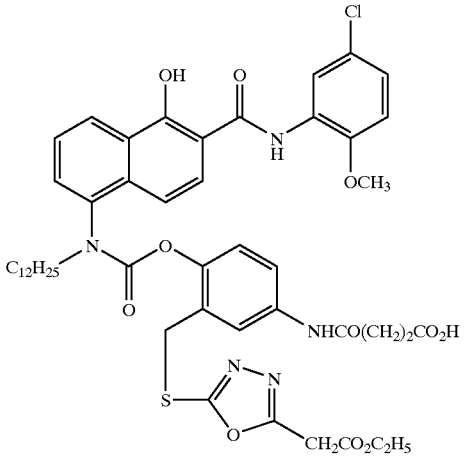

-continued
(85)
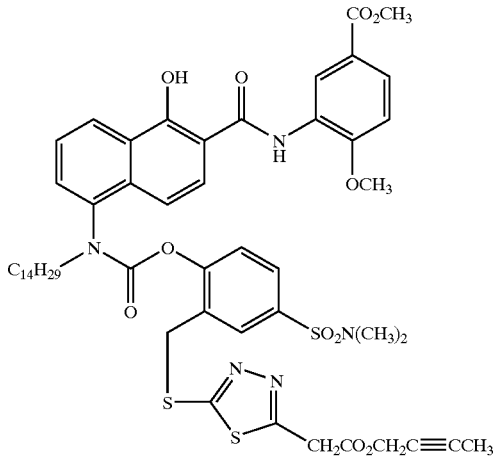
(86)
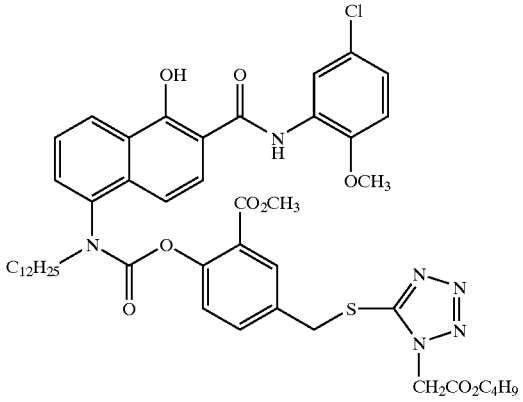
(87)
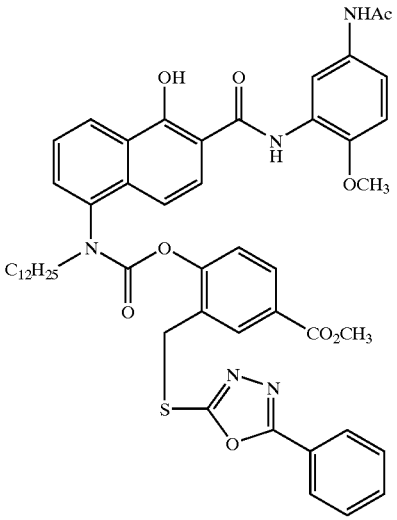

-continued
(88)
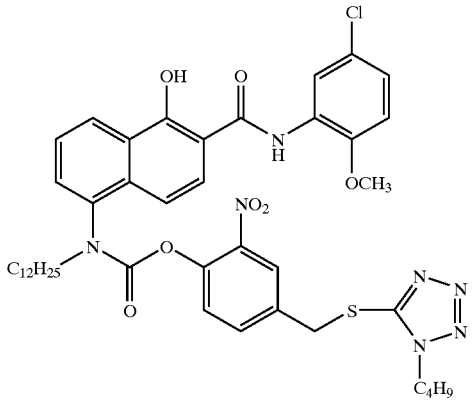
(89)
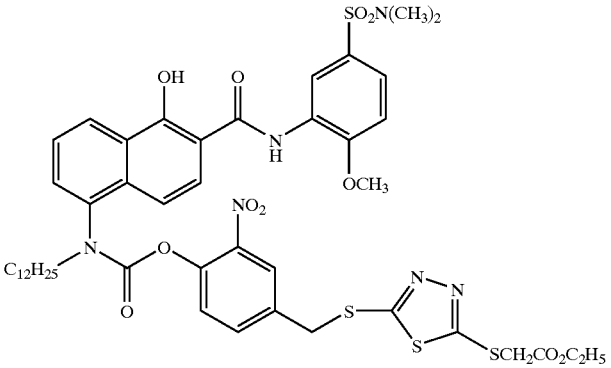
(90)
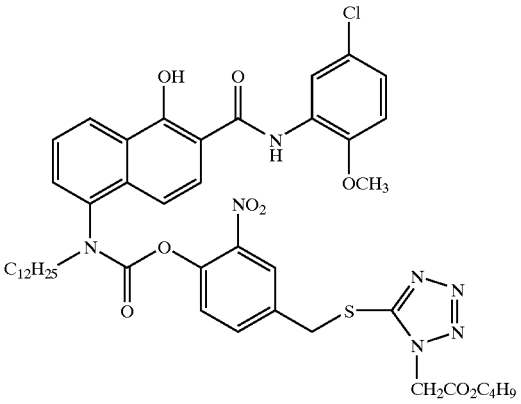
(91)
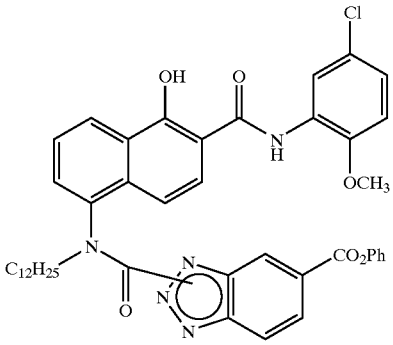

-continued
(92)
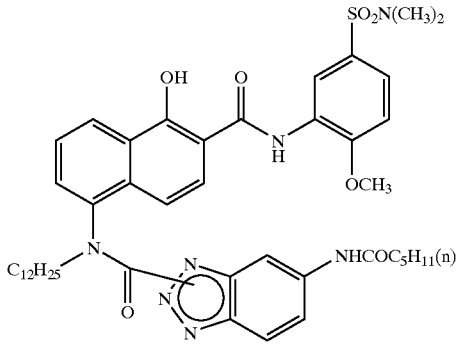
(93)
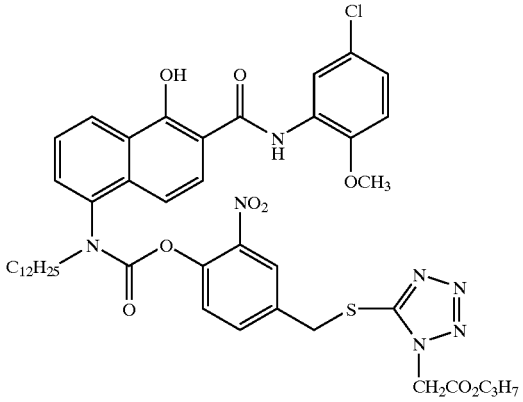
(94)
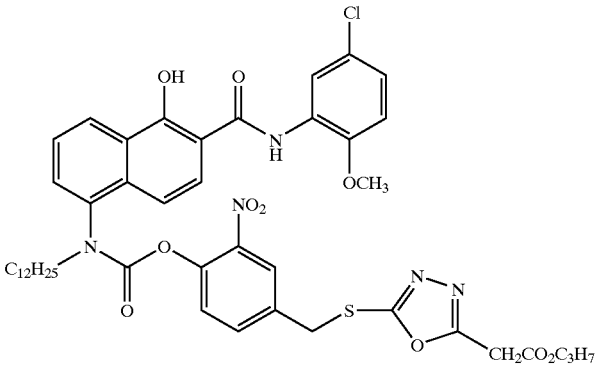
(95)
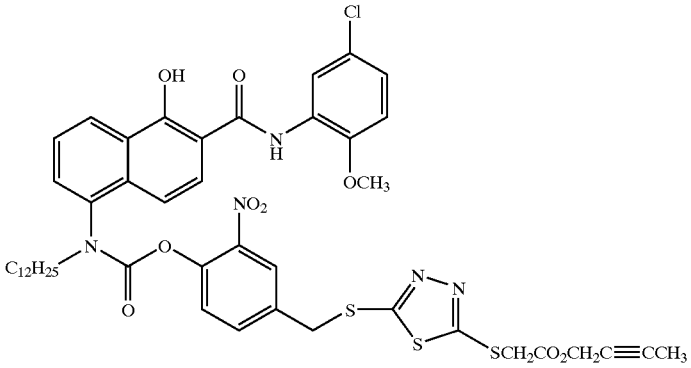

-continued (96)

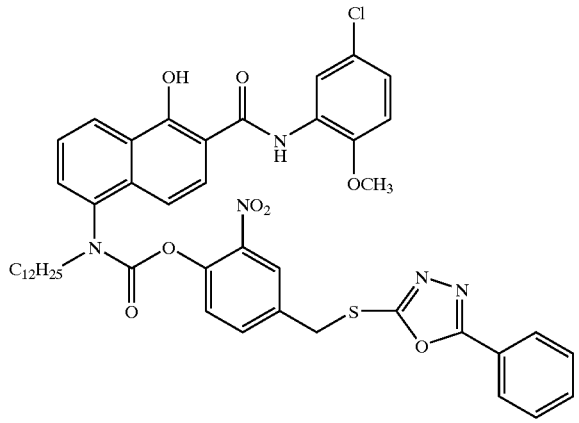

The development inhibitor-releasing compound of the present invention may be added to a colloidal silver-containing layer or a nonlight-sensitive layer adjacent thereto. The layer to which the development inhibitor-releasing compound is added is preferably a colloidal silver-containing layer. When the development inhibitor-releasing compound is added to a nonlight-sensitive layer adjacent to a colloidal silver-containing layer, the adjacent nonlight-sensitive layer is preferably a nonlight-sensitive layer adjacent to a light-sensitive layer. Specifically, the development inhibitor-releasing compound may be added to a nonlight-sensitive layer between a second antihalation layer and a red-sensitive layer or a first antihalation layer or a yellow filter layer.

The terminology "colloidal silver" indicates silver in the form of colloid or finely dispersed atomic silver (metallic silver).

Typical examples thereof include a colloidal silver which absorbs light throughout the visible range or which absorbs blue light. The former is employed for antihalation and the latter is employed as a yellow filter.

These colloidal silvers can be prepared by methods previously known, for example, a method of reducing a soluble silver salt in a gelatin solution as found in U.S. Pat. No. 2,688,601, a method of reducing a sparingly-soluble silver salt with hydrazine as described in German Patent No. 1,096,193, a method of reducing with tannic acid to silver as described in U.S. Pat. No. 2,921,914, a method of forming silver particles by electroless plating as described in JP-A-5-134358.

The total amount of the colloidal silver applied in the colloidal silver-containing nonlight-sensitive layer may be any amount such that the layer satisfies an antihalation or yellow filter performance as the photosensitive material. When an organic compound such as dye is used, the amount of the colloidal silver applied may be reduced or the colloidal silver may be eliminated. However, the colloidal silver-containing layer or a layer adjacent thereto must contain a compound capable of releasing a development inhibitor or a precursor thereof.

The colloidal silver may be added to a nonlight-sensitive layer such as a protective layer and an inter layer.

The colloidal silver added to at least one layer may have any color.

The colloidal silver and the application amount of colloidal silver to be added to the layer containing the compound capable of releasing a development inhibitor or a precursor thereof may be the whole of the colloidal silver applied in the above-mentioned photosensitive material or a part thereof.

In a nonlight-sensitive layer containing both a compound capable of releasing a development inhibitor or a precursor thereof and colloidal silver, the application amount of the compound capable of releasing a development inhibitor or a precursor thereof is preferably $1\times10^{-5}$ to $1\times10^{-1}$ mol/m$^2$.

In a nonlight-sensitive layer containing both a compound capable of releasing a development inhibitor or a precursor thereof and colloidal silver, a compound other than the compound capable of releasing a development inhibitor or a precursor thereof may further be added.

For example, a compound which reacts with an oxidized developing agent, such as a coupler, hydroquinones and hydrazines, may be added.

It is preferable that a nonlight-sensitive layer containing no colloidal silver is disposed between the nonlight-sensitive layer containing both a compound capable of releasing a development inhibitor or a precursor thereof and colloidal silver, and the light-sensitive silver halide emulsion layer.

It is preferable to add a compound which is capable of reacting with an oxidized developing agent, such as a coupler, hydroquinones and hydrazines, to the nonlight-sensitive layer containing no colloidal silver. In such a case, it is preferable that a substance resulting from a reaction with the oxidized developing agent produces substantially no color.

Next, the compound of the present invention (compound (B)) having at least three hetero atoms will be described. Although the term "hetero atom" includes any atoms other than carbon or hydrogen, preferably it is nitrogen, sulfur, phosphorus and oxygen.

If the compound (B) of the present invention is a heterocyclic compound, at least three hetero atoms exist in the heterocycle system-constituting moiety, or at least one hetero atom exists in the heterocycle system constituting-moiety and at least two hetero atoms exist in a position outside the cycle-system, at least two hetero atoms exist in positions separated from the cycle-system by at least one non-conjugated single bonding, or at least two hetero atoms exist in a part of a further substituent of the cycle-system.

In the present invention, the expression "increase in the photographic speed of the photosensitive material" indicates that $S_{0.2}$ increases by 0.02 or more, preferably 0.03 or more, more preferably 0.04 or more. The term "$S_{0.2}$" indicates a logarithmic value of a reciprocal of an exposure amount which provide a density of fog plus 0.2 in a photosensitive material developed in the development method described in Example 1 of the present specification. The above expression means that this value in the case of containing a compound having at least three hetero atoms is at least 0.02 higher than that in the case of not containing the same.

The compound (B) of the present invention may be used for either of the silver halide light-sensitive layer and nonlight-sensitive layer in the photosensitive material, preferably for the silver halide light-sensitive layer.

When the compound (B) is used in the silver halide light-sensitive layer, if the light sensitive layer is formed of separate layers having different speeds, it may be used for any layer. It is preferably used in a high-speed layer.

If the compound (B) is used in a nonlight-sensitive layer, it is preferably used for an interlayer located between a red-sensitive layer and a green-sensitive layer, or between a green-sensitive layer and a blue-sensitive layer.

The method of adding the compound (B) into the light-sensitive layer is not specifically limited. There are methods such as emulsification dispersion with a high-boiling organic solvent, solid dispersion, a method of dissolving it in an organic solvent of methanol or the like and adding it to a coating solution, and a method of adding it at the time of preparing the silver halide emulsion. It is preferably introduced into the sensitive material by emulsification dispersion.

Although a method of introducing the compound (B) as it is into the sensitive material without any processing is preferable, it is also preferable to introduce, in the sensitive material, a compound which reacts with a oxidized developing agent thereby to release a residue of the compound having at least three hetero atoms. Such a compound is also included in the range of the compound (B).

Although the addition amount of the compound (B) is not specifically limited, it is preferably 0.1 to 1000 mg/m$^2$, more preferably 1 to 500 mg/m$^2$, especially preferably 5 to 100 mg/m$^2$. When compound (B) is a compound capable of releasing a residue of compound having at least three hetero atoms by a reaction with an oxidized developing agent, the addition amount thereof, may be so selected that the addition amount in terms of the compound having at least three hetero atoms is within the above range.

If it is used for the light-sensitive silver halide emulsion layer, the addition amount thereof is $1\times10^{-4}$ to $1\times10^{-1}$ mol per mol of silver in the same layer, more preferably $1\times10^{-3}$ to $5\times10^{-2}$ mol of silver in the same layer.

Examples of the compound (B) of the present invention will be set forth below. However, the compound (B) is not limited to these.

HET-1

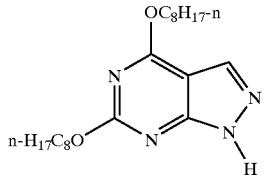

HET-2

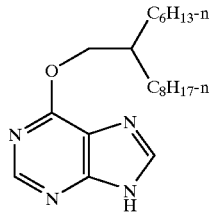

HET-3

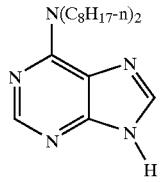

HET-4

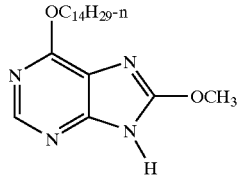

HET-5

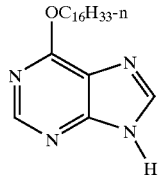

HET-6

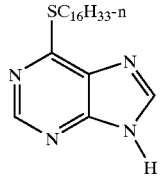

HET-7

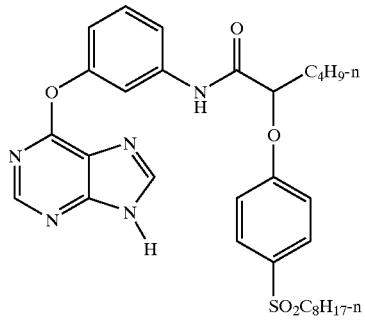

-continued
HET-8
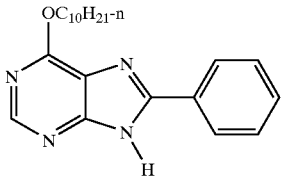
HET-9
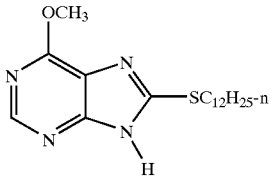
HET-10
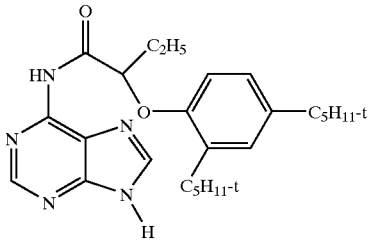
HET-11
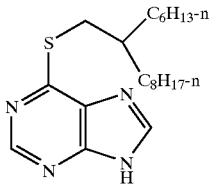
HET-12
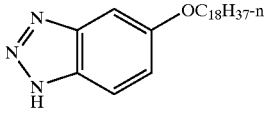
HET-13
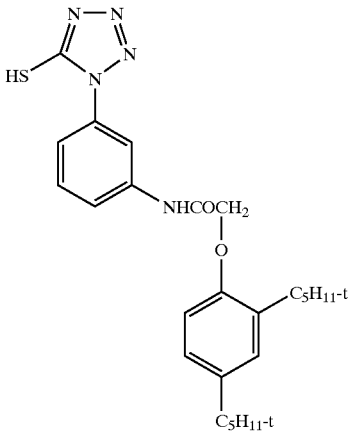
-continued
HET-14
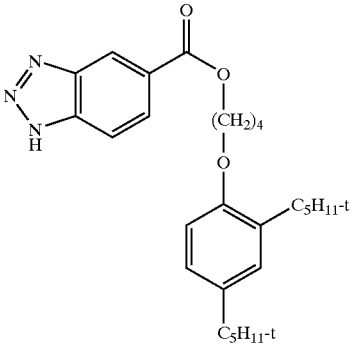
HET-15
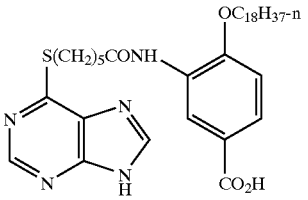
HET-16
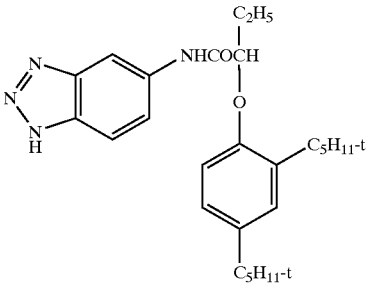
HET-17
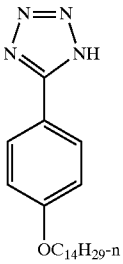
HET-18
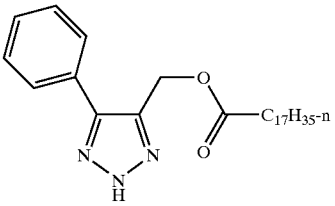
HET-19
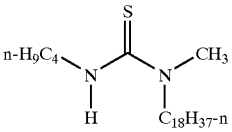

-continued
HET-20
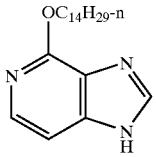
HET-21
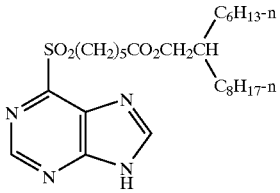
HET-22
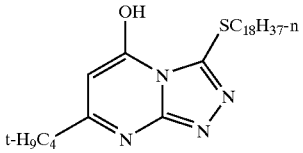
HET-23
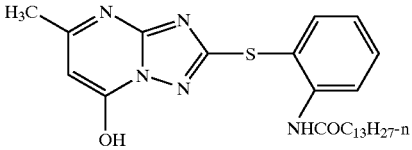
HET-24
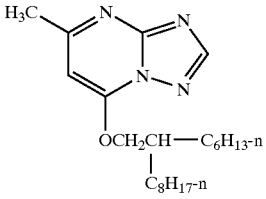
HET-25
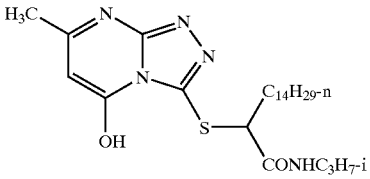
HET-26
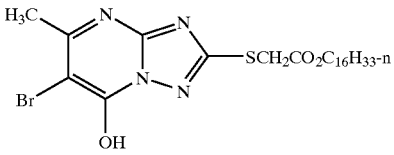
HET-27
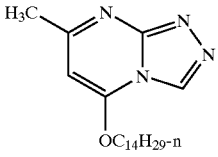
-continued
HET-28
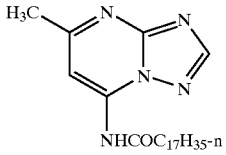
HET-29
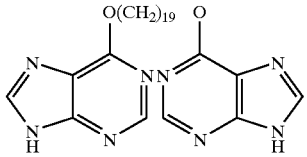
HET-30
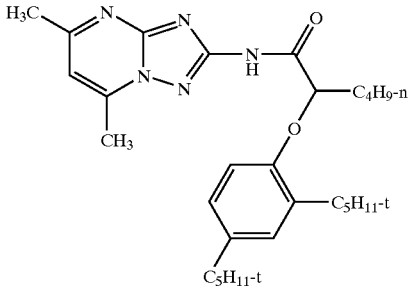
HET-31
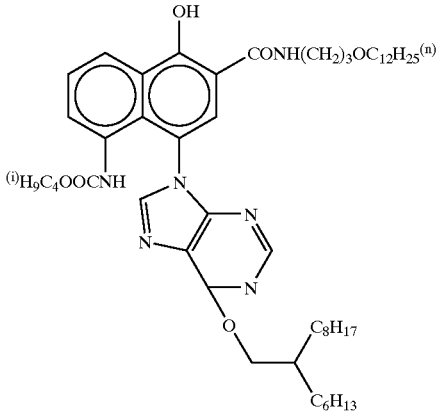
HET-32
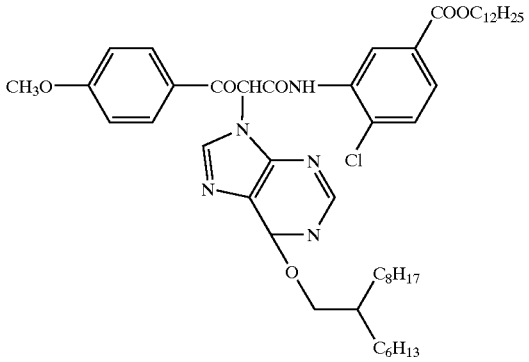
HET-33
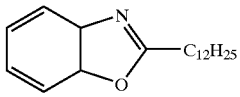

-continued
HET-34
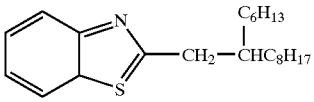
HET-35
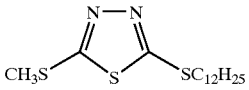
HET-36
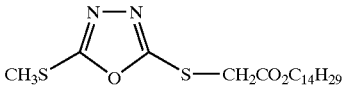
HET-37
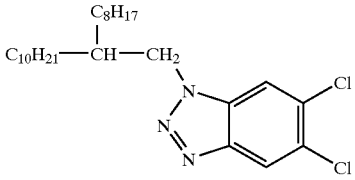
HET-38
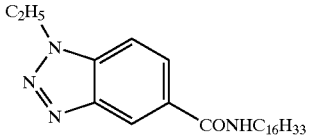
HET-39
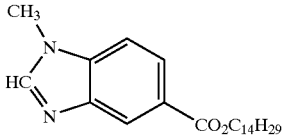
HET-40
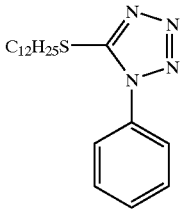
HET-41
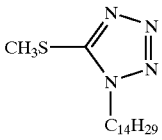
HET-42
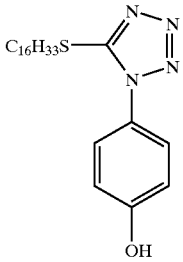
-continued
HET-43
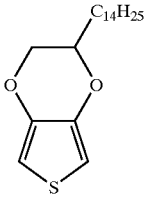
HET-44
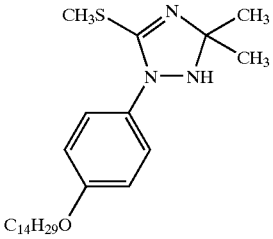
HET-45
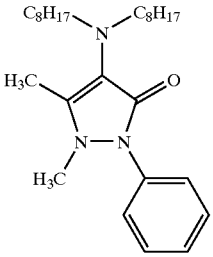
HET-46
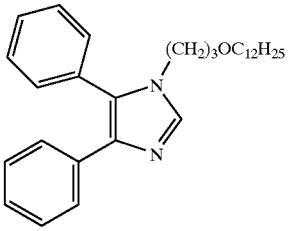
HET-47
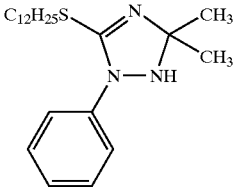
HET-48
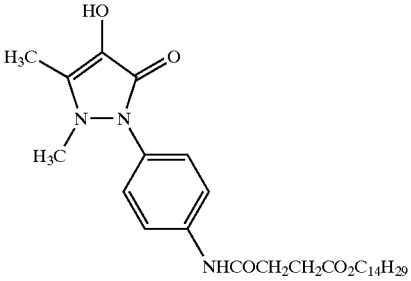

-continued

HET-49

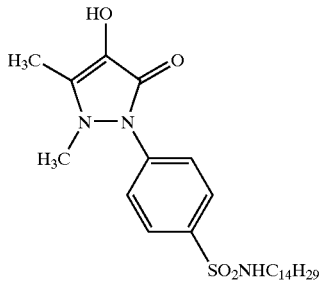

HET-50

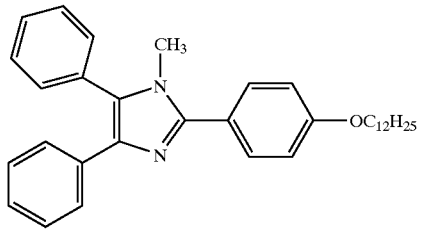

HET-51

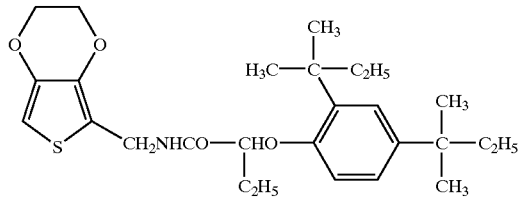

HET-52

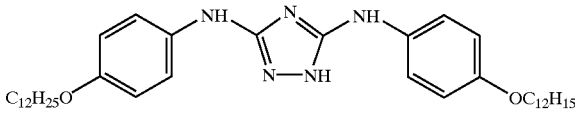

The compound represented by general formula (M) or (C) will be described below.

(M)

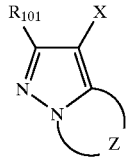

(C)

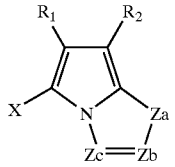

In formula (M), $R_{101}$ represents a hydrogen atom or substituent. Z represents a group of non-metallic atoms required to form a 5-membered azole ring containing 2 to 4 nitrogen atoms. The azole ring may have a substituent (including a fused ring). X represents a hydrogen atom or substituent.

In formula (C), Za represents —NH— or —CH($R_3$)—, and Zb and Zc independently represent —C($R_4$)= or —N=. $R_1$, $R_2$ and $R_3$ independently represent an electron-withdrawing group having a Hammett constant σp value of 0.2 to 1.0. $R_4$ represents a hydrogen atom or substituent. If there are two $R_4$s in the formula, they may be the same or different. X represents a hydrogen atom or substituent.

The compound of the present invention will be described in detail below. Of the skeletons represented by formula (M), preferable skeletons are 1H-pyrazolo[1,5-b][1,2,4]triazole and 1H-pyrazolo[5,1-c][1,2,4]triazole, which are represented by formula (M-1) and (M-2), respectively.

(M-1)

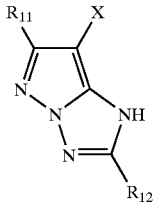

(M-2)

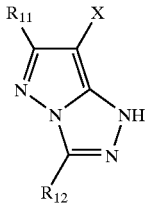

In the formula, $R_{11}$ and $R_{12}$ represent a substituent. X represents a hydrogen atom or substituent.

The substituents $R_{11}$, $R_{12}$ and X in formula (M-1) or (M-2) will be described in detail.

$R_{11}$ preferably represents a halogen atom (e.g., chlorine atom, bromine atom, and fluorine atom), alkyl group (having 1 to 60 carbon atoms, e.g., methyl, ethyl, propyl, iso-butyl, t-butyl, t-octyl, 1-ethylhexyl, nonyl, undecyl, pentadecyl, n-hexadecyl, and 3-decanamidepropyl), alkenyl group (having 2 to 60 carbon atoms, e.g., vinyl, allyl, and oleyl), cycloalkyl group (having 5 to 60 carbon atoms, e.g., cyclopentyl, cyclohexyl, 4-t-butylcyclohexyl, 1-indanyl, and cyclododecyl), aryl group (having 6 to 60 carbon atoms, e.g., phenyl, p-tolyl, and naphthyl), acylamino group (having 2 to 60 carbon atoms, e.g., acetylamino, n-butanamide, octanoylamino, 2-hexyldecanamide, 2-(2',4'-di-t-amylphenoxy)butanamide, benzoylamino, and nicotinamide), sulfonamide group (having 1 to 60 carbon atoms, e.g., methanesulfonamide, octanesulfonamide, and benzenesulfonamide), ureide group (having 2 to 60 carbon atoms, e.g., decylaminocarbonylamino, and di-n-octylaminocarbonylamino), urethane group (having 2 to 60 carbon atoms, e.g., dodecyloxycarbonylamino, phenoxycarbonylamino, and 2-ethylhexyloxycarbonylamino), alkoxy group (having 1 to 60 carbon atoms, e.g., methoxy, ethoxy, butoxy, n-octyloxy, hexadecyloxy, and methoxyethoxy), aryloxy group (having 6 to 60 carbon atoms, e.g., phenoxy, 2,4-di-t-amylphenoxy, 4-t-octylphenoxy, and naphthoxy), alkylthio group (having 1 to 60 carbon atoms, e.g., methylthio, ethylthio, butylthio, and hexadecylthio), arylthio group (having 6 to 60 carbon atoms, e.g., phenylthio, and 4-dodecyloxyphenylthio), acyl group (having 1 to 60 carbon atoms, e.g., acetyl, benzoyl, butanoyl, and dodecanoyl), sulfonyl group (having 1 to 60 carbon atoms, e.g., methanesulfonyl, butanesulfonyl, and toluenesulfonyl), cyano group, carbamoyl group (having 1 to 60 carbon atoms, e.g., N,N-dicyclohexylcarbamoyl), sulfamoyl group (having 0 to 60 carbon atoms, e.g., N,N-dimethylsulfamoyl), hydroxy group, sulfo group, carboxyl group, nitro group, alkylamino group (having 1 to 60 carbon atoms, e.g., methylamino, diethylamino, octylamino, and octadecylamino), arylamino group (having 6 to 60 carbon atoms, e.g., phenylamino, naphthylamino, and N-methyl-N-phenylamino), heterocyclic group (having 0 to 60 carbon atoms, preferably 3- to 8-membered, and more preferably, 5- to 6-membered heterocyclic group including a hetero atom, which forms a ring, selected from the group consisting of a nitrogen atom, oxygen atom, and sulfur atom, and more preferably, including a carbon atom as the ring-forming atoms in addition to the hetero atoms, e.g., a group indicated as an example of term X described later), and an acyloxy group (having 1 to 60 carbon atoms, e.g., formyloxy, acetyloxy, myristoyloxy, and benzoyloxy).

Of the above, the alkyl group, cycloalkyl group, aryl group, acylamino group, ureide group, urethane group, alkoxy group, aryloxy group, alkylthio group, arylthio group, acyl group, sulfonyl group, cyano group, carbamoyl group, and sulfamoyl group include those having a substituent, or those having a condensed ring, if possible. Examples of the substituent are an alkyl group, cycloalkyl group, aryl group, acylamino group, ureide group, urethane group, alkoxy group, aryloxy group, alkylthio group, arylthio group, acyl group, sulfonyl group, cyano group, carbamoyl group and sulfamoyl group. As a condensed ring, benzene and the like may be enumerated.

Of these substituents, preferable examples of $R_{11}$ are an alkyl group, aryl group, alkoxy group, and aryloxy group. An alkyl group, alkoxy group and aryloxy group are more preferably. A branched alkyl group is especially preferable.

$R_{12}$ preferably represents the substituents as indicated for $R_{11}$. More preferable examples of the substituents are an alkyl group, aryl group, heterocyclic group, alkoxy group, and aryloxy group.

$R_{12}$ still more preferably represents a substituted alkyl group and substituted aryl group, and most preferably, a substituted aryl group. Compounds represented by general formulas (M-3) and (M-4) are preferable. In general formulas (M-3) and (M-4), the substitution position of $—NHSO_2R_{13}$ is not particularly limited, but m- and p-positions are preferable, and p-position is more preferable.

(M-3)

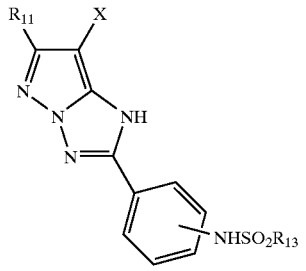

(M-4)

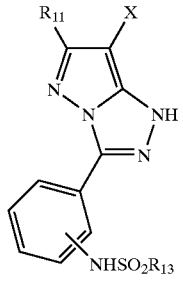

In the formulas, $R_{11}$ and X have the same meanings as those defined in general formulas (M-1) and (M-2). $R_{13}$ represents a substituent. Examples of preferable substituents represented by $R_{13}$ are the substituents enumerated above for $R_{11}$. Examples of more preferable substituents are a substituted aryl group, and a substituted or unsubstituted alkyl group. As the substituent in this case, the substituents enumerated above as examples of $R_{11}$ are preferable.

X represents a hydrogen atom or substituent. Preferable examples of the substituents are those enumerated as examples of $R_{11}$. More preferable examples of the substituents represented by X are an alkyl group, alkoxycarbonyl group, carbonyl group, carbamoyl group or a group which leaves by reaction with an oxidized developing agent. Examples of the leaving group are a halogen atom (fluorine, chlorine, bromine, etc.), alkoxy group (ethoxy, methoxycarbonylmethoxy, carboxypropyloxy, methanesulfonylethoxy, perfluoropropoxy, etc.), aryloxy group (4-carboxyphenoxy, 4-(4-hydroxyphenylsulfonyl) phenoxy, 4-methanesulfonyl-3-carboxyphenoxy, 2-methanesulfonyl-4-acetylsulfamoylphenoxy, etc.), acyloxy group (acetoxy, benzoyloxy, etc.), sulfonyloxy group (methanesulfonyloxy, benzenesulfonyloxy, etc.), acylamino group (heptafluorobutyrylamino, etc.), sulfonamide group (methanesulfonamide, etc.), alkoxycarbonyloxy group (ethoxycarbonyloxy, etc.), carbamoyloxy group (diethylcarbamoyloxy, piperidinocarbonyloxy, morpholinocarbonyloxy, etc.), alkylthio group (2-carboxyethylthio, etc.), arylthio group (2-octyloxy-5-t-octylphenylthio, 2-(2,4-di-t-amylphenoxy) butyrylaminophenylthio, etc.), heterocyclic thio group (1-phenyltetrazolylthio, 2-benzimidazolylthio, etc.), heterocyclic oxy group (2-pyridyloxy, 5-nitro-2-pyridyloxy, etc.), 5- or 6-membered, nitrogen-containing heterocyclic group (1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dione-3-yl, purine, etc.), azo group (4-methoxyphenylazo, 4-pivaloylaminophenylazo, etc.), etc.

The substituent represented by X is preferably an alkyl group, alkoxycarbonyl group, carbamoyl group, halogen atom, alkoxy group, aryloxy group, alkylthio group, arylthio group, or a 5- or 6-membered, nitrogen-containing heterocyclic group which bonds to the coupling active position with a nitrogen atom, and more preferably an alkyl group, carbamoyl group, halogen atom, substituted aryloxy group, substituted arylthio group, alkylthio group, or 1-pyrazolyl group.

The compound preferably used in the present invention which is represented by general formulas (M-1) and (M-2) may form a polymer which is greater than or equal to a dimer through $R_{11}$ and $R_{12}$, or may bond to a macromolecular chain. In the present invention, formula (M-1) is preferable and formula (M-3) is more preferable.

Next, general formula (C) will be described. The formula (C) of the present invention is specifically expressed by the following formulas (C3) to (C10):

(C3)

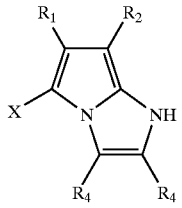

-continued (C4)

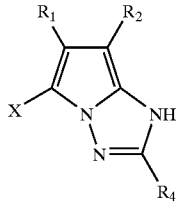

(C5)

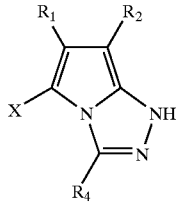

(C6)

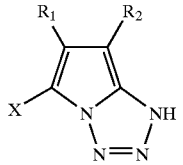

(C7)

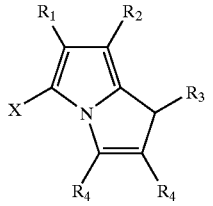

(C8)

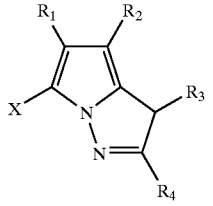

(C9)

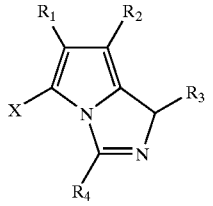

(C10)

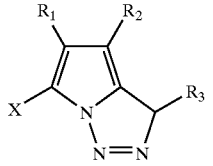

In the formulas, $R_1$ to $R_4$ and X have the same meanings as those defined in formula (C).

In the present invention, the compounds represented by formulas (C3), (C4), (C5) and (C8) are preferable, and the compound represented by (C4) is especially preferable.

In formula (C), the substituent represented by $R_1$, $R_2$ and $R_3$ is an electron-withdrawing group having a Hammett constant σp value of 0.20 to 1.0, preferably an electron-withdrawing group having a σp value of 0.20 to 0.8. Hammett's rule is an empirical rule proposed by L. P. Hammett in 1935 in order to quantitatively argue the effects of substituents on reaction or equilibrium of benzene derivatives. The rule is widely regarded as appropriate these days. The substituent constants obtained by the Hammett rule include a σp value and a am value, and these values are described in a large amount of general literature. For example, the values are described in detail in J. A. Dean ed., "Lange's Handbook of Chemistry," the 12th edition, 1979 (McGraw-Hill), "The Extra Number of The Domain of Chemistry (KAGAKUNO RYOIKI ZOUKAN)," Vol. 122, pages 96 to 103, 1979 (Nanko Do) and Chemical Reviews, Vol. 91, pp. 165–195 (1991).

In the present invention, $R_1$, $R_2$, and $R_3$ are defined by the Hammett constant σp value. However, this does not mean that $R_1$, $R_2$, and $R_3$ are limited to substituents having the known values stated in the above literature. That is, the present invention includes, of course, substituents having values that fall within the above range when measured on the basis of Hammett's rule even if they are unknown in literature.

Examples of $R_1$, $R_2$, and $R_3$, as the electron-withdrawing group having a σp value of 0.2 to 1.0, are an acyl group, alkoxycarbonyl group, aryloxycarbonyl group, carbamoyl group, cyano group, nitro group, dialkylphosphono group, diarylphosphono group, diarylphosphinyl group, alkylsulfinyl group, arylsulfinyl group, alkylsulfonyl group, arylsulfonyl group, etc. Of these substituents, those capable of further having substituents can further have substituents to be enumerated later for $R_4$.

$R_1$, $R_2$, and $R_3$ preferably represent an acyl group, alkoxycarbonyl group, cycloalkoxycarbonyl group, aryloxycarbonyl group, carbamoyl group, cyano group, and sulfonyl group, and more preferably, an cyano group, acyl group, alkoxycarbonyl group, aryloxycarbonyl group, and carbamoyl group.

A preferable example of the combination of $R_1$ and $R_2$, is one wherein $R_1$ represents a cyano group and $R_2$ represents an alkoxycarbonyl group or cycloalkoxycarbonyl group.

$R_4$ represents a hydrogen atom or substituent. Examples of the substituent are those enumerated above for $R_{11}$.

Preferable examples of the substituents represented by $R_4$ are an alkyl group, aryl group, heterocyclic group, alkoxy group, aryloxy group, and acylamino group. An alkyl group and substituted aryl group are more preferable, and a substituted aryl group is most preferable. Examples of the substituent in this case are those enumerated above for $R_4$.

X has the same meaning as that defined in general formula (M).

The following are examples of a coupler preferably used in the present invention. However, the present invention is not limited to these examples.

(1)
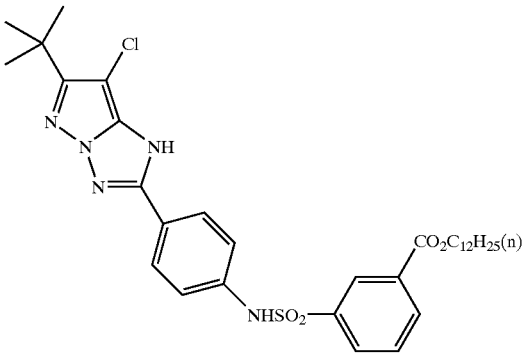
(2)
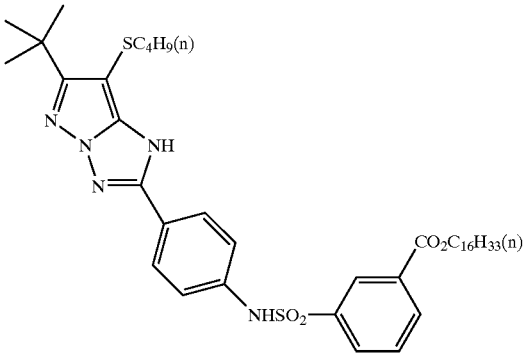
(3)
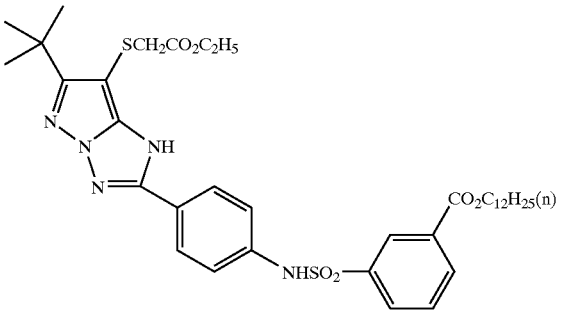
(4)
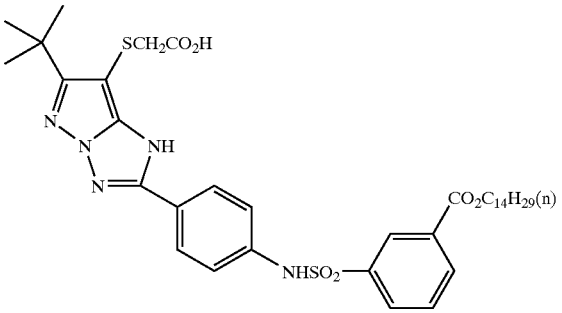
-continued
(5)
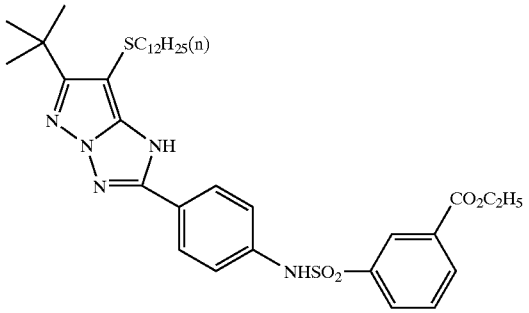
(6)
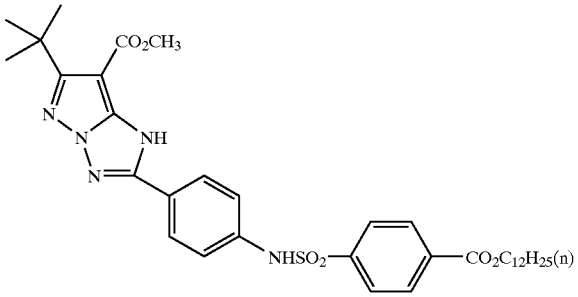
(7)
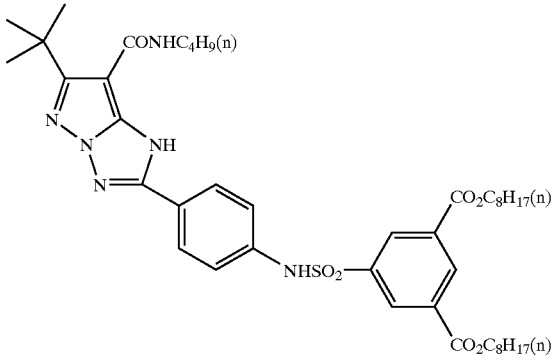
(8)
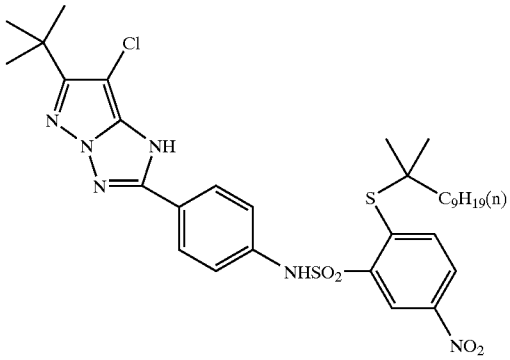

-continued
(9)
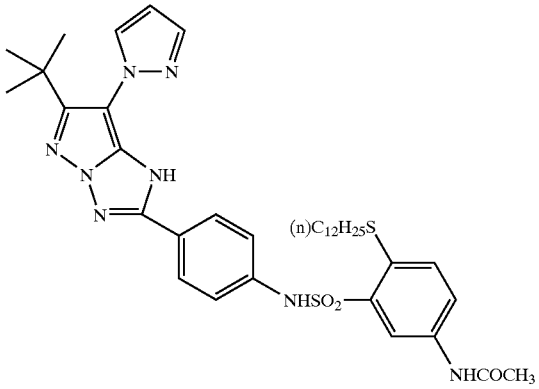
(10)
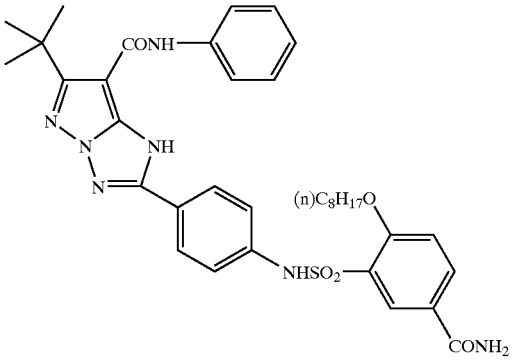
(11)
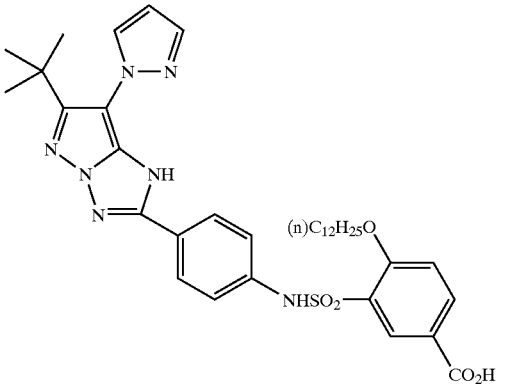
(12)
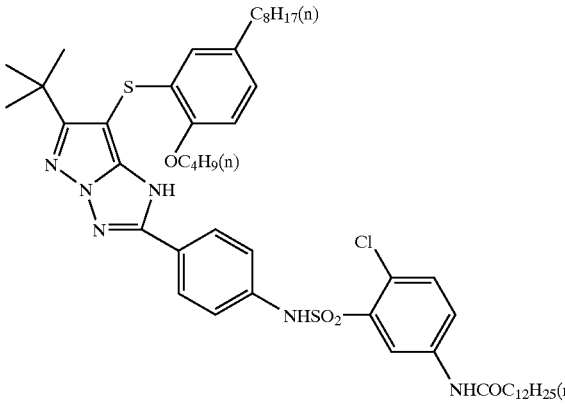
-continued
(13)
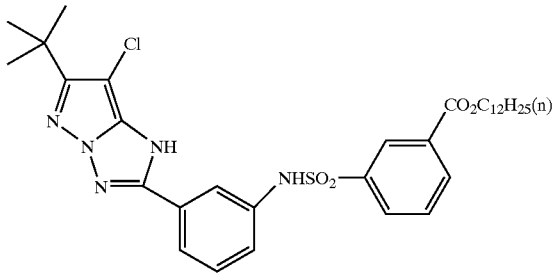
(14)
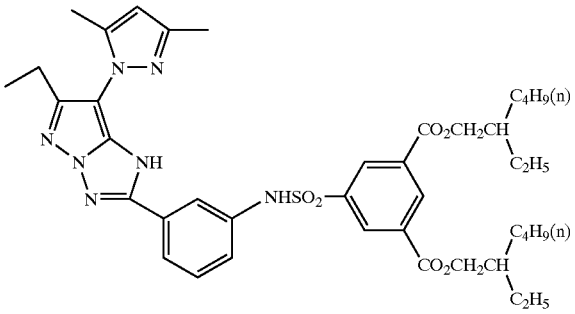
(15)
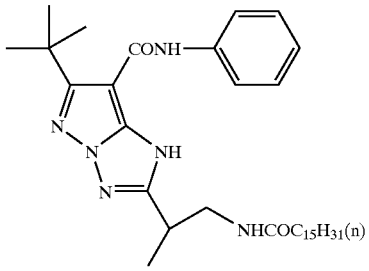
(16)
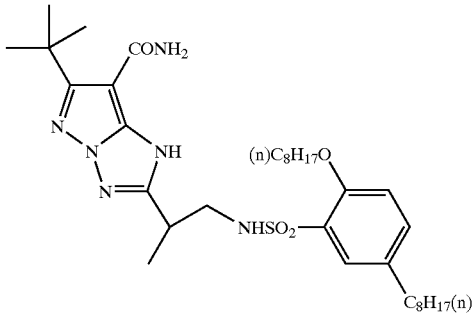
(17)
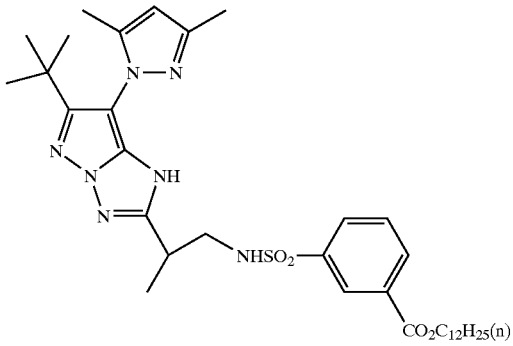

-continued
(18)
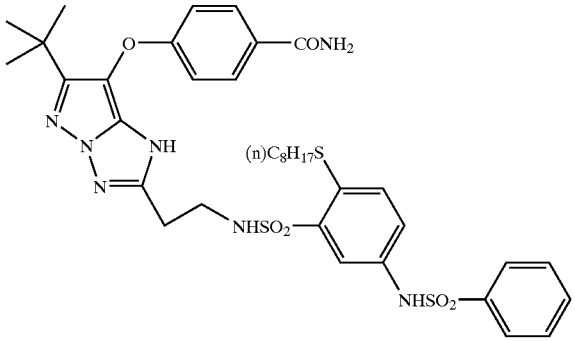
(19)
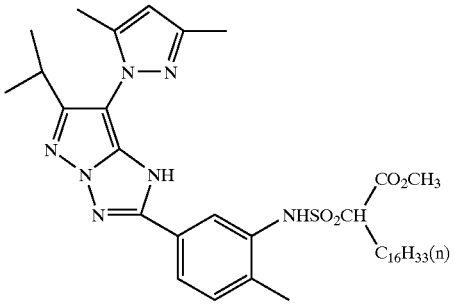
(20)
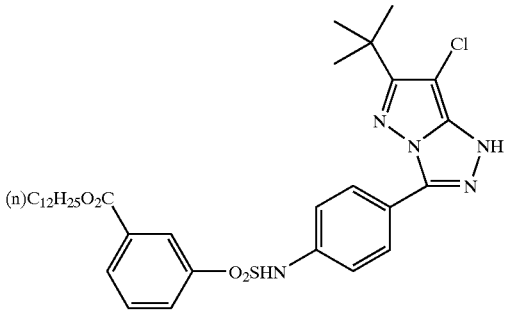
(21)
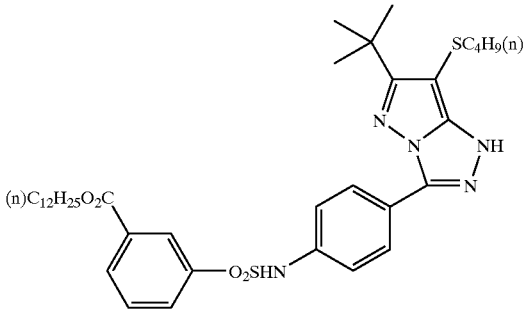
-continued
(22)
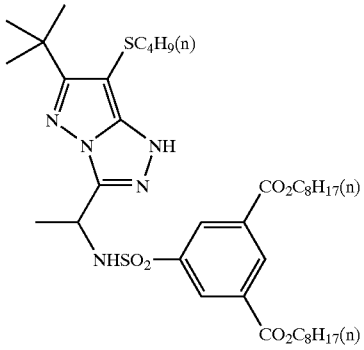
(23)
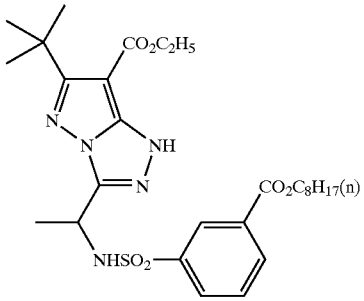
(24)
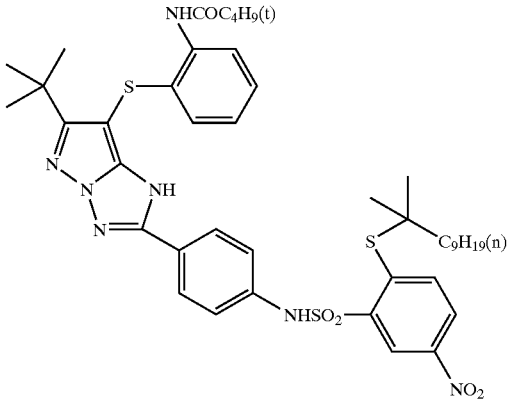
(25)
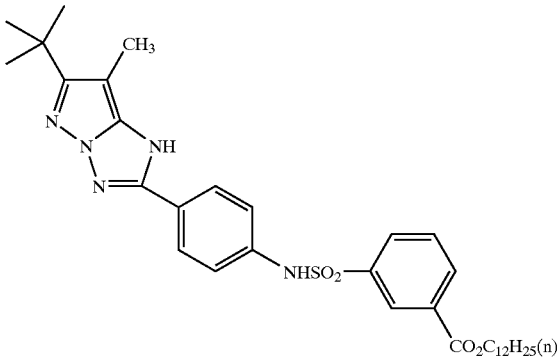

-continued
(26)
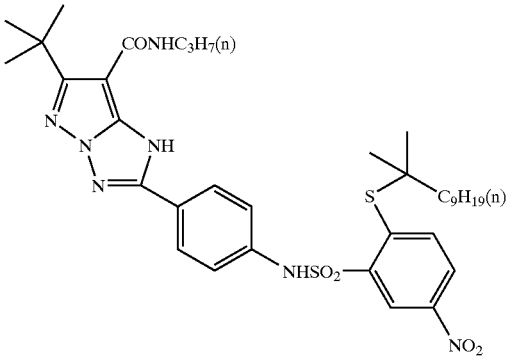
(27)
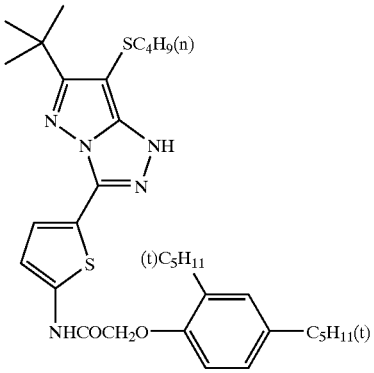
(28)
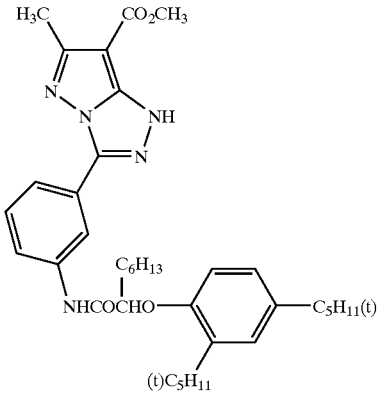
(29)
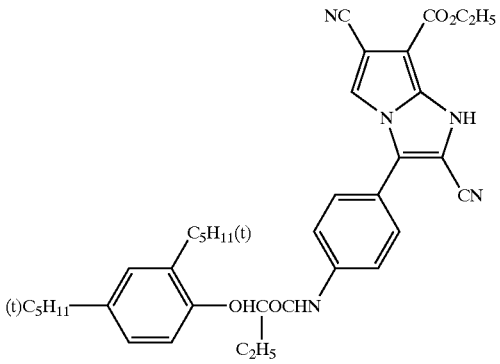
-continued
(30)
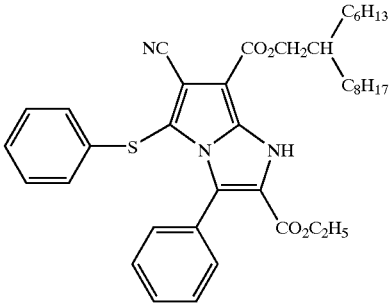
(31)
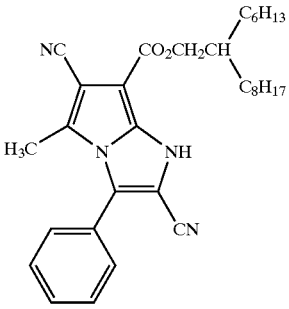
(32)
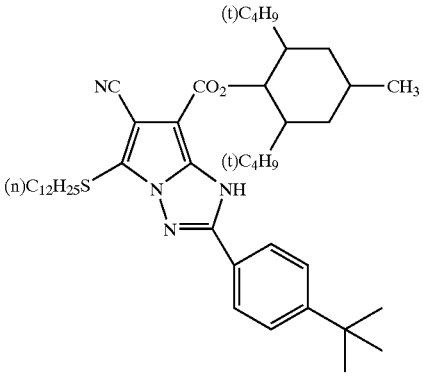
(33)
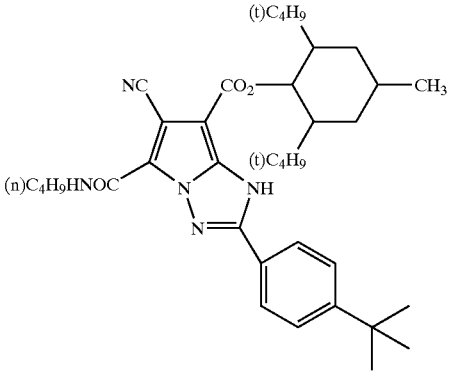

-continued
(34)
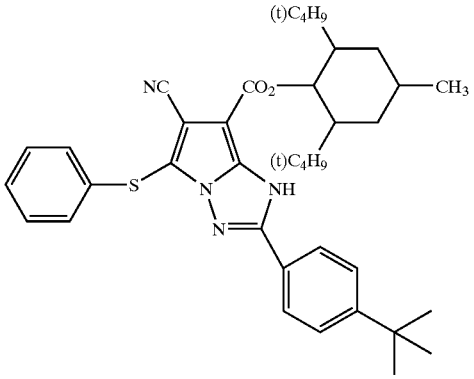
(35)
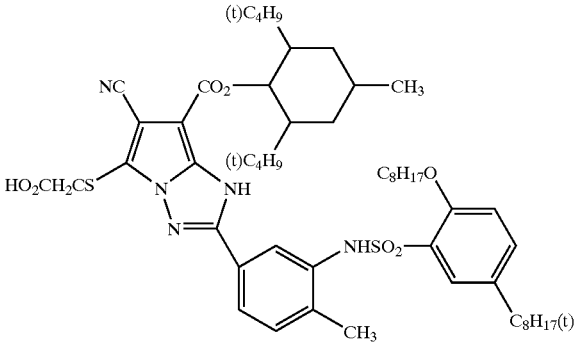
(36)
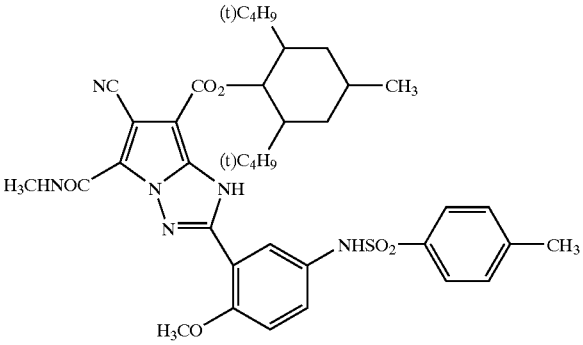
(37)
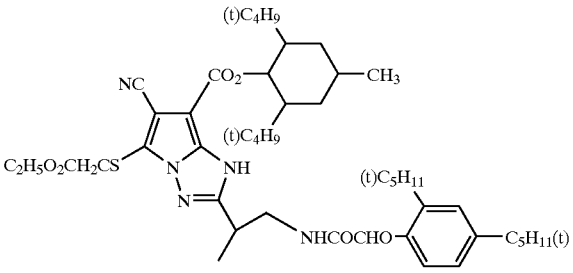
-continued
(38)
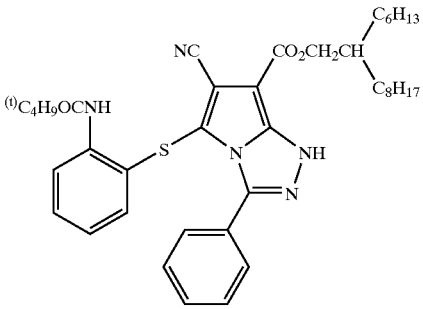
(39)
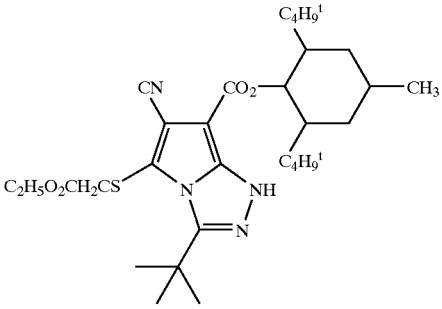
(40)
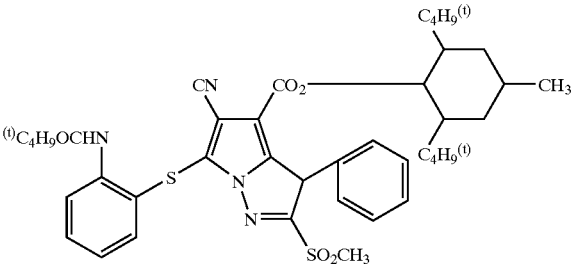
(41)
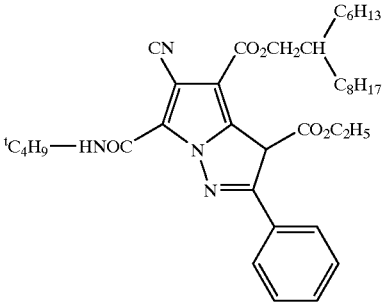

-continued
(42)
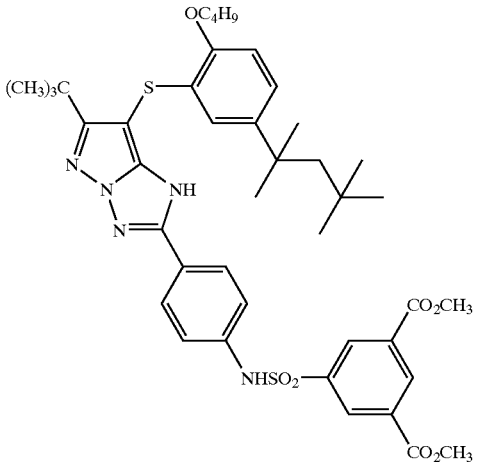
(43)
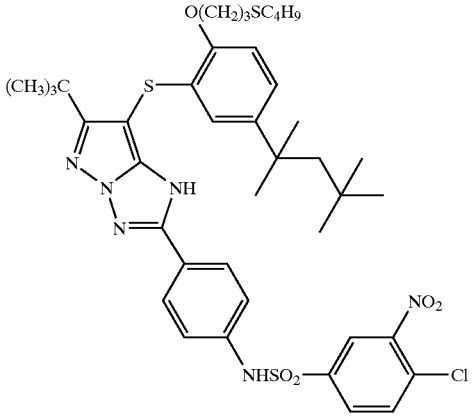
(44)
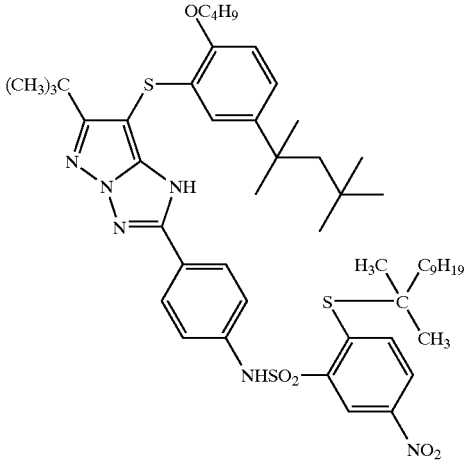
-continued
(45)
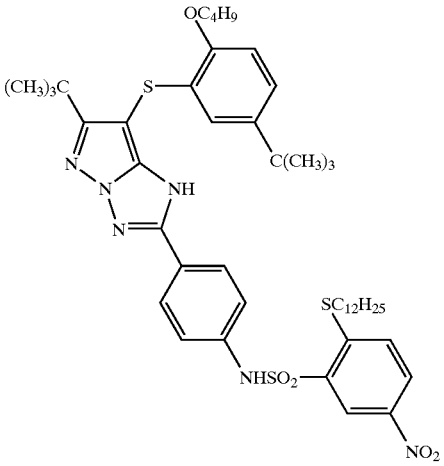
(46)
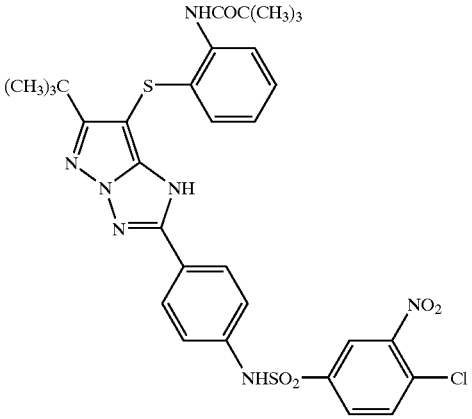
(47)
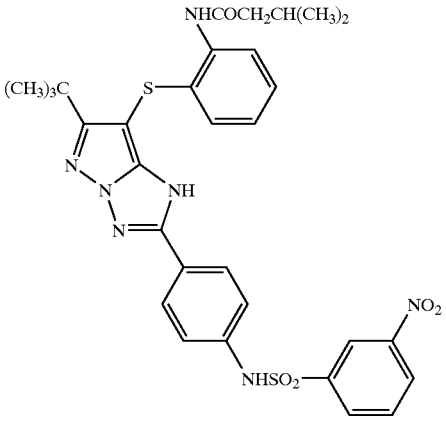

-continued
(48)
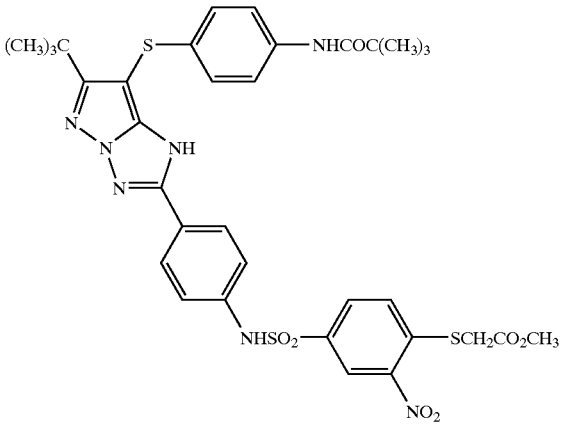
(49)
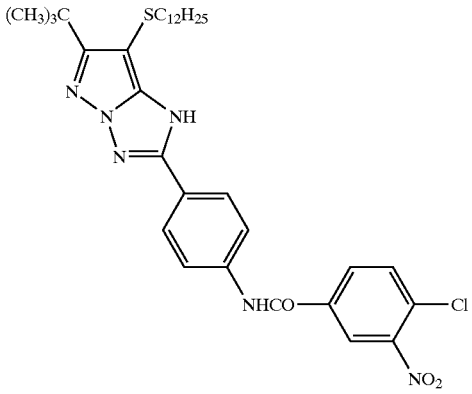
(50)
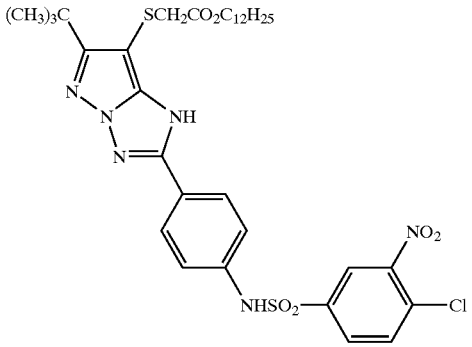
(51)
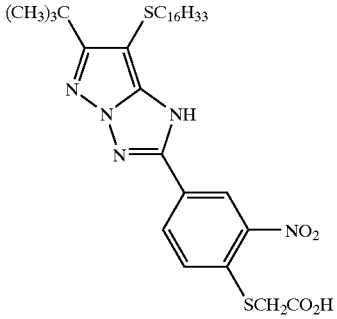
-continued
(52)
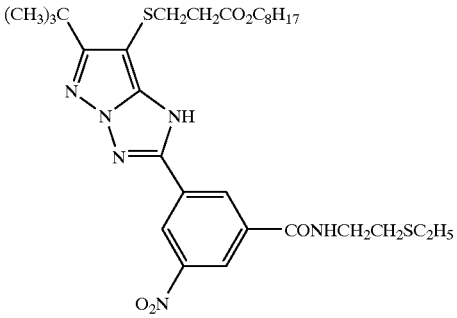
(53)
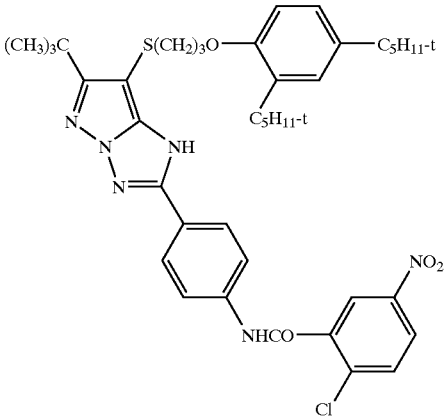
(54)
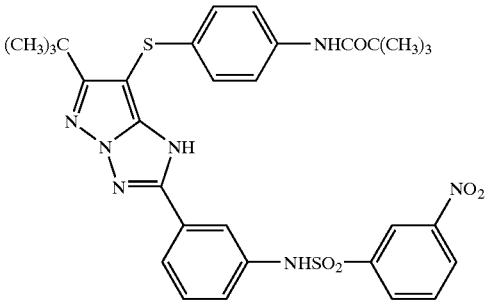
(55)
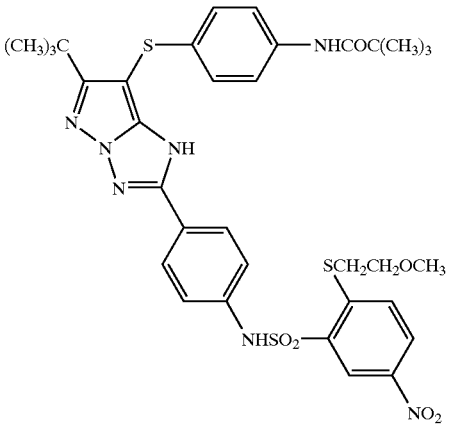

-continued
(56)
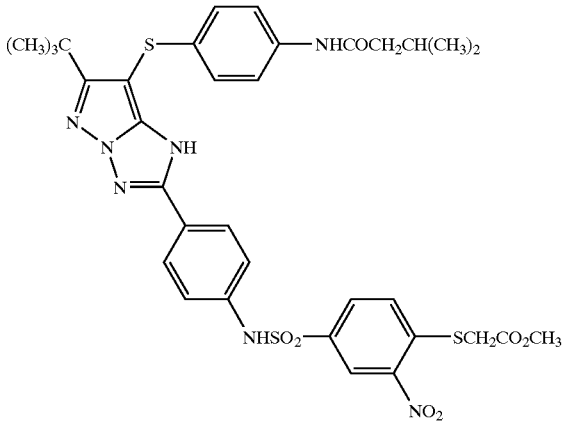
(57)
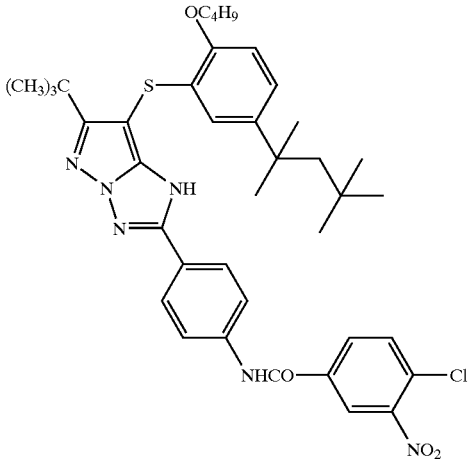
(58)
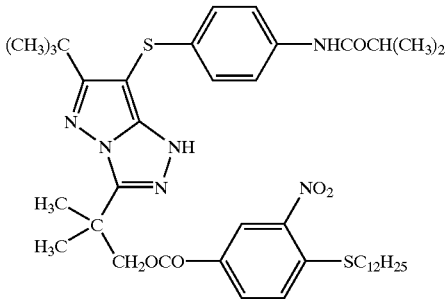
-continued
(59)
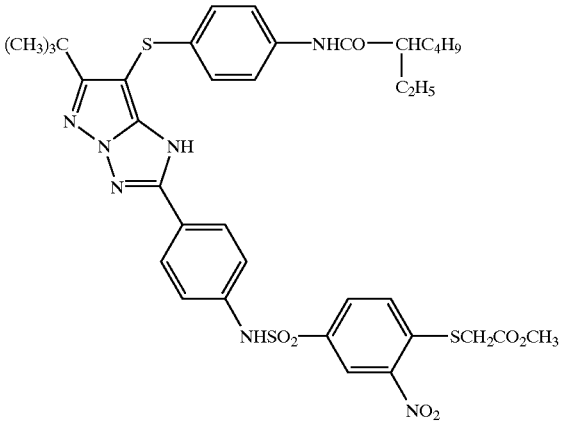
(60)
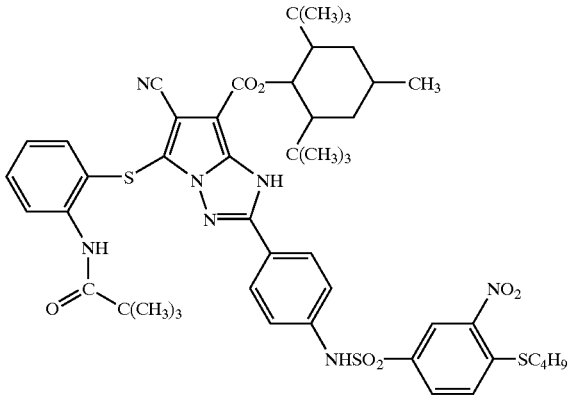
(61)
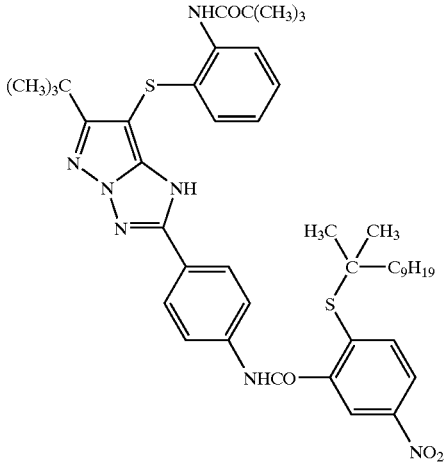

-continued (62)

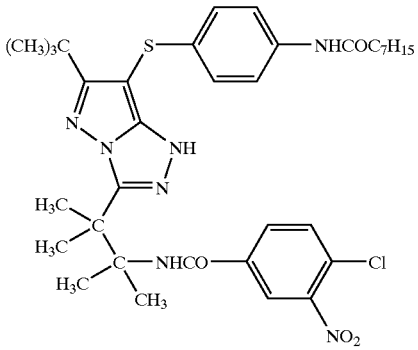

(63)

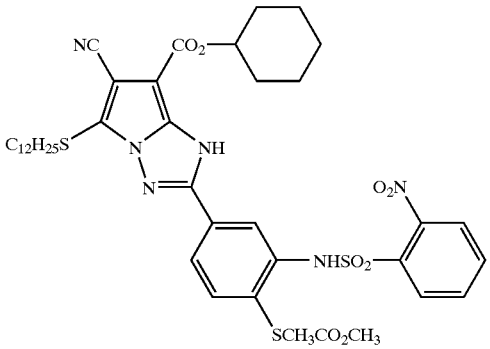

(64)

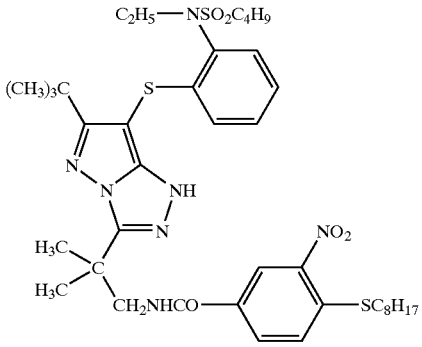

(65)

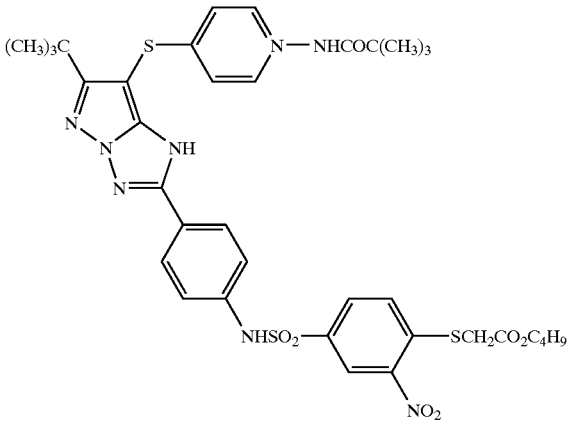

-continued (66)

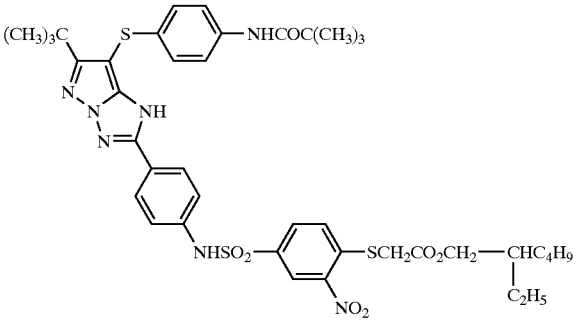

The compound of the present invention can easily be prepared according to the synthesis methods described in JP-A's-61-65245, 61-65246, 61-147254 and 8-122984, etc. The addition amount of the compound represented by general formula (M) or general formula (C) to a photosensitive material is the same as that of compound (B).

The silver halide color photosensitive material of the present invention has, on a support, at least one light-sensitive silver halide emulsion layer and at least one nonlight-sensitive silver halide layer.

In a multilayered silver halide color photosensitive material, unit light-sensitive layers are generally arranged in the order of red-, green- and blue-sensitive layers from a support side. However, according to the intended use, this arrangement order may be reversed, or an arrangement order can be employed in which a different light-sensitive layer is interposed between layers of the same color sensitivity. Non light-sensitive layers can be provided between the silver halide light-sensitive layers and as the uppermost layer and the lowermost layer. These may contain, for example, couplers, DIR compounds and color mixing inhibitors as described later.

The nonlight-sensitive layer containing a compound capable of releasing development inhibitor of the present invention is required to be a colloidal silver-containing layer or a layer adjacent to the colloidal silver-containing layer. Preferably, the nonlight-sensitive layer containing a compound capable of releasing development inhibitor of the present invention is an anti halation layer or a layer adjacent to the anti halation layer, or a yellow filter layer or a layer adjacent to the yellow filter layer. In this case, the anti halation layer is preferably present on the side nearer to a support than a light-sensitive layer that is closest to the support. Further, the yellow filter layer is preferably present between a blue-sensitive layer and a green-sensitive layer. More preferably, the nonlight-sensitive layer containing a compound capable of releasing development inhibitor of the present invention is an anti halation layer or a layer adjacent to the anti halation layer, and most preferably an anti halation layer.

When two or more anti halation layers are present, the anti halation layer that is closer to a light-sensitive layer is more preferable as the nonlight-sensitive layer containing a compound capable of releasing development inhibitor of the present invention.

Although the advantages of the present invention may be attained when the nonlight-sensitive layer containing a compound capable of releasing development inhibitor of the present invention is used between a red-sensitive layer and a green-sensitive layer, the above embodiment is preferable.

With respect to a plurality of silver halide emulsion layers constituting each unit light-sensitive layer, it is preferred that two layers consisting of a high-speed emulsion layer and a low-speed emulsion layer be arranged so that the speed is sequentially decreased toward a support as described in DE 1,121,470 or GB 923,045. Also, as described in JP-A's-57-112751, 62-200350, 62-206541 and 62-206543, layers can be arranged so that a low-speed emulsion layer is formed on a side remote from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), or the order of BH/BL/GL/GH/RH/RL, or the order of BH/BL/GH/GL/RL/RH. or the like.

In addition, as described in JP-B-55-34932, layers can be arranged, from the farthest side from a support, in the order of blue-sensitive layer/GH/RH/GL/RL. Furthermore, as described in JP-A's-56-25738 and 62-63936, layers can be arranged, from the farthest side from a support, in the order of blue-sensitive layer/GL/RL/GH/RH.

As described in JP-B-49-15495, three layers can be arranged so that a silver halide emulsion layer having the highest speed is arranged as an upper layer, a silver halide emulsion layer having a speed lower than that of the upper layer is arranged as an inter layer, and a silver halide emulsion layer having a speed lower than that of the inter layer is arranged as a lower layer; i.e., three layers having different sensitivities can be arranged so that the speed is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in layers of the same color sensitivity as described in JP-A-59-202464.

In addition, the layer arrangement can be made in the order of high-speed emulsion layer/low-speed emulsion layer/medium-speed emulsion layer, or in the order of low-speed emulsion layer/medium-speed emulsion layer/high-speed emulsion layer.

Furthermore, the layer arrangement can be changed as mentioned above even when four or more layers are formed.

It is preferable to utilize an inter layer inhibitory effect as means for improving a color reproduction.

With respect to the silver halide grains for use in interlayer effect-donating layer to a red-sensitive layer, although, for example, the size and configuration thereof are not particularly limited, it is preferred to use so-called tabular grains of high aspect ratio, a monodisperse emulsion having uniform grain size, or silver iodobromide grains having a layer structure of iodide. Further, for expanding an exposure latitude, it is preferred to mix a plurality of emulsions whose grain sizes are different from each other.

Although an inter layer effect-donating layer to a red-sensitive layer may be provided by coating on any position on a support, it is preferred that the interlayer-donating layer be provided by coating at a position which is closer to the support than the blue-sensitive layer and which is more remote from the support than the red-sensitive layer. It is further preferred that the interlayer-donating layer be positioned closer to the support than the yellow filter layer.

It is more preferred that the interlayer effect-donating layer to a red-sensitive layer be provided at a position which is closer to the support than the green-sensitive layer and which is more remote from the support than the red-sensitive layer. The interlayer-donating layer is most preferably arranged at a position adjacent to a side of the green-sensitive layer close to the support. The terminology "adjacent" used herein means that an inter layer or the like is not interposed therebetween.

There may be a plurality of interlayer effect-donating layers to a red-sensitive layer. These layers may be positioned so that they are adjacent to each other or are apart from each other.

In the present invention, use can be made of solid disperse dyes described in JP-A-11-305396.

The emulsions for use in the photosensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose preparation method is described in JP-A-59-133542. The thickness of the shell of this emulsion, although varied depending on development processing, etc., is preferably in the range of 3 to 40 nm, more preferably 5 to 20 nm.

The silver halide emulsions are generally subjected to physical ripening, chemical sensitization and spectral sensitization before use. Additives employed in these steps are described in RD Nos. 17643, 18716 and 307105. Positions where the description is made are listed in the following table.

In the photosensitive material of the present invention, two or more emulsions which are different from each other in at least one of the characteristics, specifically the grain size, grain size distribution, halogen composition, grain configuration and speed of light-sensitive silver halide emulsion, can be mixed together and used in the same layer.

It is preferred that silver halide grains having a grain surface fogged as described in U.S. Pat. No. 4,082,553 and silver halide grains or colloidal silver having a grain internal portion fogged as described in U.S. Pat. No. 4,626,498 and JP-A-59-214852 be used in light-sensitive silver halide emulsion layers and/or substantially nonlight-sensitive hydrophilic colloid layers. The expression "silver halide grains having a grain surface or grain internal portion fogged" refers to silver halide grains which can be developed uniformly (nonimagewise) irrespective of the nonexposed or exposed zone of photosensitive material. The process for producing them is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 $\mu$m, more preferably 0.05 to 0.6 $\mu$m. With respect to the grain configuration, although both regular grains and a polydisperse emulsion can be used, monodispersity (at least 95% of the weight or number of silver halide grains have grain diameters falling within ±40% of the average grain diameter) is preferred.

In the present invention, it is preferred to use nonlight-sensitive fine-grain silver halides. The expression "nonlight-sensitive fine-grain silver halides" refers to silver halide fine grains which are not sensitive to light at the time of imagewise exposure for obtaining dye images and which are substantially not developed at the time of development processing thereof. Those not having been fogged in advance are preferred. The fine-grain silver halides have a silver bromide content of 0 to 100 mol %, and, if necessary, may contain silver chloride and/or silver iodide. Preferably, silver iodide is contained in an amount of 0.5 to 10 mol %. The average grain diameter (average of equivalent circular diameters of projected areas) of fine-grain silver halides is preferably in the range of 0.01 to 0.5 $\mu$m, more preferably 0.02 to 0.2 $\mu$m.

The fine-grain silver halides can be prepared by the same process as used in the preparation of common light-sensitive silver halides. It is not needed to optically sensitize the surface of silver halide grains. Further, any spectral sensitization thereof is also not needed. However, it is preferred to add known stabilizers, such as triazole-type, azaindene-type, benzothiazolium-type and mercapto-type compounds or zinc compounds, thereto prior to the addition of fine-grain silver halides to a coating liquid. Colloidal silver can be incorporated in layers containing fine-grain silver halides.

Various additives mentioned above are used in the photosensitive material regarding the technique of the invention, and other various additives may be used depending on purposes.

The additives are described in detail in Research Disclosure Item 17643 (December 1978), Item 18716 (November 1979) and Item 308119 (December 1989). A summary of the locations where they are described will be listed in the following table.

| Types of additives | RD17643 | RD18716 | RD308119 |
|---|---|---|---|
| 1 Chemical sensitizing dyes | page 23 | page 648 right column | page 996 |
| 2 Sensitivity-increasing agents | | page 648 right column | |
| 3 Spectral sensitizing dye, super-sensitizers | pages 23–24 | page 648, right column to page 649, right column | page 996, right column to page 998, right column |
| 4 Brighteners | page 24 | | page 998 right column |
| 5 Antifoggants, stabilizers | pages 24–25 | page 649 right column | page 998, right column to page 1000, right column |
| 6 Light absorbents, filter dyes, ultraviolet absorbents | pages 25–26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column page 1005, left column |
| 10 Binders | page 26 | page 651, left column | page 1003, right column to page 1004, right column |

-continued

| Types of additives | RD17643 | RD18716 | RD308119 |
|---|---|---|---|
| 11 Plasticizers, lubricants | page 27 | page 650, right column | page 1006, left to right columns |
| 12 Coating aids, surfactants | pages 26–27 | page 650, right column | page 1005, left column to page 1006, left column |
| 13 Antistatic agents | page 27 | page 650, right column | page 1006, right column to page 1007, left column |
| 14 Matting agents | | | page 1008, left column to page 1009, left column |

With respect to the photosensitive material of the present invention and the emulsion suitable for use in the photosensitive material and also with respect to layer arrangement and related techniques, silver halide emulsions, dye forming couplers, DIR couplers and other functional couplers, various additives and development processing which can be used in the photographic photosensitive material, reference can be made to EP 0565096A1 (published on Oct. 13, 1993) and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect-donating layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion preparation methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Non light-sensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc.-releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator-releasing couplers: page 65 lines 49 to 53,
29. Other DIR couplers: page 65 line 54 to page 66 to line 4, 30. Method of dispersing couplers: page 66 lines 5 to 28,
31. Antiseptic and mildewproofing agents: page 66 lines 29 to 33,
32. Types of photosensitive materials: page 66 lines 34 to 36,
33. Thickness of light-sensitive layer and swelling speed: page 66 line 40 to page 67 line 1,
34. Back layers: page 67 lines 3 to 8,
35. Development processing summary: page 67 lines 9 to 11,
36. Developing solutions and developing agents: page 67 lines 12 to 30,
37. Developing solution additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and reuse: page 70 lines 19 to 23,
45. Developing agent built-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter is referred to as "L", and milliliter is referred to as "mL".).

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$.

The saturation magnetization ($\sigma s$) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or 5-81652 can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m.

The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. Nos. 5,336,589, 5,250,404, 5,229,259, and 5,215,874, and EP 466,130.

A polyester support used in the present invention will be described below. Details of the polyester support and sensitive materials, processing, cartridges, and examples (to be described later) are described in Journal of Technical Disclosure No. 94-6023 (JIII; 1994, Mar. 15). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers.

The weight-average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg−20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a sensitive material is preferably 5 to 500 $mg/m^2$, and especially preferably 10 to 350 $mg/m^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid)=9/1 or 5/5 (molar ratio)) grains, and polystyrene grains. The grain size is preferably 0.8 to 10 μm, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid)=9/1 (molar ratio, 0.3 μm) grains, polystyrene grains (0.25 μm), and colloidal silica grains (0.03 μm).

The support used in Example of this specification may be prepared by the method described in Example 1 of JP-A-2001-281815.

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A's-1-312537 and 1-312538. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films used in the present invention can be so-called raw films before being developed or developed photographic films. Also, raw and developed photographic films can be accommodated in the same new cartridge or in different cartridges.

A color photographic photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. These films are so processed as to have an APS format and set in an exclusive cartridge. These APS cartridge films are loaded into APS cameras such as the Fuji Film EPION Series represented by the EPION 300Z. A color light sensitive film of the present invention is also suited as a film-fitted lens such as FUJICOLOR UTSURUNDESU (Quick Snap) SUPER SLIM and UTSURUNNDESU ACE800 produces by Fuji Photo Film Co., Ltd.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 and Fuji Film DIGITALLABO SYSTEM, FRONTIER are preferable. Examples of a film processor for the MINILABO CHAMPION are the FP922AL/FP562B/FP562B, AL/FP362B/FP362BL AL and a recommended processing chemical is the FUJICOLOR JUST-IT CN-16L and CN-16Q. Examples of a printer processor are the PP3008AR/PP3008A/PP1828AR/PP1828A/PP1258AR/PP1258A/PP728AR/PP728A, and a recommended processing chemical is the FUJICOLOR JUST-IT CP-47L and CP-40FAII.

In the FRONTIER SYSTEM, SCANNER & IMAGE-PROCESSOR SP-1000 and LASER PRINTER & PAPER PROCESSOR LP-1000P, or LASER PRINTER LP-1000W are used. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLE

Examples of the present invention will be described below, which, however, in no way limit the scope of the present invention.

Example 1

Silver halide emulsion Em-A was prepared according to the following method.

(Em-A)

42.2 L of an aqueous solution containing 36.7 g of a low-molecular-weight gelatin of 15,000 molecular weight and converted to phthalate at a phthalation ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, and 2485 mL of an aqueous solution containing 398.2 g of $AgNO_3$ and 2581 mL of an aqueous solution containing 291.1 g of KBr were added by the double jet method over 2 min. Immediately after the addition, 47.8 g of KBr was added. Then, the temperature was raised to 43° C., and the mixture was ripened. After the completion of the ripening, 923 g of a gelatin of 100,000 molecular weight converted to phthalate at a phthalation ratio of 97% and 79.2 g of KBr were added, and an aqueous solution of KBr and 15947 mL of an aqueous solution containing 5,103 g of $AgNO_3$ were added by the double jet method over a period of 12 min while increasing the flow rate so that the final flow rate was 1.4 times the initial flow rate. During this period, the silver potential was maintained at −60 mV against saturated calomel electrode. After the mixture was washed with water, gelatin was added, and the pH, pAg, weight of the emulsion per kg thereof, in terms of silver, and gelatin weight were adjusted to 5.7, 8.8, 131.8 g and 64.1 g, respectively, thereby to prepare a seed emulsion.

1211 mL of an aqueous solution containing 46 g of a gelatin converted to phthalate at a phthalation ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate and 2 mg of thiourea dioxide were added, an aqueous solution containing 144.5 g of $AgNO_3$ and 410 mL of a mixed aqueous solution of KBr and KI containing 7 mol % of KI were added by the double jet method over a period of 56 min while increasing the flow rate so that the final flow rate was 3.7 times the initial flow rate. During this period the silver potential was maintained at −45 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode. The mixture was heated to 82° C., and KBr was added to thereby adjust the silver potential to −80 mV. Thereafter, an AgI fine grain emulsion of 0.037 mm grain size was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr. The mixture was washed with water, and gelatin was added, adjusting the pH and pAg thereof at 40° C. to 5.8 and 8.7, respectively. The gelatin contains components having a molecular weight of 280,000 or more, which was measured according to PAGI method, in an amount of 30%. After compounds 11 and 12 were added, the temperature was raised to 60° C. Then, sensitizing dyes 11 and 12 were added, and potassium thiocyanate, chloroauric acid, sodium thiosulfate and N,N-dimethylselenourea were added to thereby effect optimum chemical sensitization. At the completion of chemical sensitization, Compounds 13 and 14 were added. The terminology "optimum chemical sensitization" used herein means that the addition amount of sensitizing dye or each compound has been selected so as to fall within the range of $10^{-1}$ to $10^{-8}$ mol per mol of silver halide.

Compound 11

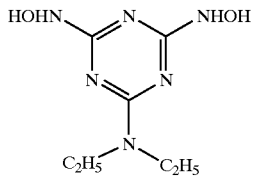

Compound 12

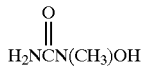

Sensitizing dye 11

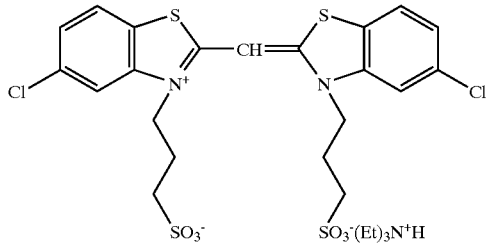

Sensitizing dye 12

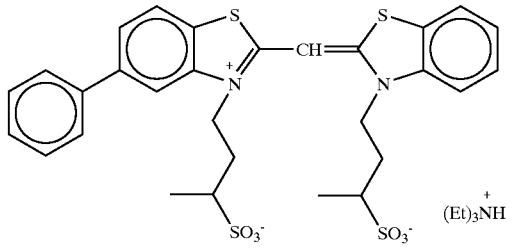

Compound 13

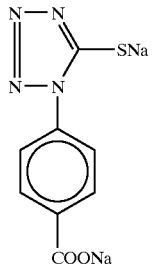

Compound 14

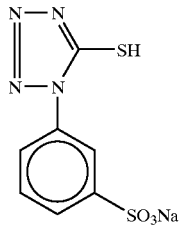

The thus obtained grains were observed with transmission electron microscope while cooling with liquid nitrogen. As a result, 10 or more dislocation lines per grain were observed at the peripheral portion of thereof.

(Em-B) (Emulsion for Low-Speed Blue-Sensitive Layer)

1,192 mL of an aqueous solution containing 0.96 g of low-molecular weight gelatin and 0.9 g of KBr were vigorously stirred at 40° C. 37.5 mL of an aqueous solution containing 1.49 g of $AgNO_3$ and 37.5 mL of an aqueous solution containing 1.5 g of KBr were added over 30 sec by the double jet method. After 1.2 g of KBr was added, the temperature was raised to 75° C. to ripen the material. After the through ripening, 30 g of trimellitated gelatin whose amino groups were chemically modified with trimellitic acid and having a molecular weight of 100,000 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was maintained at −20 mV against saturated calomel electrode. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 15.8 mol %. At the same time, the silver potential was maintained at 0 mV against saturated calomel electrode. 96.5 mL of an aqueous solution containing 24.1 g of $AgNO_3$ and an aqueous KBr solution were added by the double jet method over 3 min. During the addition, the silver potential was maintained at 0 mV. After 26 mg of sodium ethylthiosulfonate were added, the temperature was decreased to 55° C., an aqueous KBr solution was added to adjust the silver potential at −90 m. The aforementioned AgI fine grain emulsion was added in an amount of 8.5 g in terms of a KI weight. Immediately after the completion of the addition, 228 mL of an aqueous solution containing 57 g of $AgNO_3$ were added over 5 min. The addition of the KBr solution was so adjusted that the silver potential at the completion of the addition was +20 mV. Washing with water and chemical sensitization were performed in almost the same manner as in Em-A.

(Em-C) (An Emulsion for a Low-Speed Blue-Sensitive Layer)

1,192 mL of an aqueous solution containing 1.02 g of phthalated gelatin with a phthalation ratio of 97%, containing 35 mmol of methionine per gram and having a molecular weight of 100,000, and 0.97 g of KBr was vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 66° C. to throughly ripen the material. After the completion of the ripening, 41.2 g of trimellitated gelatin having a molecular weight of 100,000, which was used in the preparation of Em-B, and 18.5 g of NaCl were added, and the pH was adjusted to 7.2, and 8 mg of dimethylamineborane was added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential was maintained at −30 mV against saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 2.3 mol %. At the same time, the silver potential was maintained at −20 mV against saturated calomel electrode. After 10.7 mL of 1N potassium thiocyanate solution was added, 153.5 mL of an aqueous solution containing 24.1 g of $AgNO_3$ and an aqueous KBr solution were added by the double jet method over 2 min 30 sec. During the addition, the silver potential was maintained at 10 mV. The addition of KBr solution controlled the silver potential at −70 mV. The aforementioned AgI fine grain emulsion was added in an amount of 6.4 g in terms of a KI weight. Immediately after the addition, 404 mL of an aqueous solution containing 57 g of $AgNO_3$ were added over 45 min. The addition of the KBr solution was so adjusted that the silver potential at the completion of the addition was −30 mV. Washing with water and chemical sensitization were performed in almost the same manner as in Em-A.

(Em-D) (Emulsion for Low-Speed Blue-Sensitive Emulsion Layer)

In the preparation of Em-C, the addition amount of $AgNO_3$ during nucleation was changed to 2.0 times. Then, the potential at the completion of the final addition of 404 mL of aqueous solution containing 57 g of $AgNO_3$ was changed to +90 mV by the KBr solution. Emulsion Em-D was prepared in almost the similar manner as in Em-C, except for the above mentioned changes.

(Em-E) (Emulsion for a Magenta-Coloring Layer Having its Peak of Spectral Sensitivity at 480–550 nm) (A Interlayer Effect-Donating Layer to a Red-Sensitive Layer)

1,200 mL of an aqueous solution containing 0.71 g of low-molecular weight gelatin having a molecular weight of 15,000, 0.92 g of KBr and 0.2 g of the modified silicone oil used in the preparation of Em-A were held at 39° C. and stirred vigorously at pH 1.8. An aqueous solution containing 0.45 g of $AgNO_3$ and an aqueous KBr solution containing 1.5 mol % of KI were added over 17 sec by the double jet method. During the addition, the excess KBr concentration was held constant. The temperature was raised to 56° C. to ripen the material. After the through ripening, 20 g of phthalated gelatin with a phthalation ratio of 97%, containing 35 mmol of methionine per gram and having a molecular weight of 100,000 were added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, an AgI fine grains used in the preparation of Em-A was added so that the silver iodide content became 4.1 mol %. At the same time, the silver potential was maintained at −60 mV against saturated calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, the aforementioned AgI fine grain emulsion was simultaneously added at an accelerated flow rate such that the silver iodide content was 10.5 mol %. At the same time, the silver potential was maintained at −70 mV. After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the silver potential was maintained at +20 mV. After 2 mg of sodium benzenethiosulfonate was added, the pH was adjusted to 7.3. KBr was added to adjust the silver potential at −70 mV, then, the aforementioned AgI fine grain emulsion was added in an amount of 5.73 g in terms of a KI weight. Immediately after the completion of the addition, 609 mL of an aqueous solution containing 66.4 g of $AgNO_3$ were added over 10 min. For the first 6 min of the addition, the silver potential was maintained at −70 mV. After the resultant emulsion was washed with water, gelatin was added and the pH and pAg were adjusted to 6.5 and 8.2, respectively. After compounds 11 and 12 were added, the temperature was raised to 56° C. After 0.004 mol of the aforementioned AgI fine grain emulsion per mol of silver was added, chemical sensitizing dyes 13 and 14 were added. Optimal chemical sensitization was performed by adding potassium thiocyanate, chlorauric acid, sodium thiosulphate and N,N-dimethylselenourea. At the completion of the chemical sensitization, compounds 13 and 14 were added.

Sensitizing dye 13

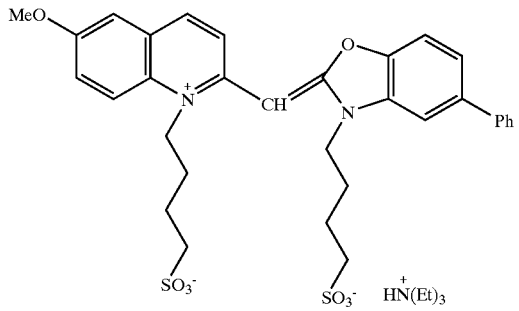

Sensitizing dye 14

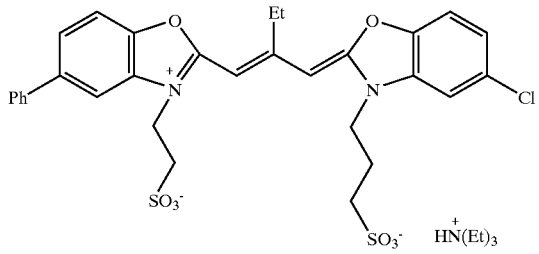

(Em-F) (Emulsion for Medium-Speed Green-Sensitive Layer)

Emulsion Em-F was prepared in almost the similar manner as in Em-E, except that in the preparation of Em-E, the addition amount of $AgNO_3$ during nucleation was changed to 3.1 times. Provided that the sensitizing dyes of Em-E were changed to sensitizing dyes 15, 16 and 17.

Sensitizing dye 15

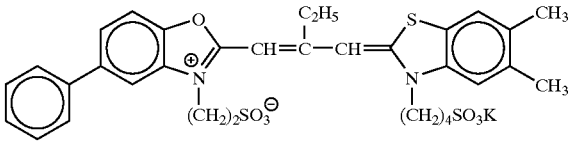

Sensitizing dye 16

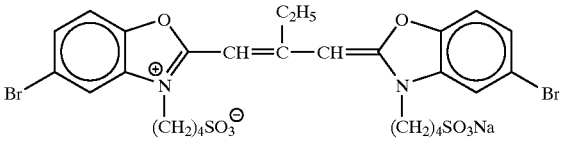

Sensitizing dye 17

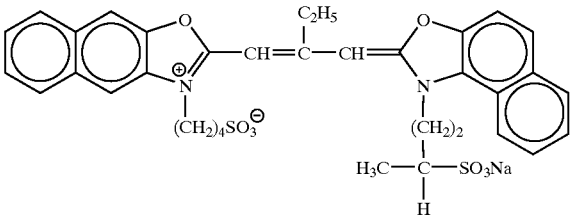

(Em-G) (Emulsion for a Low-Speed Emulsion Layer)

1,200 mL of an aqueous solution containing 0.70 g of low-molecular weight gelatin having a molecular weight of 15,000, 0.9 g of KBr, and 0.175 g of the modified silicone oil used in the preparation of Em-A was held at 33° C. and stirred vigorously at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 69° C. to ripen the material. After the completion of the ripening, 27.8 g of trimellitated gelatin whose amino groups were chemically modified with trimellitic acid and containing, 35 mmol of methionine per gram and having a molecular weight of 100,000 were added. After the pH was adjusted to 6.3, 2.9 g of KBr were added. 270 mL of an aqueous solution containing 27.58 g of $AgNO_3$ and 270 mL of an aqueous KBr solution were added over 37 min by the double jet method. During the addition, an AgI fine grains having grain size of 0.008 mm was added simultaneously so that the silver iodide content became 4.1 mol %, and the silver potential was maintained at −60 mV against saturated calomel electrode. The AgI fine grains were prepared by mixing low-molecular weight gelatin having a molecular weight of 15,000, an aqueous $AgNO_3$ solution and an aqueous KI solution in a separate chamber having an agitator of magnetic coupling induced type described in JP-A-10-43570, just before the addition of the thus prepared emulsion. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion that was prepared by mixing just before the addition thereof was simultaneously added at an accelerated flow rate such that the silver iodide content was 7.9 mol %. At the same time, the silver potential was maintained at −70 mV. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the silver potential at the termination of the addition was maintained at +20 mV. The temperature was raised to 78° C., and the pH of adjusted to 9.1, and then the potential was adjusted to −60 mV by the addition of KBr. The AgI fine grain emulsion used of the preparation of Em-A was added in an amount of 5.73 g in terms of a KI weight. Immediately after the completion of the addition, 321 mL of an aqueous solution containing 66.4 g of $AgNO_3$ were added over 4 min. For the first 2 min of the addition, the silver potential was maintained at −60 mV. After the resultant emulsion was washed with water and chemically sensitized in almost the same manner as in Em-F.

(Em-H) (Emulsion for a Low-Speed Green-Sensitive Layer)

An aqueous solution containing 17.8 g of ion-exchanged gelatin having a molecular weight of 10,0000, 6.2 g of KBr and 0.46 g of KI was held at 45° C. and stirred vigorously. An aqueous solution containing 11.85 g of $AgNO_3$ and an aqueous solution containing 3.8 g of KBr were added over 47 sec by the double jet method. After the temperature was raised to 63° C., 24.1 g of ion-exchanged gelatin having a molecular weight of 100,000 was added, and ripened. After the through ripening, an aqueous solution containing 133.4 g of $AgNO_3$ and an aqueous KBr solution were added over 20 min by the double jet method so that the final flow rate was 2.6 times the initial flow rate. During the addition, the silver potential was maintained at +40 mV against saturated calomel electrode. And 0.1 mg of $K_2IrCl_6$ was added at 10 min after the initiation of the addition. After 7 g of NaCl was added, an aqueous solution containing 45.6 g of $AgNO_3$ and an aqueous KBr solution were added over 12 min by the double jet method. During this, the silver potential was maintained at +90 mV. Further, 100 mL of an aqueous solution containing 29 mg of yellow prussiate was added over 6 min from the initiation of the addition. After 14.4 g of KBr were added, 6.3 g of the AgI fine grain emulsion used in the preparation of Em-A were added. Immediately after the completion of the addition, an aqueous solution containing 42.7 g of $AgNO_3$ and a KBr aqueous solution were added over 11 min by the double jet method. The silver potential during the addition was maintained at +90 mV. The emulsion was washed with water and chemically sensitized in almost the similar manner as in Em-F.

(Em-I) (Emulsion for Low-Speed Green-Sensitive Layer)

Em-I was prepared in almost the same manner as in Em-H, except that the temperature during the nucleation was changed to 38° C.

(Em-J) (Emulsion for a High-Speed Red-Sensitive Layer)

1,200 mL of an aqueous solution containing 0.38 g of phthalated gelatin whose phthalation ration is 97% and whose molecular weight is 100,000, and 0.99 g of KBr was held at 60° C. and stirred vigorously at pH 2. An aqueous solution containing 1.96 g of $AgNO_3$ and an aqueous solution containing 1.97 g of KBr and 0.172 g of KI were added over 30 sec by the double jet method. After the completion of the ripening, 12.8 g of trimellitated gelatin whose amino groups were chemically modified with trimellitic acid and having, 35 mmol of methionine per gram and having a molecular weight of 100,000 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 35 min by the double jet method. During the addition, the silver potential was maintained at −50 mV against saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion used in the preparation of Em-A was simultaneously added in an accelerated flow rate such that the silver iodide content was 6.5 mol %, and the silver potential was maintained at −50 mV. After 1.5 mg of sodium thiourea dioxide was added, 132 mL of an aqueous solution containing 41.8 g of $AgNO_3$ and a KBr solution were added over 13 min by the double jet method. The addition of the KBr solution was so adjusted that the silver potential at the completion of the addition was +40 mV. After 2 mg of sodium benzenethiosulfonate was added, KBr was added to adjust the silver potential at −100 mV. 6.2 g, in terms of KI weight, of the aforementioned AgI fine grain emulsion was added. Immediately after the completion of the addition, 300 mL of an aqueous solution containing 88.5 g of $AgNO_3$ was added over a period of 8 min. The addition of the KBr solution was so adjusted that the potential was +60 mV. After washing with water, gelatin was added and adjusted the pH and pAg at 40° C. to 6.5 and 8.2, respectively. After compounds 11 and 12 were added, the temperature was raised to 61° C. After sensitizing dyes 18, 19, 20 and 21 were added, $K_2IrCl_6$, potassium thiocyanate, chloroauric acid, sodium thiosulphate and N,N-dimethylselenourea were added to optimally sensitize the emulsion. At the termination of the chemical sensitization, compounds 13 and 14 were added.

Sensitizing dye 18

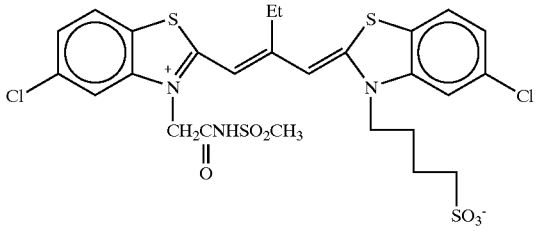

Sensitizing dye 19

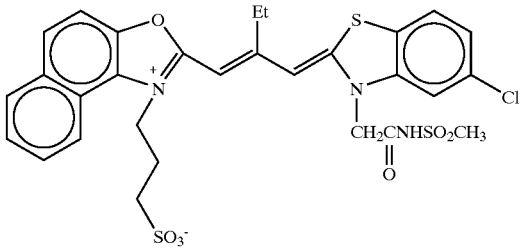

Sensitizing dye 20

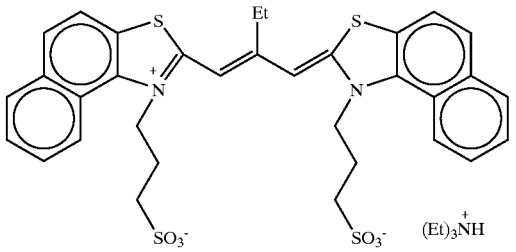

Sensitizing dye 21

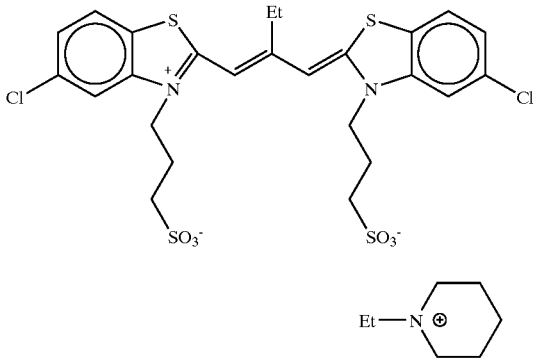

(Em-K) (Emulsion for a Medium-Speed Red-Sensitive Emulsion Layer)

1,200 mL of an aqueous solution containing 4.9 g of low-molecular weight gelatin having a molecular weight of 15,000, and 5.3 g of KBr was held at 60° C. and stirred vigorously. 27 mL of an aqueous solution containing 8.75 g of $AgNO_3$ and 36 mL of an aqueous solution containing 6.45 g of KBr were added over 1 min by the double jet method. After the temperature was raised to 77° C., 21 mL of an aqueous solution containing 6.9 g of $AgNO_3$ was added over 2.5 min. 26 g of $NH_4NO_3$, 56 mL of 1N NaOH were added subsequently, and then ripened. After the completion of the ripening, pH was adjusted to 4.8. 438 mL of an aqueous solution containing 141 g of $AgNO_3$ and 458 mL of an aqueous solution containing 102.6 g of KBr were added by the double jet method while the flow rate was accelerated so that the final flow rate was 4 times the initial flow rate. After the temperature was raised to 55° C., 240 mL of an aqueous solution containing 7.1 g of $AgNO_3$ and an aqueous solution containing 6.46 g of KI were added by the double jet method over 5 min. After 7.1 g of KBr were added, 4 mg of sodium benzenethiosulphonate and 0.05 mg of $K_2KrCl_6$ were added. 177 mL of an aqueous solution containing 57.2 g of $AgNO_3$ and 223 mL of an aqueous solution containing 40.2 g of KBr were added over 8 min by the double jet method. Washing with water and chemical sensitization were performed in almost the same manner as in Em-J.

(Em-L) (Emulsion for a Medium-Speed Red-Sensitive Layer)

Emulsion Em-L was prepared in almost the same manner as in Em-K, except that the temperature during the nucleation was changed to 42° C.

(Em-M, Em-N and Em-O)

Em-M, Em-N and Em-O were prepared in almost the same manner as in Em-H or Em-I, except that the chemical sensitization was performed in almost the same manner ass in Em-J.

(Em-P) (Emulsion for a High-Speed Green-Sensitive Layer)

Em-P was prepared in the same manner as in Em-P, except that the spectral sensitizing dyes were changed to sensitizing dyes 15, 16 and 17, thereby performing an optimal chemical sensitization.

The characteristics of the thus obtained silver halide emulsions Em-A to Em-P are shown in Table 1.

TABLE 1

Grain characteristics of silver halide emulsions Em-A to Em-P

| Emulsion No. | Equivalent sphere diameter μm | Equivalent circle diameter μm | Aspect ratio | Iodide content mol % | Plane index of main plane | Cl content mol % |
|---|---|---|---|---|---|---|
| Em-A | 1.9 | 3.65 | 10.5 | 6.1 | (111) | 0 |
| Em-B | 1.0 | 2.0 | 12.2 | 10.0 | (1ll) | 0 |
| Em-C | 0.7 | — | 1 | 4.0 | (111) | 1.0 |
| Em-D | 0.4 | 0.53 | 3.5 | 4.1 | (111) | 2.0 |
| Em-E | 1.1 | 2.63 | 20.6 | 6.7 | (111) | 0 |
| Em-F | 1.2 | 2.74 | 18 | 6.9 | (111) | 0 |
| Em-G | 0.9 | 1.98 | 15.9 | 6.1 | (111) | 0 |
| Em-H | 0.7 | 1.22 | 8 | 6.0 | (111) | 2.0 |
| Em-I | 0.4 | 0.63 | 6 | 6.0 | (111) | 2.0 |
| Em-J | 1.3 | 3.18 | 22 | 3.5 | (111) | 0 |
| Em-K | 1.0 | 2.37 | 20 | 4.0 | (111) | 0 |
| Em-L | 0.8 | 1.86 | 19 | 3.6 | (111) | 0 |
| Em-M | 0.6 | 1.09 | 8.9 | 2.9 | (111) | 2.0 |
| Em-N | 0.4 | 0.63 | 6 | 2.0 | (111) | 2.0 |
| Em-O | 0.3 | 0.38 | 3 | 1.0 | (111) | 2.0 |
| Em-P | 1.3 | 3.18 | 22 | 3.5 | (111) | 0 |

Also, summary of formulation of the emulsified product of the invention is set forth below.

An ethyl acetate solution into which a coupler is dissolved, a high-boiling solvent, and a surfactant were added to a 10% gelatin solution, and mixed the solution using a homogenizer (manufactured by NIHONSEIKI), thereby emulsify and obtaining an emulsified product.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/$m^2$, by using a bar coater) consisting of 0.1 g/$m^2$ of gelatin, 0.01 g/$m^2$ of sodium α-sulfodi-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/$m^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree 10), and resorcin.

3-2) Coating of Magnetic Recording Layer

A bar coater was used to coat the surface with 0.06 g/$m^2$ of cobalt-γ-iron oxide (specific area 43 $m^2$/g, major axis 0.14 μm, minor axis 0.03 μm, saturation magnetization 89 $Am^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/$m^2$ of diacetylcellulose (iron oxide was dispersed by an open kneader and sand mill), by using 0.3 g/$m^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/$m^2$ of silica grains (0.3 μm) were added as a matting agent, and 10 mg/$m^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 $Am^2$/kg, $7.3\times10^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly (polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

Next, the surface of the support on the side away from the back layers formed as above was multi-coated with a plurality of layers having the following compositions to form a sample of a color negative photographic material.

(Compositions of Sensitive Layers)

The main ingredients used in the individual layers are classified as follows, however, the use thereof are not limited to those specified below.

ExC: Cyan coupler UV: Ultraviolet absorbent
ExM: Magenta coupler HBS: High-boiling organic solvent
ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| **First layer (First antihalation layer)** | | |
| Black colloidal silver | silver | 0.150 |
| Surface-fogged AgBrI (2) of 0.07 μm | silver | 0.01 |
| Gelatin | | 0.90 |
| ExC-1 | | 0.002 |
| ExC-3 | | 0.002 |
| Cpd-2 | | 0.001 |
| HBS-1 | | 0.004 |
| HBS-2 | | 0.002 |
| **Second layer (Second antihalation layer)** | | |
| Black colloidal silver | silver | 0.069 |
| Gelatin | | 0.400 |
| ExM-1 | | 0.055 |
| ExF-1 | | $2.0 \times 10^{-3}$ |
| HBS-1 | | 0.079 |
| Solid disperse dye ExF-2 | | 0.018 |
| Solid disperse dye ExF-3 | | 0.024 |
| **Third layer (Inter layer)** | | |
| AgBrI (2) of 0.07 μm | | 0.020 |
| ExC-2 | | 0.022 |
| Cpd-1 | | 0.050 |

-continued

| | | |
|---|---|---|
| UV-1 | | 0.06 |
| UV-2 | | 0.04 |
| UV-3 | | 0.06 |
| UV-4 | | 0.008 |
| Polyethylacrylate latex | | 0.085 |
| HBS-1 | | 0.500 |
| HBS-4 | | 0.500 |
| Gelatin | | 0.354 |
| **Fourth layer (Low-speed red-sensitive emulsion layer)** | | |
| Em-M | silver | 0.060 |
| Em-N | silver | 0.105 |
| Em-O | silver | 0.156 |
| ExC-1 | | 0.111 |
| ExC-3 | | 0.047 |
| ExC-4 | | 0.079 |
| ExC-5 | | 0.013 |
| ExC-6 | | 0.005 |
| ExC-8 | | 0.020 |
| Cpd-2 | | 0.025 |
| Cpd-4 | | 0.025 |
| HBS-1 | | 0.17 |
| Gelatin | | 0.84 |
| **Fifth layer (Medium-speed red-sensitive emulsion layer)** | | |
| Em-K | silver | 0.24 |
| Em-L | silver | 0.65 |
| ExC-1 | | 0.18 |
| ExC-2 | | 0.024 |
| ExC-3 | | 0.020 |
| ExC-4 | | 0.14 |
| ExC-5 | | 0.016 |
| ExC-6 | | 0.009 |
| ExC-8 | | 0.035 |
| Cpd-2 | | 0.036 |
| Cpd-4 | | 0.028 |
| HBS-1 | | 0.19 |
| Gelatin | | 1.23 |
| **Sixth layer (High-speed red-sensitive emulsion layer)** | | |
| Em-J | silver | 1.60 |
| ExC-1 | | 0.19 |
| ExC-3 | | 0.09 |
| ExC-6 | | 0.049 |
| ExC-8 | | 0.040 |
| Cpd-2 | | 0.043 |
| Cpd-4 | | 0.077 |
| HBS-1 | | 0.25 |
| HBS-2 | | 0.12 |
| Gelatin | | 2.00 |
| **Seventh layer (Inter layer)** | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| **Eighth layer (Interlayer effect-donating layer (Layer to donate interlayer effect to red-sensitive layer)** | | |
| Em-E | silver | 0.510 |
| Cpd-4 | | 0.030 |
| ExM-2 | | 0.090 |
| ExM-3 | | 0.033 |
| ExY-1 | | 0.033 |
| ExG-1 | | 0.007 |
| ExC-8 | | 0.005 |
| HBS-1 | | 0.089 |
| HBS-3 | | 0.004 |
| Gelatin | | 0.55 |
| **Ninth layer (Low-speed green-sensitive emulsion layer)** | | |
| Em-G | silver | 0.36 |
| Em-H | silver | 0.24 |
| Em-I | silver | 0.32 |
| ExM-2 | | 0.37 |
| ExM-3 | | 0.043 |
| ExG-1 | | 0.005 |
| ExC-8 | | 0.005 |

-continued

| | | |
|---|---|---|
| HBS-1 | | 0.28 |
| HBS-3 | | 0.01 |
| HBS-4 | | 0.27 |
| Gelatin | | 1.30 |
| Tenth layer (Medium-speed green-sensitive emulsion layer) | | |
| Em-F | silver | 0.24 |
| Em-G | silver | 0.20 |
| ExC-6 | | 0.011 |
| ExM-2 | | 0.031 |
| ExM-3 | | 0.026 |
| ExY-1 | | 0.005 |
| ExM-4 | | 0.028 |
| ExG-1 | | 0.005 |
| ExC-8 | | 0.010 |
| HBS-1 | | 0.064 |
| HBS-3 | | $2.1 \times 10^{-3}$ |
| Gelatin | | 0.43 |
| Eleventh layer (High-speed green-sensitive emulsion layer) | | |
| Em-P | silver | 1.100 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| ExC-8 | | 0.010 |
| Cpd-4 | | 0.007 |
| HBS-1 | | 0.18 |
| Polyethylacrylate latex | | 0.099 |
| Gelatin | | 1.11 |
| Twelfth layer (Yellow filter layer) | | |
| Yellow colloidal silver | silver | 0.047 |
| Cpd-1 | | 0.16 |
| Solid disperse dye ExF-5 | | 0.010 |
| Solid disperse dye ExF-6 | | 0.010 |
| HBS-1 | | 0.082 |
| Gelatin | | 1.057 |
| Thirteenth layer (Low-speed blue-sensitive emulsion layer) | | |
| Em-B | silver | 0.19 |
| Em-C | silver | 0.23 |
| Em-D | silver | 0.05 |
| ExC-1 | | 0.045 |
| ExC-8 | | 0.010 |
| ExY-1 | | 0.032 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.26 |
| Gelatin | | 1.47 |
| Fourteenth layer (High-speed blue-sensitive emulsion layer) | | |
| Em-A | silver | 0.85 |
| ExC-1 | | 0.016 |
| ExC-8 | | 0.010 |
| ExY-2 | | 0.30 |
| ExY-3 | | 0.05 |
| ExY-6 | | 0.065 |
| Cpd-2 | | 0.075 |
| Cpd-3 | | $1.0 \times 10^{-3}$ |
| HBS-1 | | 0.12 |
| Gelatin | | 0.98 |
| Fifteenth layer (First protective layer) | | |
| AgBrI (2) of 0.07 mm | silver | 0.30 |
| UV-1 | | 0.21 |
| UV-2 | | 0.13 |
| UV-3 | | 0.20 |
| UV-4 | | 0.025 |

-continued

| | |
|---|---|
| F-18 | 0.009 |
| F-19 | 0.005 |
| HBS-1 | 0.12 |
| HBS-4 | $5.0 \times 10^{-2}$ |
| Gelatin | 3.0 |
| Sixteenth layer (Second protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained B-4 to B-6, F-1 to F-18, iron salt, lead salt, gold salt, platinum salt, palladium salt, iridium salt, ruthenium salt and rhodium salt. Also in the coating liquids for the eighth and the eleventh layers, $8.5\times10^{-3}$ g and $7.9\times10^{-3}$ g, respectively, per mole of silver halide of calcium was added in the form of calcium nitrate, thereby preparing samples. In addition, at least one of W-1, W-6, W-7 and W-8 was added in order to improve anti-electron static property, and at least one of W-2 and W-5 was added in order to improve coating property.

Preparation of dispersions of organic solid disperse dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of these fine dye grains was 0.45 μm. ExF-2 was dispersed by a micro-precipitation dispersion method described in Example 1 of EP549,489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1
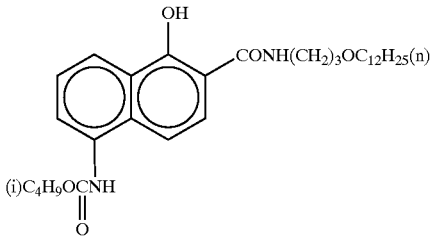
ExC-2
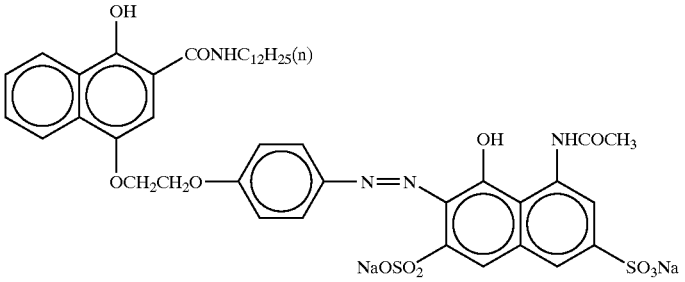
ExC-3
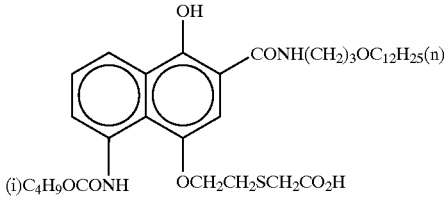
ExC-4
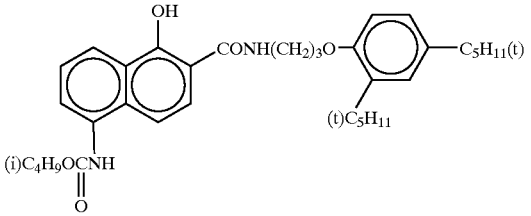
Exc-5
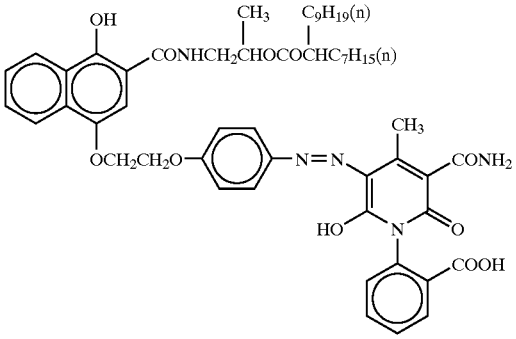
ExC-6
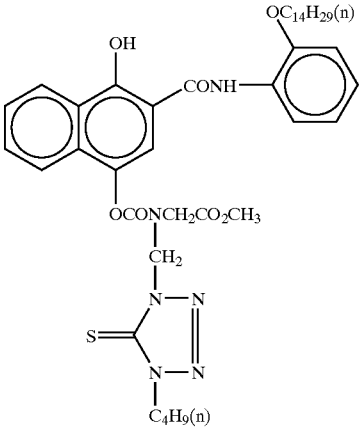
ExC-8
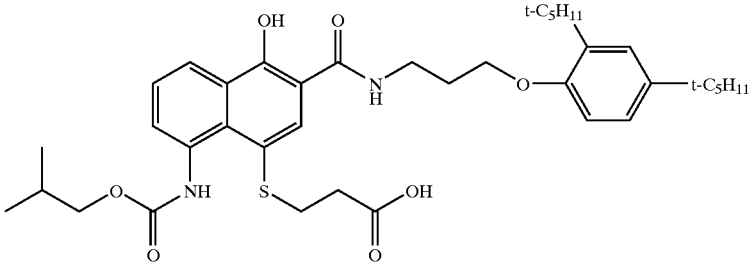

-continued
ExM-1
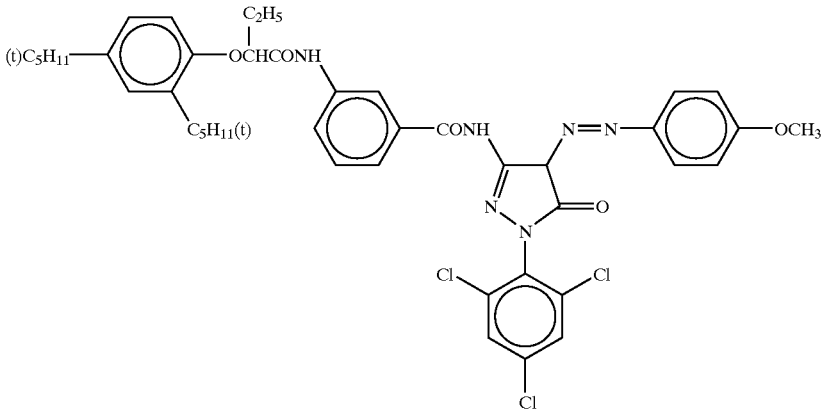
ExM-2
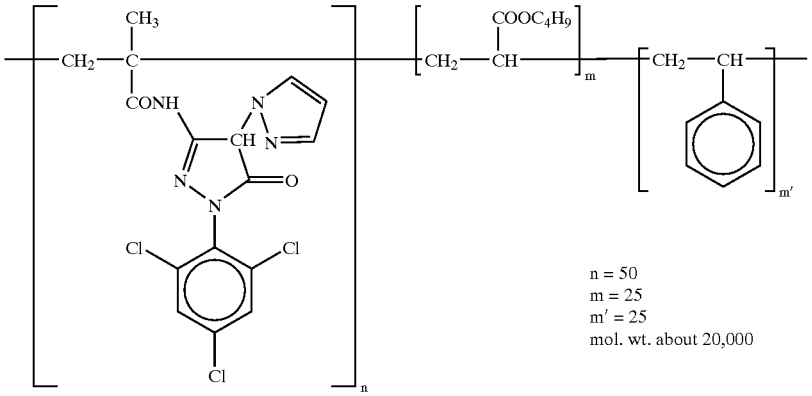
ExM-3
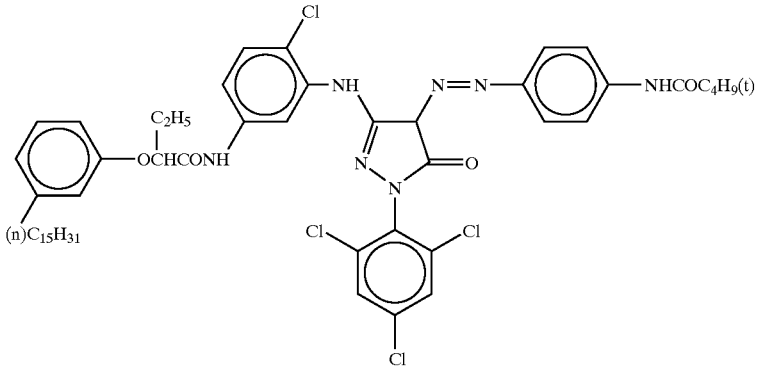
ExM-4
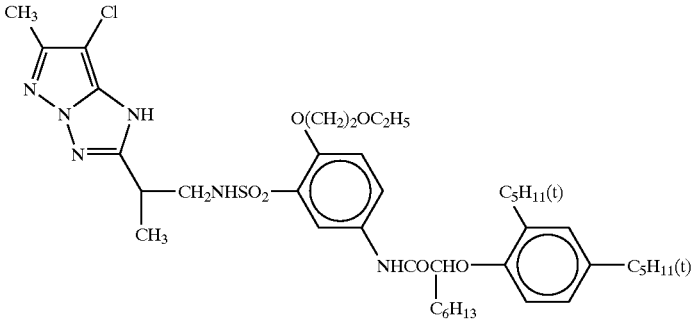

-continued
ExM-5
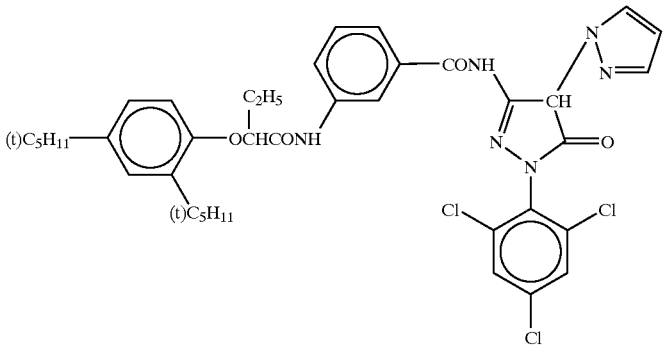
ExY-1
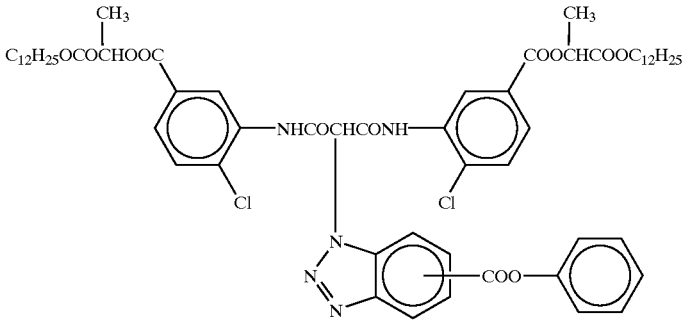
ExY-2
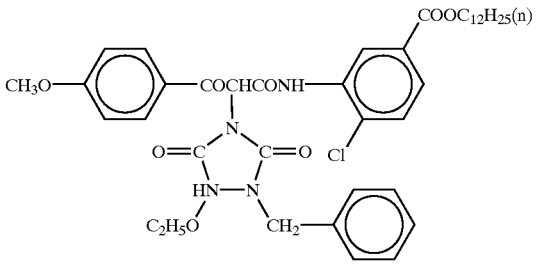
ExY-3
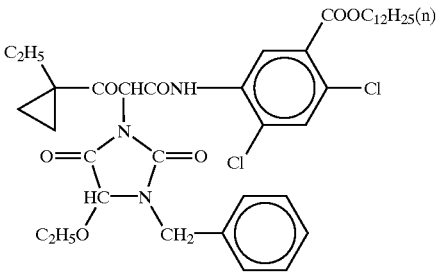
ExY-4
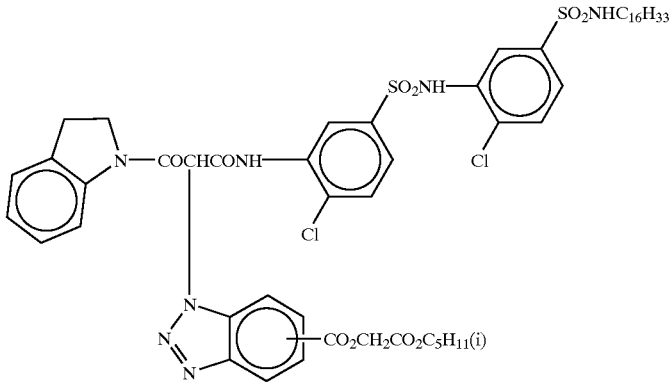

-continued
ExY-5
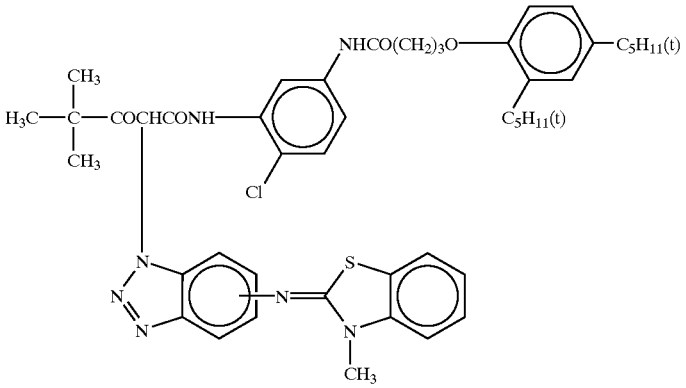
ExG-1
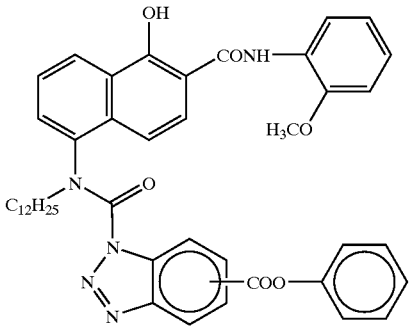
ExY-6
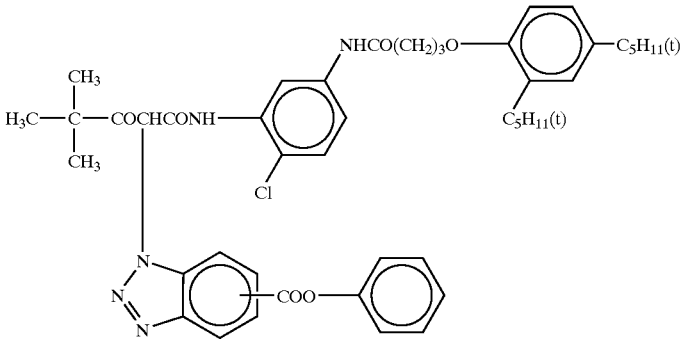
ExF-1
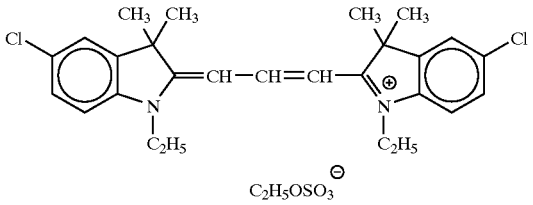
ExF-2
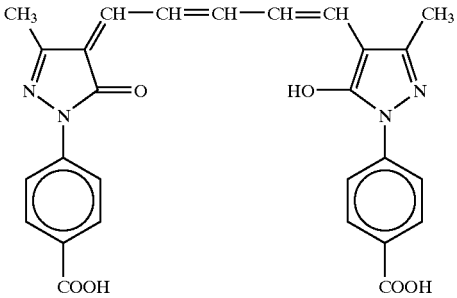
ExF-3
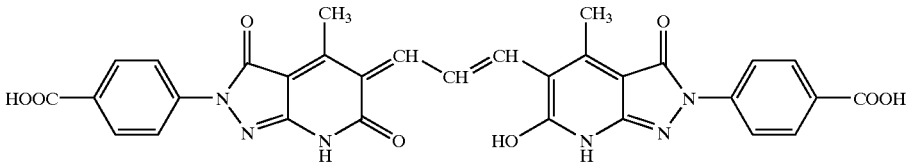

-continued
ExF-4
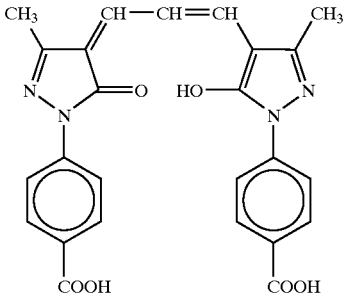
ExF-5
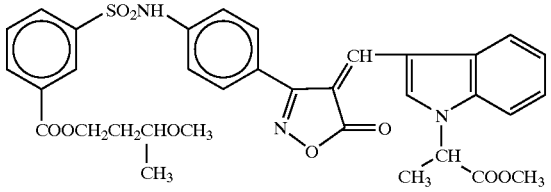
ExF-6
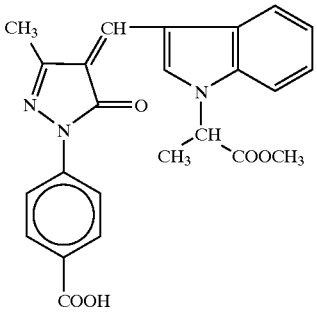
Cpd-1
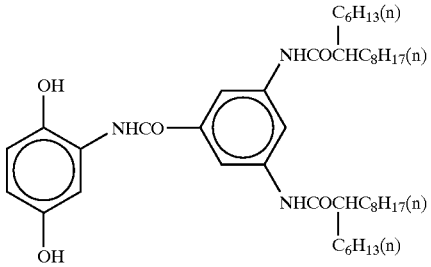
Cpd-2
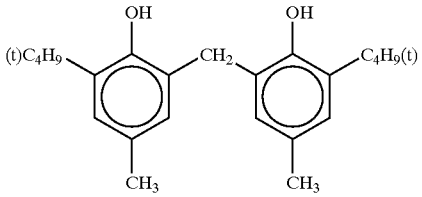
Cpd-3
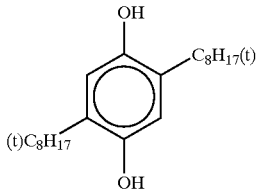
Cpd-4
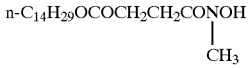
UV-1
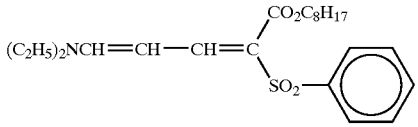
UV-2
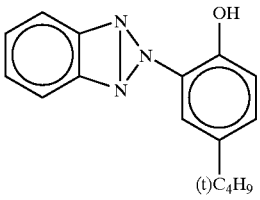
UV-3
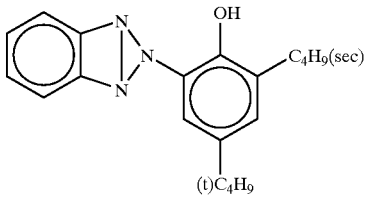
UV-4
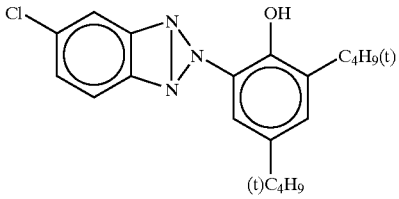
HBS-1
Tricresyl phosphate
HBS-2
Di-n-butyl phthalate
HBS-3
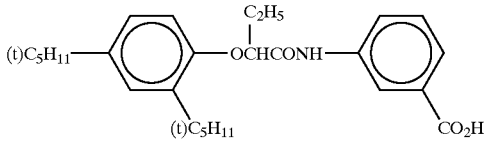
HBS-4
Tri(2-ethylhexyl) phosphate
H-1
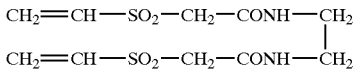

-continued
S-1
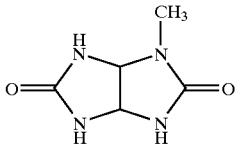
B-1
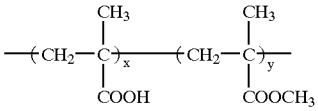
x/y = 10/90 (wt. ratio)
Av. mol. wt.: about 35,000
B-2
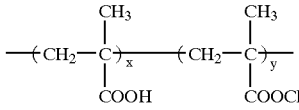
x/y = 40/60 (wt. ratio)
Av. mol. wt.: about 20,000
B-3
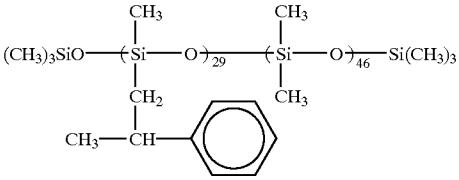
(Molar ratio)
Av. mol. wt.: about 8,000
B-4
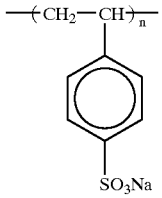
Av. mol. wt.: about 750,000
B-5
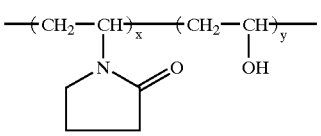
x/y = 70/30 (wt. ratio)
Av. mol. wt.: about 17,000
B-6
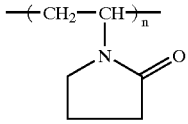
Av. mol. wt.: about 10,000
W-1
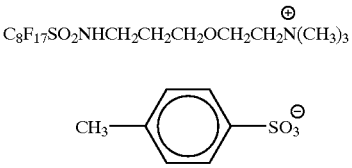
W-2
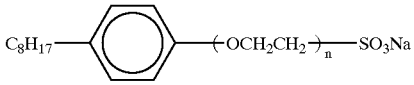
n = 2–4
W-4
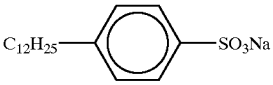
W-5
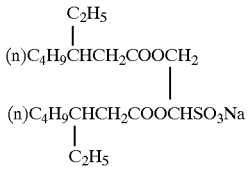
W-6
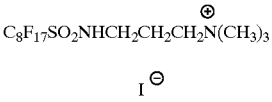
W-7
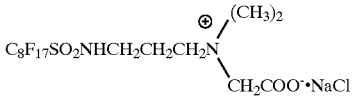
W-8
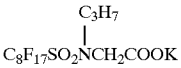
F-1
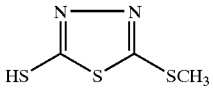
F-2
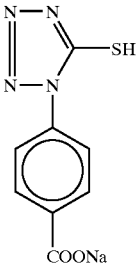

-continued
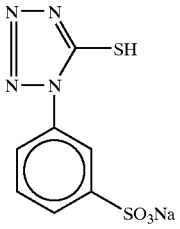
F-3
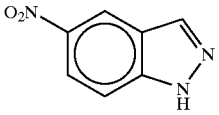
F-4
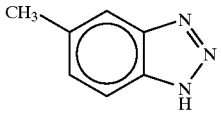
F-5
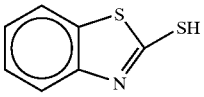
F-6
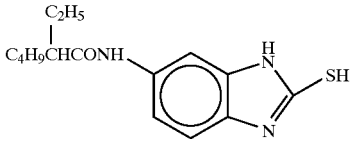
F-7
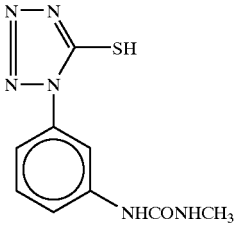
F-8
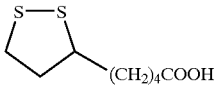
F-9
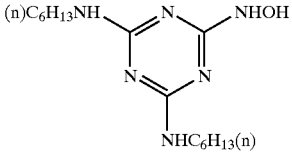
F-10
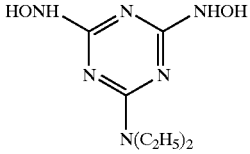
F-11
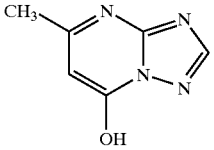
F-12
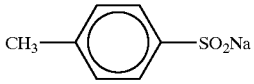
F-13
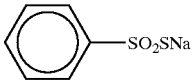
F-14
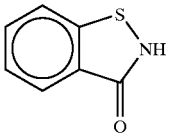
F-15
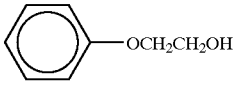
F-16
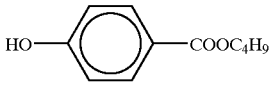
F-17
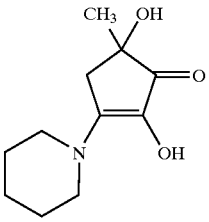
F-18

-continued

F-19

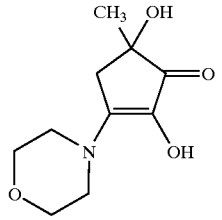

(Preparation of Samples 102 to 113)

Samples 102 to 113 were prepared in the same manner as Sample 101, except that the second, fifth, and sixth layers of Sample 101 were added with compounds described in Table 2 (type and amount).

(Evaluation of Photographic Properties)

(1) Evaluation of Speed

These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge, and development processing was performed by the following processing steps (1).

The processing steps and the processing solution compositions are presented below.

(Processing Steps)

| Step | Time | Temperature | Replenishing rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |

-continued

| | Tank solution (g) | Replenisher (g) |
|---|---|---|
| Disodium cathecol-3,5-disulfonate | 0.3 | 0.3 |
| Sodium sulfite | 3.9 | 5.3 |
| Potassium carbonate | 39.0 | 39.0 |
| Disodium-N, N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5. (Stabilizer) common to tank solution and replenisher

| | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one·sodium | 0.10 |
| Disodium ethylenediaminetetraacetate | 0.05 |
| 1,2,4-triazole | 1.3 |
| 1,4-bis (1,2,4-triazole-1-isomethyl) piperazine | 0.75 |
| Water to make | 1.0 L |
| pH | 8.5 |

The density of each of the thus processed samples was measured, and each speed was evaluated by the following method.

The speed of each of the samples was expressed as a logarithm of an inverse number of an exposure amount giving the minimum density+0.2 of cyan images, thereby to compare the samples. Evaluation was made with a difference from the result of Sample 101.

The larger this value is, the higher speed the sample has, which is preferable.

(2) Evaluation of Granularity

Uniform exposure amount that gives the minimum density+0.2 of cyan images was provided to the samples (exposure through a gelatin filter SC-39 manufactured by Fuji Photo Film Co., Ltd. for 1/100 sec exposure) and development processing was conducted with the processing steps (1).

Density measurements of the samples after the processing were conducted using a 48 $\mu$m aperture of, to evaluate the granularity using their RMS values.

Relative values in relation to the result of Sample 101 are shown.

The smaller this value is, the granularity is smaller, which is preferable.

(3) Evaluation of Fluctuation in Photographic Property Due to Development Processing Fluctuation The same experiment as in the experiment for (1), i.e., Evaluation of speed, was conducted, except that the temperature of the color developing step was changed to 39.8° C.

The fluctuation was evaluated by the difference in the minimum density of cyan images of each sample that was processed with the color development step (39.8° C.) from the minimum density of cyan images of the same sample but measured in (1).

The difference in Sample 101 was assumed to be 1.00, and relative values are shown.

The smaller this value is, the smaller the fluctuation in photographic property due to development processing fluctuation, which is preferable.

(4) Evaluation of Fluctuation in Speed Due to Storage

The same experiment as in the experiment for (1), i.e., Evaluation of speed was conducted, except that the samples were left to stand under the conditions of 40° C. and 60% RH for 2 days. As reference experiments, samples stored under the conditions of 25° C. and 60% for 2 days were evaluated in the same manner. The result of each sample is set forth as a speed change from the reference experiment.

The smaller this value is, the better.

TABLE 2

| Sample | Compound added to second layer | Compound (B) added to fifth layer | Compound (B) added to sixth layer | Speed | Granularity | Fog fluctuation due to processing | Speed fluctuation due to storage | Remarks |
|---|---|---|---|---|---|---|---|---|
| 101 | — | — | — | +0 | 1.00 | 1.00 | −0.01 | Comp. |
| 102 | — | HET-2 15 mmol/Ag1mol | HET-2 15 mmol/Ag1mol | +0.07 | 101 | 1.32 | −0.01 | Comp. |
| 103 | (61) 0.04 mmol/m$^2$ | HET-3 15 mmol/Ag1mol | HET-2 15 mmol/Ag1mol | +0.07 | 101 | 1.05 | −0.01 | Inv. |
| 104 | (7) 0.04 mmol/m$^2$ | HET-3 15 mmol/Ag1mol | HET-2 15 mmol/Ag1mol | +0.07 | 101 | 1.04 | −0.01 | Inv. |
| 105 | A-15 0.04 mmol/m$^2$ | HET-3 15 mmol/Ag1mol | HET-2 15 mmol/Ag1mol | +0.06 | 100 | 1.04 | −0.01 | Inv. |
| 106 | A-15 0.08 mmol/m$^2$ | HET-3 15 mmol/Ag1mol | HET-2 15 mmol/Ag1mol | +0.06 | 100 | 1.01 | −0.02 | Inv. |
| 107 | (7) 0.04 mmol/m$^2$ | HET-3 15 mmol/Ag1mol | HET-3 15 mmol/Ag1mol | +0.07 | 101 | 1.02 | −0.01 | Inv. |
| 108 | — | Exemplified (66) 15 mmol/Ag1mol | Exemplified (66) 15 mmol/Ag1mol | +0.09 | 101 | 1.28 | −0.01 | Comp. |
| 109 | (61) 0.04 mmol/m$^2$ | Exemplified (66) 15 mmol/Ag1mol | Exemplified (66) 15 mmol/Ag1mol | +0.09 | 101 | 1.04 | −0.01 | Inv. |
| 110 | A-15 0.04 | Exemplified (66) | Exemplified (66) | +0.09 | 101 | 1.05 | −0.01 | Inv. |

TABLE 2-continued

| Sample | Compound added to second layer | Compound (B) added to fifth layer | Compound (B) added to sixth layer | Speed | Granularity | Fog fluctuation due to processing | Speed fluctuation due to storage | Remarks |
|---|---|---|---|---|---|---|---|---|
| | mmol/m$^2$ | 15 mmol/Ag1mol | 15 mmol/Ag1mol | | | | | |
| 111 | A-15 0.04 mmol/m$^2$ | Exemplified (66) 30 mmol/Ag1mol | Exemplified (66) 30 mmol/Ag1mol | +0.15 | 101 | 1.06 | −0.01 | Inv. |
| 112 | Comparative compound (A) 0.04 mmol/m$^2$ | Exemplified (66) 15 mmol/Ag1mol | Exemplified (66) 15 mmol/Ag1mol | +0.05 | 99 | 1.15 | −0.03 | Comp. Compound of JP-A 11-271930 is used |
| 113 | Comparative compound (A) 0.08 mmol/m$^2$ | Exemplified (66) 15 mmol/Ag1mol | Exemplified (66) 15 mmol/Ag1mol | +0.04 | 98 | 1.12 | −0.05 | Comp. Compound of JP-A-11-271930 is used |

Comparative compound (A):
Exemplified compound HT-9 described in JP-A-11-271930

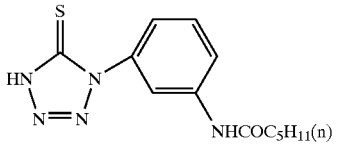

As is apparent from the results in Table 2 that the samples to which the compounds described in JP-2000-194085 are added to the fifth and sixth layers, increment in speed is apparent but the fluctuation in photographic property due to the fluctuation in development processing is large.

In the samples to which the development inhibitor-releasing compound is added to the second layer, it is apparent that the fluctuation in photographic property due to the fluctuation in development processing is decreased. The similar results are apparent in Samples 108 to 111.

When the exemplified compound HT-9 (hereinafter referred to as comparative compound (A)) described in JP-A-11-271930 is added to the second layer, the decrement in the fluctuation of photographic property due to the fluctuation in development processing is not satisfactory, and speed enhancement is also small.

From the above results, only the means of the present invention can attain the photosensitive materials whose speed, granularity, fluctuation in photographic properties due to fluctuation in processing and storage, are excellent at the same time.

Example 2

The same samples as Samples 102, 104 and 105 were prepared in the same manner as Samples 102, 104 and 105, respectively, except that exemplified compound HET-2 of Compound (B) was added to each of the tenth, eleventh and fourteenth layers in an amount of 10 millimole per mol of silver halide. The thus prepared samples were designated Samples 202, 204 and 205, respectively.

The same samples as Samples 108, 109 and 110 were prepared in the same manner as Samples 108, 109 and 110, respectively, except that exemplified compound (62) of Compound (B) was added to each of the tenth, eleventh and fourteenth layers in an amount of 10 millimole per mol of silver halide. The thus prepared samples were designated Samples 208, 209 and 210, respectively.

The same evaluations as in Example 1 were conducted. As a result, advantage in enhancement of speed was recognized in all of cyan image, magenta images and yellow images. Table 3 shows the advantage in the decreasing in fog fluctuation due to processing. Results are shown by the relative values to Sample 202.

TABLE 3

| Sample | Fog fluctuation of cyan images | Fog fluctuation of magenta images | Fog fluctuation of yellow images | Remarks |
|---|---|---|---|---|
| 202 | 1.00 | 1.00 | 1.00 | Comp. |
| 204 | 0.78 | 0.92 | 0.98 | Inv. |
| 205 | 0.79 | 0.94 | 1.01 | Inv. |
| 208 | 0.97 | 0.98 | 0.98 | Comp. |
| 209 | 0.80 | 0.93 | 0.97 | Inv. |
| 210 | 0.81 | 0.94 | 1.01 | Inv. |

It is understood from Table 3 that the advantage in decreasing fog fluctuation are apparent in the samples of the present invention.

In Samples 205 and 210, although the fog fluctuation of yellow images slightly increases, the advantages in decreasing fog fluctuation of cyan and magenta images are large.

Samples 204 and 209 to which the development inhibitor-releasing coupler is added to the second layer, and which coupler does not substantially generate color after it releases a development-inhibiting group, show much smaller fog fluctuation of also yellow images, which is preferable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material comprising at least one light-sensitive silver halide emulsion layer and at least one nonlight-sensitive layer, wherein at least one of the nonlight-sensitive layers contains colloidal silver; the colloidal silver-containing nonlight-sensitive layer or a nonlight-sensitive layer adjacent to the colloidal silver-containing nonlight-sensitive layer contains a compound capable of releasing a development inhibitor or a precursor thereof by a coupling reaction with an oxidized developing agent; and at least one layer selected from the group consisting of the light-sensitive silver halide emulsion layer and the nonlight-sensitive layer contains a compound (B) defined below:

compound (B): a compound having at least three hetero atoms and capable of enhancing the photographic speed of the photosensitive material in comparison to the same photosensitive materials without the compound.

2. The silver halide color photosensitive material according to claim 1, wherein the compound capable of releasing a development inhibitor or a precursor thereof is a compound which generates substantially no color after the release of the development inhibitor or the precursor thereof.

3. The silver halide color photosensitive material according to claim 1, wherein the compound (B) is a 1,3,4,6-tetraazaindene-based compound.

4. The silver halide color photosensitive material according to claim 1, wherein the compound (B) is represented by the following general formula (M) or (C):

(M)

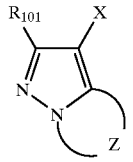

-continued (C)

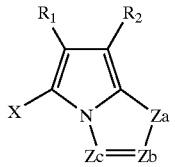

wherein in the general formula (M), $R_{101}$ represents a hydrogen atom or substituent; Z represents a group of non-metallic atoms required to form a 5-membered azole ring containing 2 to 4 nitrogen atoms, wherein the azole ring may have a substituent or may have a condensed ring attached thereto; and X represents hydrogen atom or substituent; and in the general formula (C), Za represents —NH—or —CH($R_3$)—; Zb and Zc independently represent —C($R_4$)= or —N=; each of $R_1$, $R_2$ and $R_3$ independently represents an electron-withdrawing group having a Hammett's substituent constant σp of not less than 0.2 and not more than 1.0; $R_4$ represents a hydrogen atom or substituent, provided that when there are two or more $R_4$s, they may be the same or different; and X represents a hydrogen atom or substituent.

5. The silver halide color photosensitive material according to claim 1, wherein the at least one of the colloidal silver-containing nonlight-sensitive layers is selected from the group consisting of a protective layer, an inter layer and an antihalation layer.

6. The silver halide color photosensitive material according to claim 1, wherein the colloidal silver-containing nonlight-sensitive layer contains the compound capable of releasing a development inhibitor or the precursor thereof.

* * * * *